US006643482B2

(12) United States Patent
Higeta et al.

(10) Patent No.: US 6,643,482 B2
(45) Date of Patent: Nov. 4, 2003

(54) REMANUFACTURING METHOD FOR PROCESS CARTRIDGE

(75) Inventors: Akira Higeta, Funabashi (JP); Satoshi Yasuda, Tokyo (JP); Yoshiyuki Kakumi, Tuchiura (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/884,954

(22) Filed: Jun. 21, 2001

(65) Prior Publication Data

US 2002/0041774 A1 Apr. 11, 2002

(30) Foreign Application Priority Data

Jun. 28, 2000 (JP) ..... 2000-194564

(51) Int. Cl.[7] ..... G03G 15/00
(52) U.S. Cl. ..... 399/109; 399/111; 399/113
(58) Field of Search ..... 399/107, 109, 399/111, 113, 114

(56) References Cited

U.S. PATENT DOCUMENTS

| | | | | |
|---|---|---|---|---|
| 5,331,373 | A | 7/1994 | Nomura et al. | |
| 5,452,056 | A | 9/1995 | Nomura et al. | |
| 5,485,249 | A | 1/1996 | Higeta et al. | |
| 5,585,889 | A | 12/1996 | Shishido et al. | |
| 5,740,499 | A | 4/1998 | Higeta et al. | 399/105 |
| 5,809,374 | A | 9/1998 | Tsuda et al. | 399/111 |
| 5,839,028 | A | 11/1998 | Nomura et al. | 399/109 |
| 6,101,348 | A | 8/2000 | Nonaka et al. | 399/103 |
| 6,185,390 | B1 | 2/2001 | Higeta et al. | 399/90 |
| 6,397,025 | B1 * | 5/2002 | Higeta et al. | 399/109 |

FOREIGN PATENT DOCUMENTS

| | | |
|---|---|---|
| JP | 8-305258 | 11/1996 |
| JP | 9-62079 | 3/1997 |

* cited by examiner

*Primary Examiner*—Hoang Ngo
(74) *Attorney, Agent, or Firm*—Fitzpatrick, Cella, Harper & Scinto

(57) ABSTRACT

A remanufacturing method for a process cartridge detachably mountable to a main assembly of an electrophotographic image forming apparatus, the process cartridge including a first unit supporting an electrophotographic photosensitive drum and a second unit supporting a developing roller for developing an electrostatic latent image formed on the electrophotographic photosensitive drum and having a developer accommodating portion accommodating a developer to be used for development of the electrostatic latent image by the developing roller, the first unit and the second unit being rotatably coupled, the method including (a) a unit separating step of separating the first unit and the second unit from each other; (b) a developer filling step of filling the developer into the developer accommodating portion of the second unit; (c) a unit coupling process of coupling the first unit and the second unit with each other; and (d) a tape affixing step of removably affixing a tape along an outer surface of the first unit, an outer surface of a drum shutter for covering such a portion of the electrophotographic photosensitive drum which is exposed from the first unit and a second unit, an outer surface of the second unit.

34 Claims, 30 Drawing Sheets

REMANUFACTURING METHOD FOR PROCESS CARTRIDGE

FIELD OF THE INVENTION AND RELATED ART

The present invention relates to a remanufacturing method for a process cartridge.

Here, the process cartridge is a cartridge containing at least a developing roller as developing means and an electrophotographic photosensitive member as a unit, the cartridge being detachably mountable to a main assembly of an electrophotographic image forming apparatus. The process cartridge may contain an electrophotographic photosensitive member and at least one of charging means, developing means and cleaning means as a unit detachably mountable to the main assembly of the image forming apparatus. The process cartridge may contain at least an electrophotographic photosensitive member and developing means a unit detachably mountable to the main assembly of the image forming apparatus.

The electrophotographic image forming apparatus is an apparatus in which an image is formed on a recording material (recording paper, textile or the like) using an electrophotographic image forming process, and includes an electrophotographic copying machine, an electrophotographic printer (a LED printer, laser beam printer and so on), an electrophotographic printer type facsimile machine, an electrophotographic word processor and the like.

In an electrophotographic image forming apparatus using an electrophotographic image forming process, a process cartridge is used which integrally contains an electrophotographic photosensitive member and process means actable on the electrophotographic photosensitive member, the process cartridge being detachably mountable to the main assembly of the electrophotographic image forming apparatus. With this process cartridge type, the maintenance of the apparatus can be carried out in effect without service people. Therefore, the process cartridge type is widely used in the field of the electrophotographic image forming apparatus.

Such a process cartridge forms an image on recording material with toner. Therefore, the toner is consumed in accordance with image forming operations. When the toner is consumed up to such an extent that user is not satisfied with the image quality, the commercial value of the process cartridge is lost.

It is desired that such a used process cartridge are is given the commercial value, again by remanufacturing the process cartridge through easy method.

SUMMARY OF THE INVENTION

Accordingly, it is a principal object of the present invention to provide a simple remanufacturing method for a process cartridge.

It is another object of the present invention to provide a remanufacturing method for a process cartridge and a process cartridge, wherein leakage of developer to outside of the process cartridge is effectively prevented when the process cartridge is carried or transported.

It is a further object of the present invention to provide a remanufacturing method for a process cartridge, wherein a process cartridge which has been consumed to such an extent that produced images are not satisfactory due to the consumption of the developer and therefore which has lost its commercial value, can be given a commercial value.

According to an aspect of the present invention, there is provides a remanufacturing method for a process cartridge detachably mountable to a main assembly of an electrophotographic image forming apparatus, the process cartridge including a first unit supporting an electrophotographic photosensitive drum and a second unit supporting a developing roller for developing an electrostatic latent image formed on the electrophotographic photosensitive drum and having a developer accommodating portion accommodating a developer to be used for development of the electrostatic latent image by the developing roller, the first unit and the second unit being rotatably coupled, the method comprising:

(a) a unit separating step of separating the first unit and the second unit from each other;

(b) a developer filling step of filling the developer into the developer accommodating portion of the second unit;

(c) a unit coupling process of coupling the first unit and the second unit with each other; and (d) a tape affixing step of removably affixing a tape along an outer surface of the first unit, an outer surface of a drum shutter for covering such a portion of the electrophotographic photosensitive drum which is exposed from the first unit and a second unit, an outer surface of the second unit.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 7(*b*) is a perspective view of an outer appearance of a developing unit of the process cartridge shown in FIG. 3.

FIG. 10(*b*) is a perspective view of an inside of a developing device holder.

FIG. 18(*b*) is two views showing a shape of a locking claw of a connecting member.

DESCRIPTION OF THE PREFERRED EMBODIMENTS

First, the overall structures of the image forming apparatus and process cartridge in this embodiment of the present invention will be described, and then, the method for overhauling the process cartridge will be described. Lastly, each of the process cartridge overhauling processes, and the process cartridge reassembled through the overhauling process, will be described. The shorter dimension direction of a process cartridge B means the direction in which the process cartridge B is mounted into, or dismounted from, the apparatus main assembly 14, and coincides with the direction in which recording medium is conveyed. The longer dimension direction, or the longitudinal direction, of the process cartridge means the direction which intersects (approximately perpendicular to) with the direction in which the process cartridge B is mounted into, or dismounted from, the apparatus main assembly 14, and intersects (approximately perpendicularly to) with the direction in which the recording medium is conveyed. Also it is parallel to the surface of the recording medium.

Figure 1:
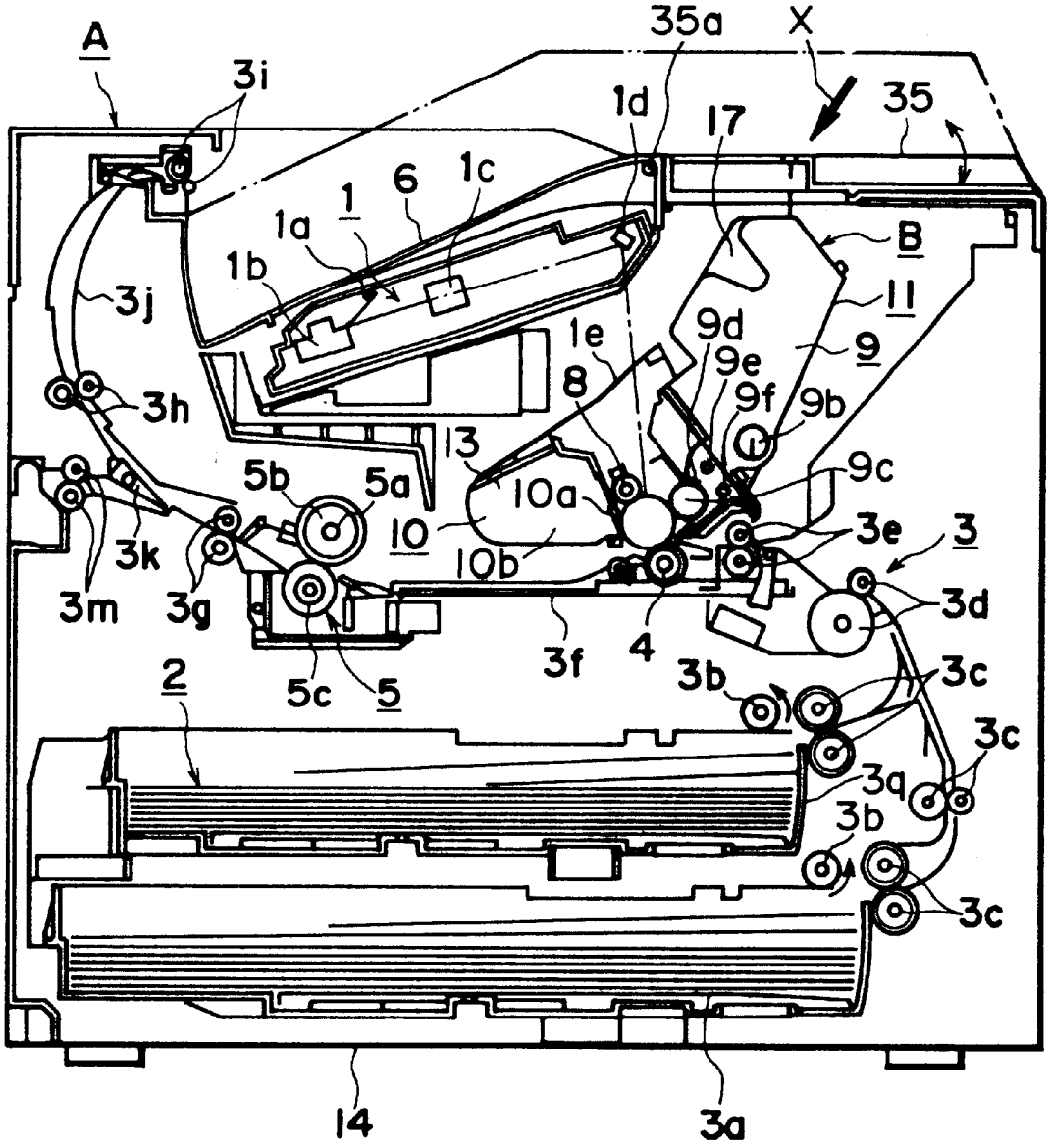
FIG. 1 is a sectional view of an electrophotographic image forming apparatus according to an embodiment of the present invention.
Figure 2:
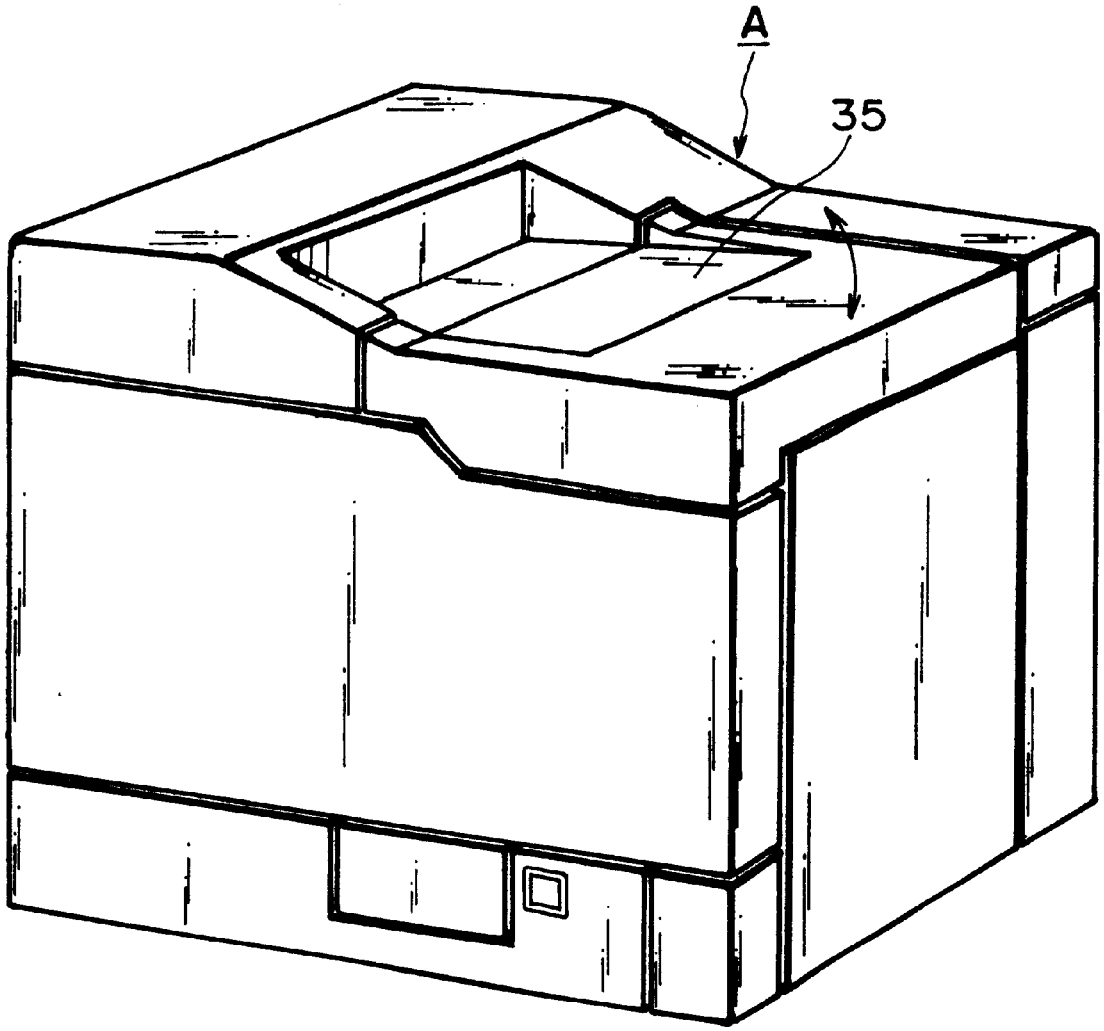
FIG. 2 shows a perspective view of an outer appearance of the apparatus shown in FIG. 1.
Figure 3:
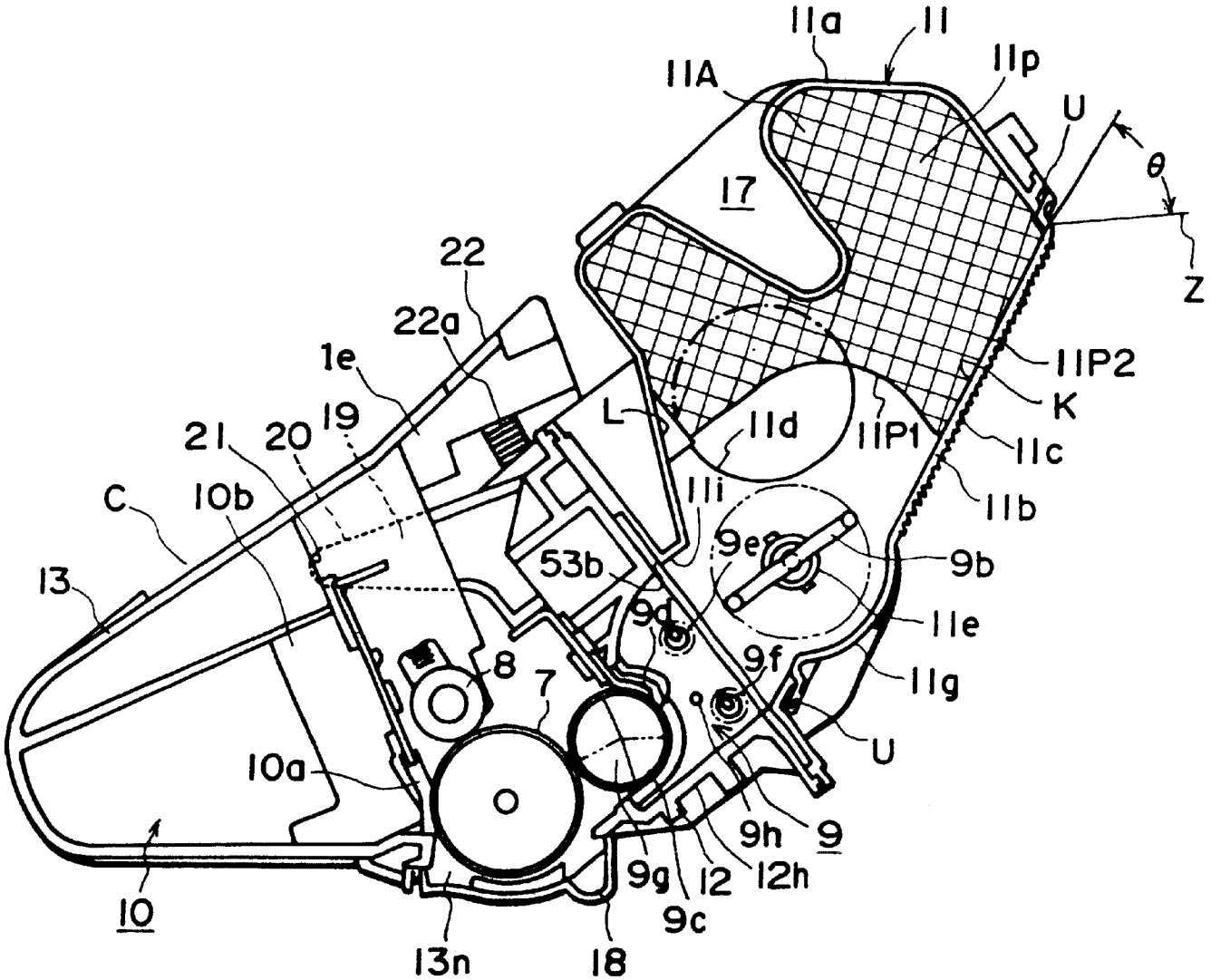
FIG. 3 is a sectional view of a process cartridge according to an embodiment of the present invention.
Figure 4:
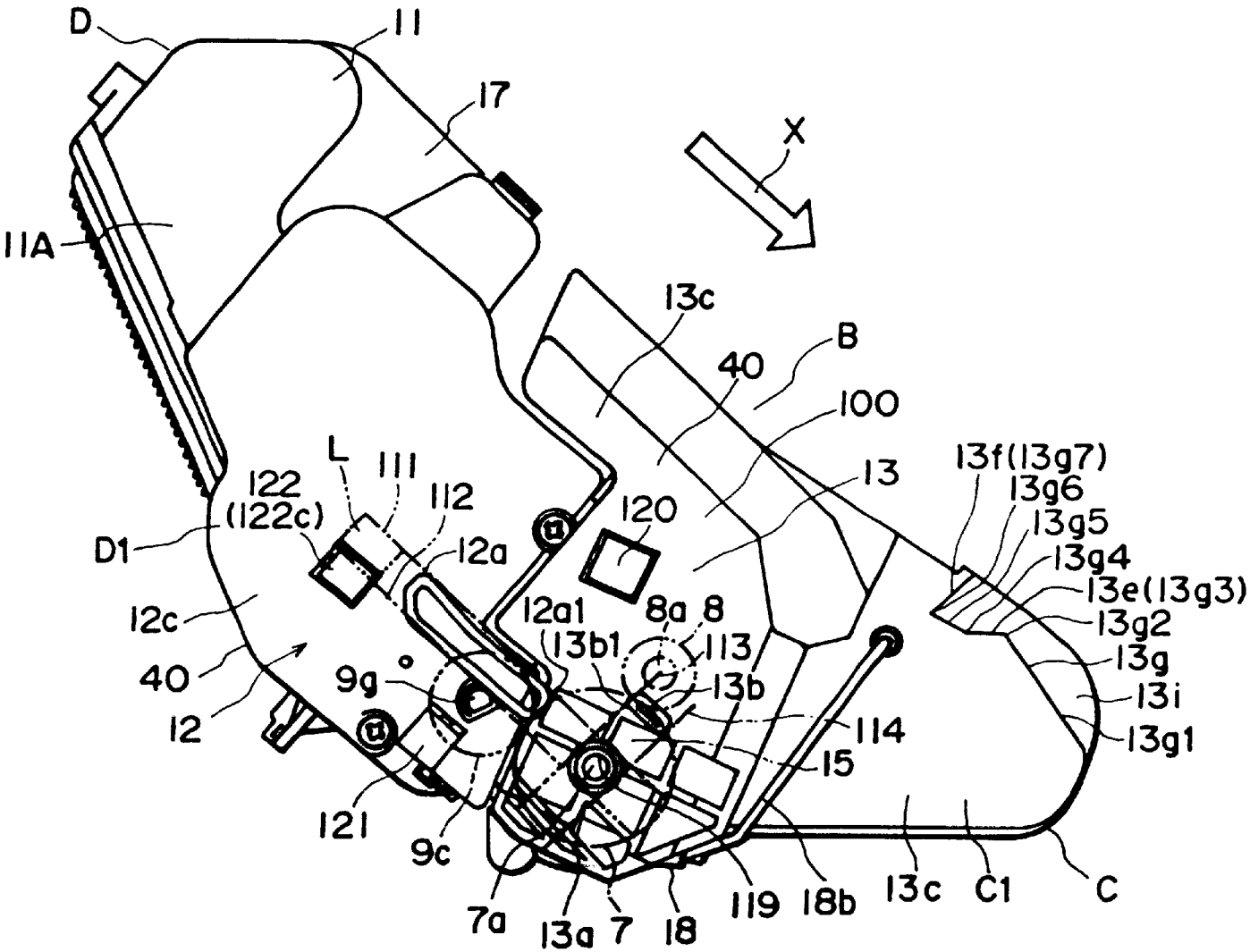
FIG. 4 is a right side view of the process cartridge shown in FIG. 3.
Figure 5:
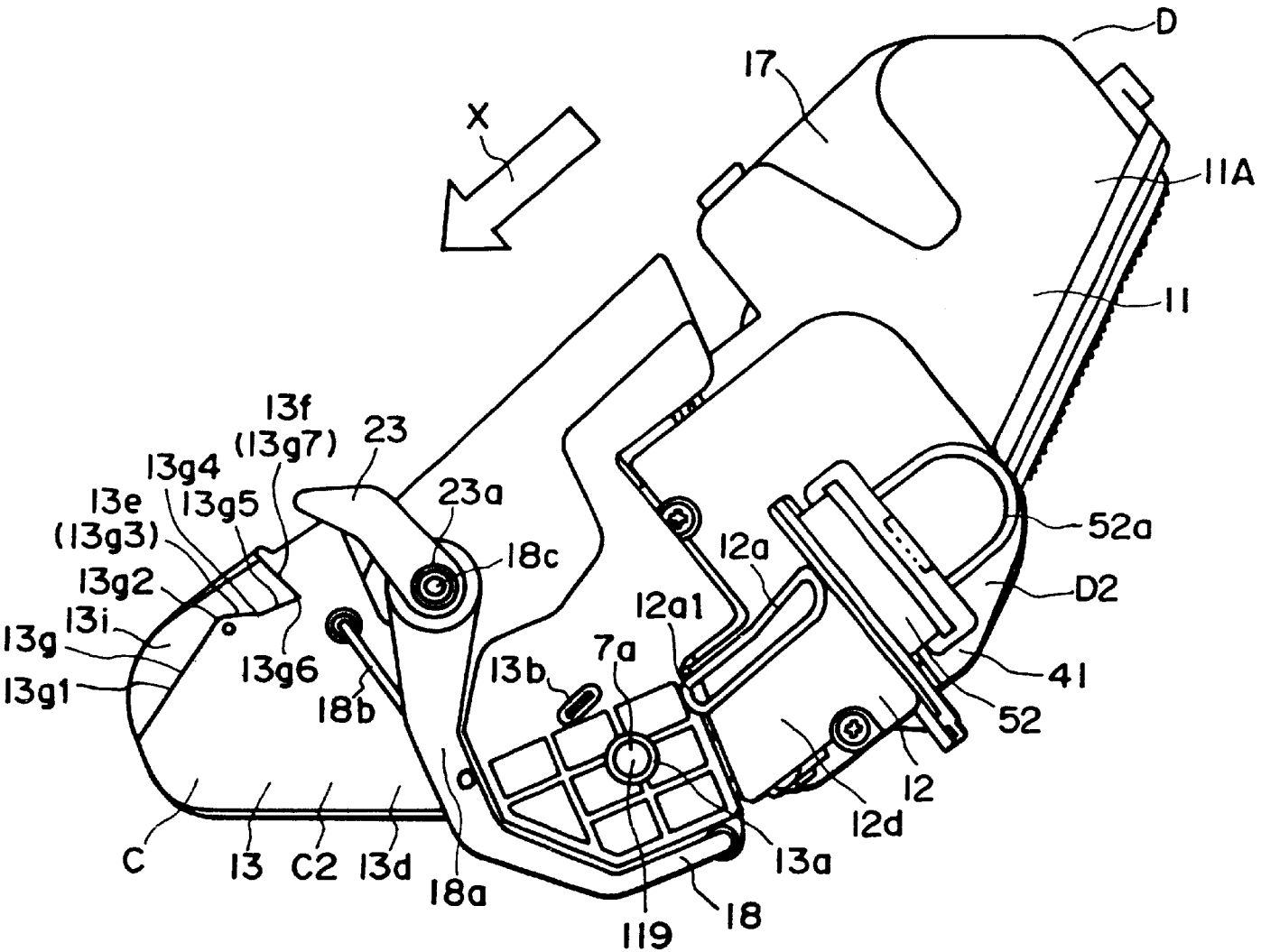
FIG. 5 is a left side view of the process cartridge shown in FIG. 3.
Figure 6:
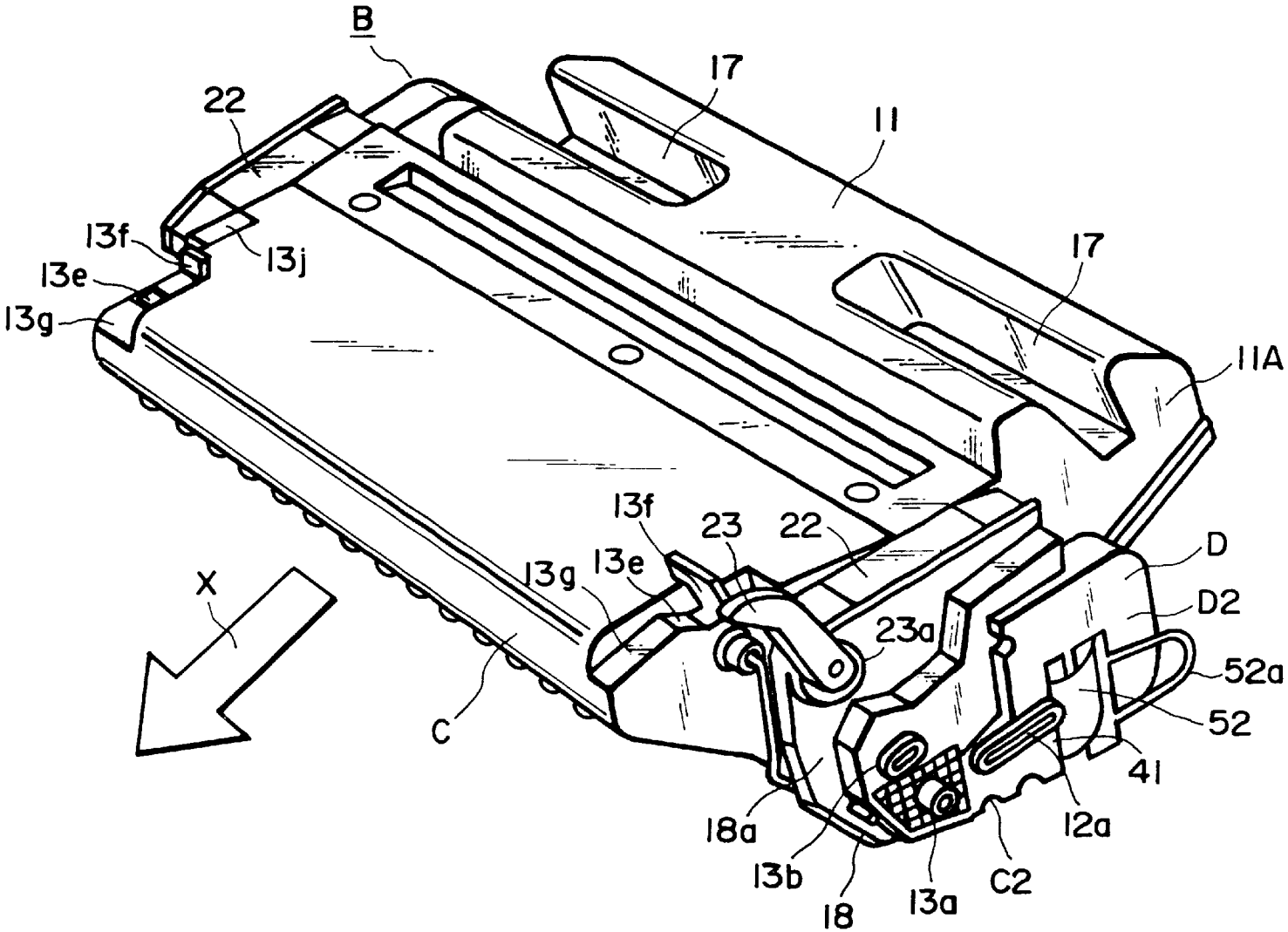
FIG. 6 shows a perspective view of an outer appearance of the process cartridge shown in FIG. 3.

FIG. 1 is an electrophotographic image forming apparatus (laser beam printer) in accordance with the present invention, and describes the general structure thereof. FIG. 2 is an external perspective view of the apparatus in FIG. 1. FIGS. 3–6 are drawings related to a process cartridge in accordance with the present invention. FIG. 3 is a sectional view of the process cartridge at a plane parallel to the shorter dimension direction, and FIG. 4 is a right side view of the process cartridge. FIG. 5 is a left side view of the process cartridge, and FIG. 6 is a perspective view of the process cartridge, as seen from above the right front of the process cartridge. The top and bottom sides of the process cartridge mean the sides which are on the top and bottom sides, respectively, when the process cartridge B is in the apparatus main assembly 14. The left and right sides of the process cartridge B means the left and right sides of the process cartridge B as seen from diagonally above the upstream side in terms of the direction in which the process cartridge B is inserted into the apparatus main assembly 14.

First, referring to FIGS. 1 and 2, a laser beam printer A as an electrophotographic image forming apparatus in accordance with the present invention will be described. Given in FIG. 3 is the sectional view of the process cartridge B at a plane parallel to the shorter dimension direction of the process cartridge B. Referring to FIG. 1, this laser beam printer A forms an image on recording medium (for example, recording paper, OHP sheet, fabric, and the like) through an electrophotographic image formation process; it forms a visible image (hereinafter, "toner image") on an electrophotographic photosensitive member (hereinafter, "photosensitive drum") with the use of developer (hereinafter, "toner"). More specifically, the photosensitive drum is charged by a charging means, and the charged photosensitive drum is exposed to a laser beam projected, while being modulated with the image formation data, from an optical means. As a result, a latent image in accordance with the image formation data is formed on the photosensitive drum. This latent image is developed into a toner image by a developing means. Meanwhile, a recording medium 2 which has been held in a cassette 3*a* is conveyed, while being reversed once, from the cassette 3*a* by a pickup roller 3*b*, conveyer roller pairs 3*c* and 3*d*, and a registration roller pair 3*e*, in synchronism with the formation of the toner image. The toner on the photosensitive drum in the process cartridge B is transferred onto the recording medium 2 by applying voltage to a transfer roller 4 as a transferring means. After the transfer of the toner image onto the recording medium 2, the recording medium 2 is conveyed, by a conveyance guide 3*f*, to a fixing means 5 which contains a driver roller 5*c* and a fixing roller 5*b*. The fixing roller 5*b* contains a heater 5*a*. In the fixing means 5, the toner image is fixed to the recording medium 2 through the application of pressure and heat. Thereafter, the recording medium 2 is conveyed further and discharged into a delivery tray 6 through a reversing path 3*j*, by discharge roller pairs 3*g*, 3*h* and 3*i*. This delivery tray 6 is located on top of the main assembly 14 of the image forming apparatus A. Incidentally, a pivotal flapper 3*k* may be pivoted so that the recording medium 2 is discharged by a discharge roller pair 3*m* without being passed through a reversing path 3*j*. In this embodiment, the aforementioned pickup roller 3*b*, conveyer roller pairs 3*c* and 3*d*, registration roller pair 3*e*, conveyance guide 3*f*, discharge roller pairs 3*g*, 3*h* and 8*i*, and discharge roller pair 3*m*, together constitute a conveying means 3.

Referring to FIGS. 3 and 6, in the aforementioned process cartridge B, the photosensitive drum 7 having a photosensitive layer 7*e* (FIG. 7) is rotated, and as it is rotated, its peripheral surface is uniformly charged by applying voltage to a charge roller 8 as a charging means. Next, a laser beam modulated with image formation data is projected from an optical system 1 onto the photosensitive drum 7 through an exposure opening 1*c*. As a result, a latent image is formed on the photosensitive drum 7. This latent image is developed (visualized) by a developing means 9 which uses toner. More specifically, the charge roller 8 is placed in contact with the photosensitive drum 7 to charge the photosensitive drum 7. It is rotated by the rotation of the photosensitive drum 7. The developing means 9 supplies the portion of the photosensitive drum 7 in the development station with toner so that the latent image on the photosensitive drum 7 is developed. The optical system 1 comprises a laser diode 1*a*, a polygon mirror 1*b*, a lens 1*c*, and a reflection mirror 1*d*.

As for the developing means 9, the toner within a toner container 11A is sent out to a development roller 9*c* by the rotation of a toner sending member 9*b*. As the development roller 9*c*, in which a stationary magnet is positioned, is rotated, a toner layer is formed on the development roller 9*c* by a development blade 9*d*, while being triboelectrically charged by the development blade 9*d*, and the toner on the development roller 9*c* is supplied to the portion of the photosensitive drum 7 in the development station, so that the toner transfers onto the photosensitive drum 7 in accordance with the latent image. As a result, a toner image, or a visible image, is formed on the photosensitive drum. The development blade 9*d* regulates the amount of the toner coated on the peripheral surface of the development roller 9*c*. In the adjacencies of the development roller 9*c*, toner stirring members 9*e* and 9*f* for circulating the toner within the development chamber are rotationally attached.

To the transfer roller 4, such voltage that is opposite in polarity to the toner image is applied. As a result, the toner image on the photosensitive drum 7 is transferred onto the recording medium 2. Thereafter, the toner remaining on the photosensitive drum 7 is removed by a cleaning means 10. The cleaning means 10 comprises an elastic cleaning blade 10*a*, which is placed in contact with the photosensitive drum 7. The cleaning blade 10 scrapes down the toner remaining on the photosensitive drum 7, and collects it into a toner bin 10*b* for the removed toner.

The process cartridge B comprises a toner holding frame 11 and a developing means holding frame 12, which are connected to each other. The toner holding frame 11 has a toner container (toner storing portion) 11A for storing toner, and the developing means holding frame 12 holds the developing means 9 such as the development roller 9*c*. The process cartridge B also comprises a cleaning means holding frame 13 to which the photosensitive drum 7, cleaning means 10 such as the cleaning blade 10*a*, and charge roller 8 are attached. The cleaning means holding frame 13 is connected to the combination of the toner holding frame 11 and developing means holding frame 12. The process cartridge B is removably mountable in the apparatus main assembly 14 by an operator.

The process cartridge B is provided with the exposure opening 1*e* through which a light beam modulated with image formation data is projected onto the photosensitive drum 7, and a transfer opening 13*n* through which the peripheral surface of the photosensitive drum 7 is placed in contact with the recording medium 2. More specifically, the exposure opening 1*e* belongs to the cleaning means holding frame 13, and the transfer opening 13*n* is between the developing means holding frame 12 and cleaning means holding frame 13.

Next, the structure of the process cartridge B in this embodiment will be described. The process cartridge B in this embodiment comprises the toner holding frame 11, developing means holding frame 12, and cleaning means holding frame 13. More specifically, the toner holding frame 11 and developing means holding frame 12 are connected to each other, and the cleaning means holding frame 13 is rotationally connected to the combination of the toner holding frame 11 and developing means holding frame 12. In other words, the aforementioned photosensitive drum 7, charge roller 8, developing means 9, cleaning means 10, and the like are integrally placed in the corresponding frames so that they can be removably mounted in a cartridge mounting means in the apparatus main assembly 14.

Structure Frame of Process Cartridge

In the process cartridge B in this embodiment, the toner holding frame 11, developing means holding frame 12, and cleaning means holding frame 13 are joined to form the frame of the process cartridge B. This process cartridge B frame will be described next.

Referring to FIG. 3, the toner sending member 9*b* is rotationally attached to the toner holding frame 11. The development roller 9*c* and developing blade 9*d* are attached to the developing means holding frame 12, and also the stirring members 9*e* and 9*f* for circulating the toner within the development chamber are attached to the developing means holding frame 12, being positioned in the adjacencies of the development roller 9*e*. Also a rod antenna 9*h* is attached to the developing means holding frame 12, extending approximately in parallel to the development roller 9*c*. The toner holding frame 11 and developing means holding frame 12 are welded (in this embodiment, by ultrasonic welding) to each other, forming a development unit D (FIG. 7(*b*)) as a second frame portion of the process cartridge B.

To the cleaning means holding frame 13, the photosensitive drum 7, charge roller 8, and cleaning means 10 are attached. Also attached to the cleaning means holding frame 13 is a drum shutter 18 for preventing the photosensitive drum 7 from being exposed to ambient light for an extended length of time, and also from coming in contact with foreign objects, by covering the photosensitive drum 7 as the process cartridge B is removed from the apparatus main assembly 14. A combination of the photosensitive drum 7, charge roller 8, cleaning means 10, cleaning means holding frame 13, and drum shutter 18 constitutes a cleaning unit C (FIG. 7(*a*)) as a first frame portion of the process cartridge B.

The development unit D and cleaning unit C are connected to each other, in a manner to be pivotal relative to each other, with the use of a pair of connecting members 22, forming the process cartridge B. More specifically, referring to FIG. 7, the developing means holding frame 12 is provided with a pair of arms 19, which are located one for one at the longitudinal ends of the developing means holding frame 12. From the end of each arm 19, a rotational axis 20 is extended in the longitudinal direction of the developing means holding frame 12 (FIG. 7(*b*)). On the other hand, the cleaning means holding frame 13 is provided with a pair of recesses, which are located one for one at the longitudinal ends of the cleaning means holding frame 13, and in which the pair of rotational axes 20 are placed one for one (FIG. 7(*a*)) to be accurately fixed in its position relative to the cleaning means holding frame 13. As the rotational axes 20 are placed in the corresponding rotational axis positioning recesses 21, and the connecting members 22 (FIGS. 18 and 19) are attached to the cleaning means holding frame 13, the development unit D and cleaning unit C are connected to each other in a manner to be pivotal relative to each other about the rotational axes 20. The developing means holding frame 12 is kept pressed downward by a compression spring 22*a* attached to each connecting member 22, assuring that the development roller 9*c* is kept pressed toward the photosensitive drum 7. Further, each longitudinal end of the development roller 9*c* is fitted with a spacer ring 9*i*, the diameter of which is greater than that of the development roller 9*c*. Therefore, the spacer rings 9*i* are pressed upon the photosensitive drum 7, assuring that a predetermined gap (approximately 300 $\mu$m) is maintained between the peripheral surfaces of the photosensitive drum 7 and development roller 9*c*. In other words, the development unit D and cleaning unit C are made pivotal relative to each other about the axes 20. Thus, the positional relationship between the peripheral surfaces of the photosensitive drum 7 and development roller 9*c* can be maintained by the resiliency of the compression springs 22*a*.

Structure of Process Cartridge Guiding Means

Next, the guiding means for guiding the process cartridge B when the process cartridge B is mounted into, or dismounted from, the apparatus main assembly 14 will be described. The guiding means is shown in FIGS. 4–6. FIG. 4 is a plan of the right side of the process cartridge B as seen from the trailing side of the direction (indicated by an arrow mark) in which the process cartridge B is inserted into the apparatus main assembly 14 of the image forming apparatus A. FIG. 5 is a plan view of the left side of the process cartridge B.

Referring to the drawings, the external shell 100, or the frame of the process cartridge B, is provided with a pair of guiding means, which are located one for one at the longitudinal ends of the process cartridge B to guide the process cartridge B when the process cartridge B is mounted into, or dismounted from, the apparatus main assembly 14. Each guiding means comprises a cylindrical guide 13*a* as a first guiding member, a long guide 12*a* as a second guiding member, and a short guide 13*b* as a third guiding member.

Figure 10:
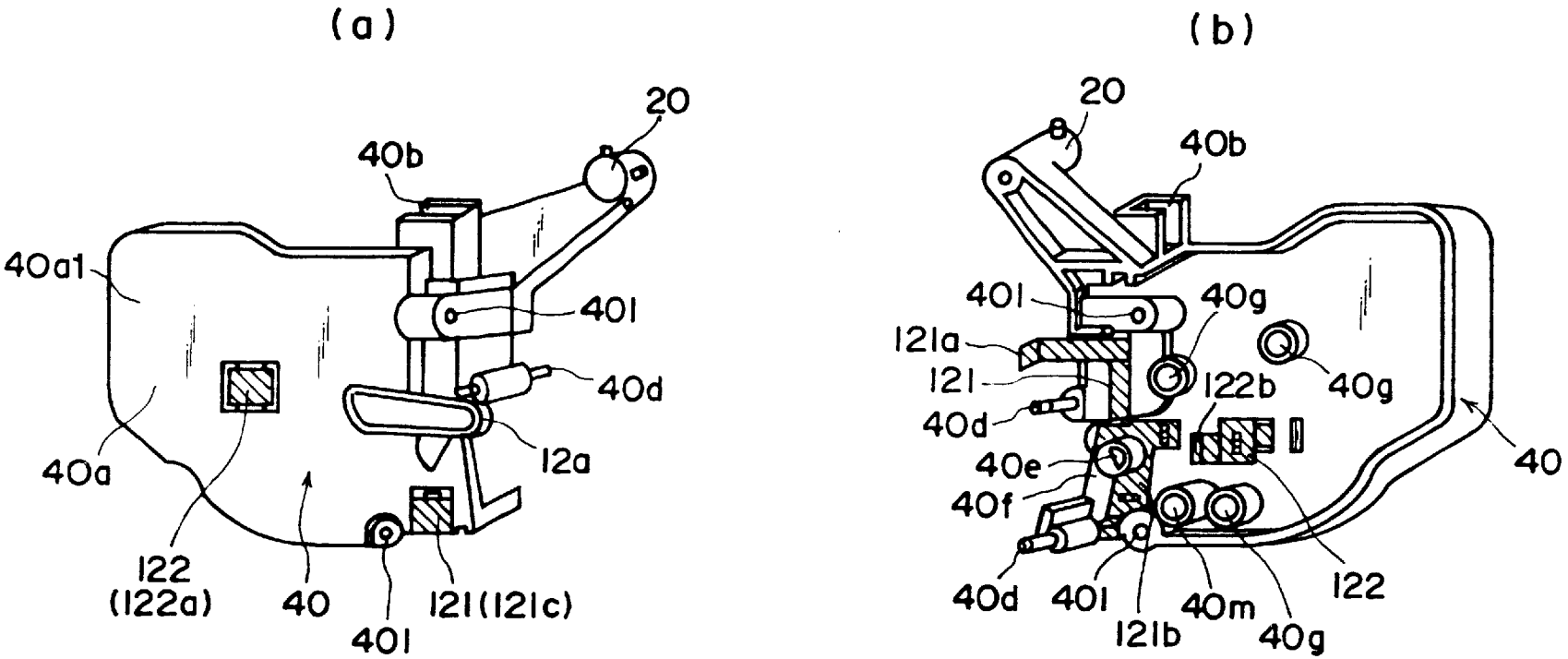
FIG. 10(*a*) is a perspective view of an outer appearance of a developing device holder.
Figure 22:
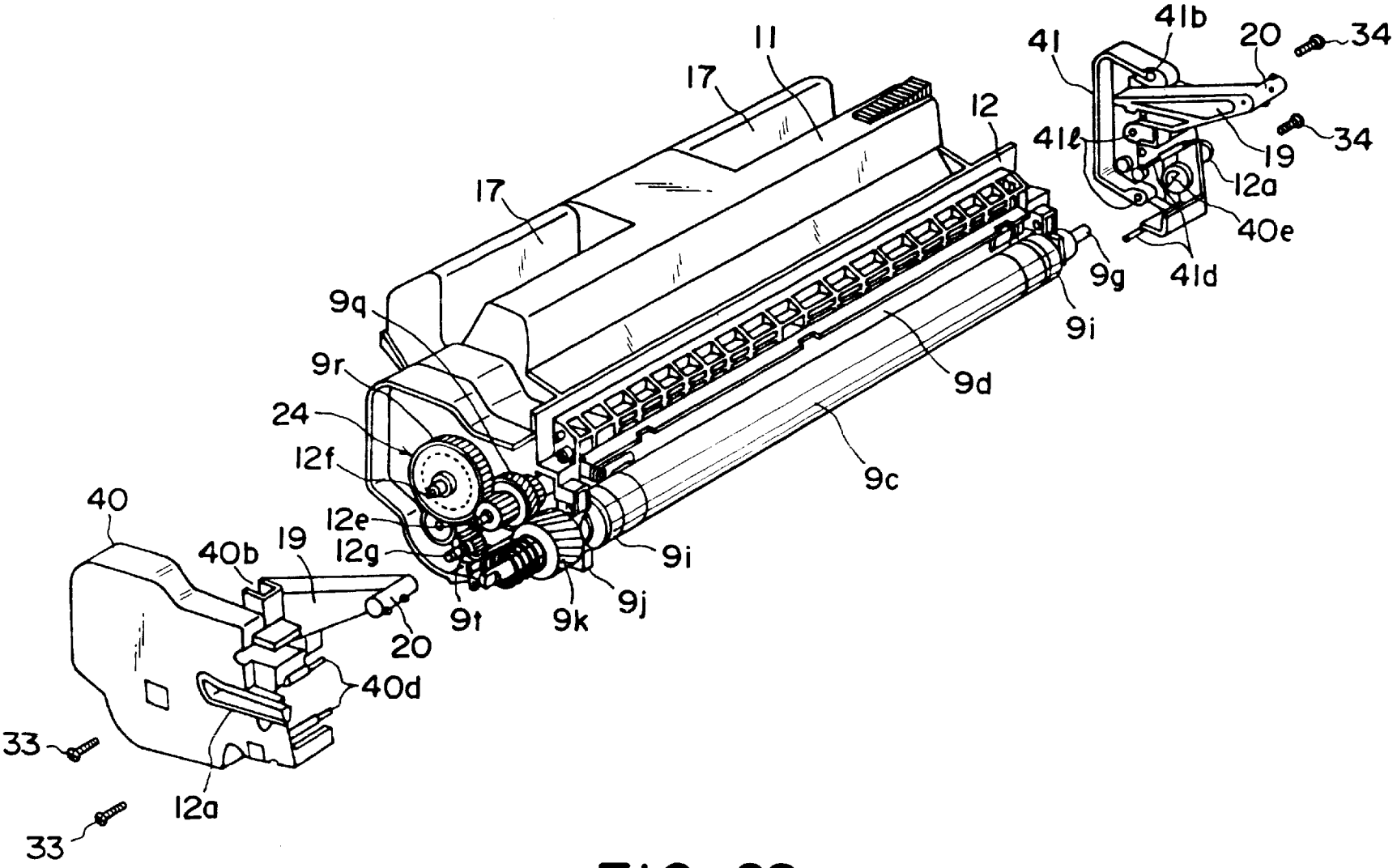
FIG. 22 is a partly exploded perspective view of a developing unit.

The cylindrical guide 13*a* is a cylindrical member, and projects perpendicularly outward from the side wall of the cleaning means holding frame 13, in parallel to the axial line of the photosensitive drum 7. It nonrotationally supports a drum shaft 7*a*. The drum shaft 7*a* supports the photosensitive drum 7. The long guide 12*a* is a part of the developing means holding frame 12, and extends in a manner to straddle both the external surfaces of the side walls of the developing means holding frame 12 and cleaning means holding frame 13. The short guide 13*b*, which is a part of the cleaning means holding frame 13, is on the external surface of the side wall of the cleaning means holding frame 13, being located above the aforementioned cylindrical guide 13*a*. More precisely, the long guide 12*a* is an integral part of one of a pair of development unit holders 40 and 41 fixed to the developing means holding frame 12 (FIGS. 10 and 22). The development unit holders 40 and 41 will be described later. The cylindrical guide 13*a* and short guide 13*b* are integral parts of the cleaning means holding frame 13.

The long guide 12*a* is extended in the direction in which the process cartridge B is inserted (direction indicated by the arrow mark X in FIGS. 4 and 5); in other words, it is extended in such a direction that, when the process cartridge B is inserted into the apparatus main assembly 14, the angle of the long guide 12*a* becomes approximately the same as the angle at which the process cartridge B is inserted into the apparatus main assembly 14. The cylindrical guide 13*a* is positioned in a manner to align with the long guide 12*a* in terms of the direction in which the long guide 12*a* is extended. Further, the short guide 13*b* is positioned in a manner to extend approximately in parallel to the long guide 12*a*. Evidently, another set of the cylindrical guide 13*a* as a first guiding member, long guide 12*a* as a second guiding member, and short guide 13*b* as a third guiding member, is on the other side of the process cartridge B shown in FIG. 5, that is, the side opposite to the side shown in FIG. 4, in the same manner as shown in FIG. 4. The distances these three guiding members project from the external surfaces of the side walls of the cleaning means holding frame 13 and developing means holding frame 12 are approximately the same. Next, these guiding members will be described in detail.

Figure 8:
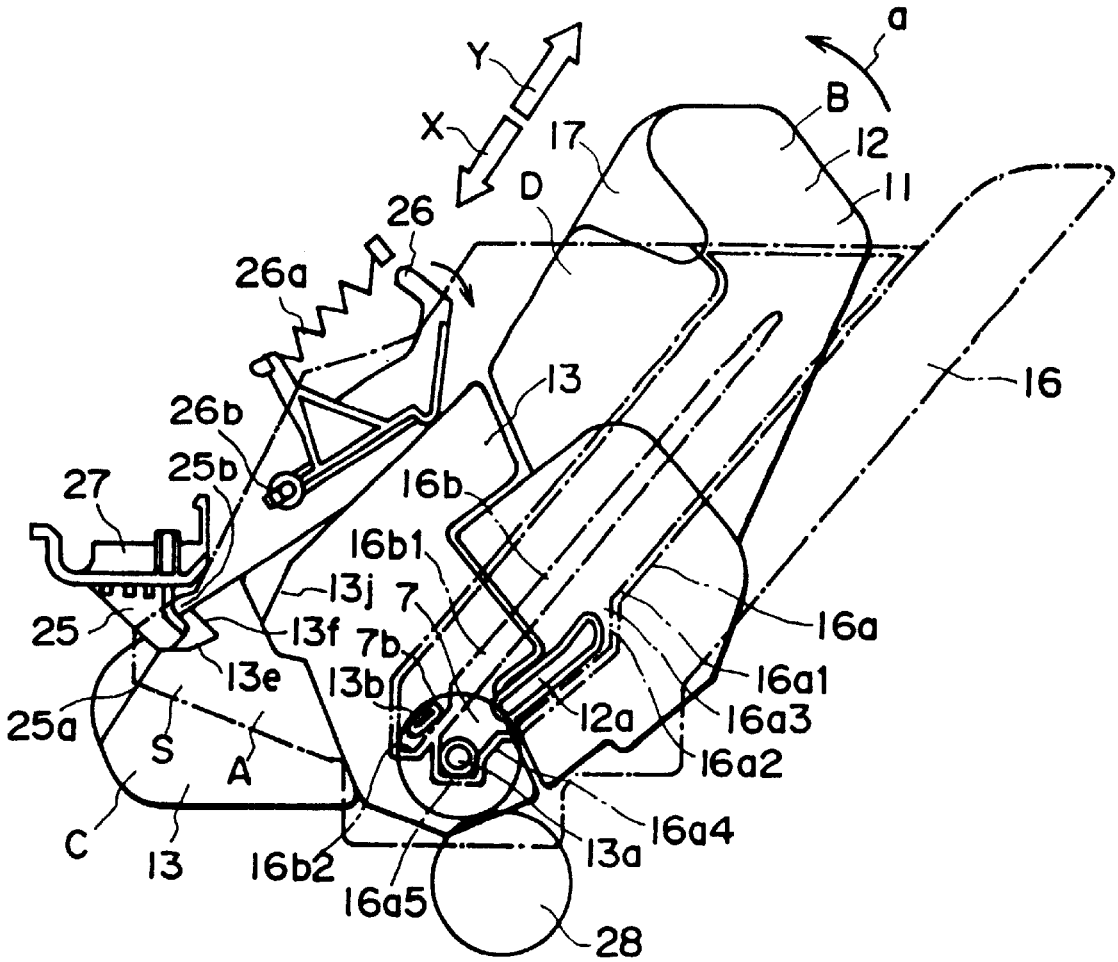
FIG. 8 is a side view illustrating process cartridge mounting and demounting process relative to the main assembly of the apparatus.
Figure 9:
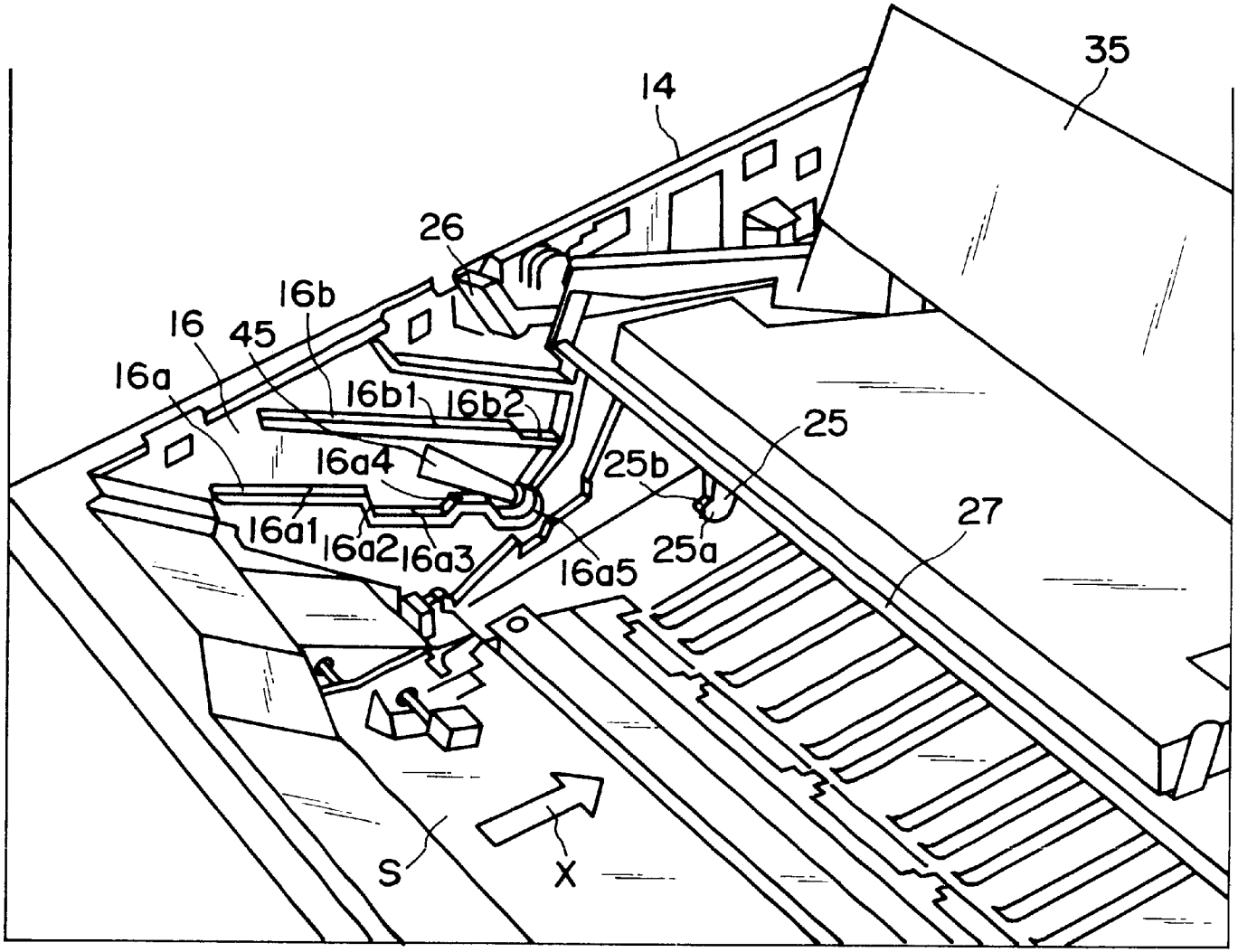
FIG. 9 is a perspective view of inside of the main assembly of the apparatus.

The cylindrical guide 13*a* as a first guiding member is at each of the longitudinal ends C1 (right end 13*c*) and C2 (left end 13*d*). The end C1 means the right end 13*c* of the cleaning means holding frame 13 in terms of the axial direction of the photosensitive drum 7, as seen from the development unit D side of the process cartridge B (as seen from the downstream side in terms of the process cartridge insertion direction), whereas the end C2 means left end 13*d* of the cleaning means holding frame 13 in terms of the axial direction of the photosensitive drum 7, as seen from the development unit D side of the process cartridge B. The cylindrical guide 13*a* is such a cylindrical member that extends from each longitudinal end 13*c* (13*d*) of the cleaning means holding frame 13, in alignment with the axial line of the photosensitive drum 7. The metallic drum shaft 7*a* is supported by these cylindrical guides 3*a* of the cleaning means holding frame 13; the end portions of the drum shaft 7*a* fit in the hollows of the corresponding cylindrical guides 13*a*. Thus, the drum shaft 7*a* is guided by the cylindrical guide 13*a* along the guide portions 16*a* (which will be described later) of the apparatus main assembly 14, and is accurately positioned in the grooves (16*a*5 as the cylindrical guides 13*a* fit in the corresponding grooves 16*a*5 (FIGS. 8 and 9).

The long guides 12*a* as second guiding members are located at the longitudinal ends D1 (right end 12*c*) and D2 (left end 12*d*) of the development unit D. The and D1 is the right end of the developing means holding frame 12 in terms of the axial direction of the photosensitive drum 7, whereas the end D2 is the left end of the developing means holding frame 12 in terms of the axial direction of the photosensitive drum 7. The long guide 12*a* is located on the upstream side in terms of the process cartridge insertion direction (indicated by the arrow mark X), a certain distance away from the cylindrical guide 13*a*. More precisely, the long guide 12*a* is positioned within an area L sandwiched by two "imaginary" lines 111 and 112 (FIG. 4), which are drawn in the upstream direction in terms of the process cartridge insertion direction from the top and bottom sides of the circumference of the cylindrical guide 13*a*, and are tangent to the circumference of the cylindrical guide 13*a*. Further, the long guide 12*a* extends a slight distance (approximately 1–3 mm) over the cleaning means holding frame 13.

The short guides 13*b* as third guides are located one for one at the longitudinal ends 13*c* and 13*d* of the cleaning unit C. Each short guide 13*b* is located above the corresponding cylindrical guide 13*a*. More precisely, in terms of the direction in which the process cartridge B is inserted into the apparatus main assembly 14, the short guide 13*b* is located approximately above the cylindrical guide 13*a*. In other words, the short guide 13*b* is positioned within an area 15 sandwiched by straight lines 113 and 114 drawn perpendicular to the process cartridge insertion direction (direction of arrow mark X) and tangent to the circumference of the cylindrical guide 13*a*. Further, this short guide 13*b* is positioned virtually in parallel to the long guide 12*a*.

At this time, examples of the sizes these guiding members will be given.

Acceptable ranges in the sizes of the guiding members given below are the ranges adopted for the process cartridge in this embodiment. The cylindrical guide 13*a* is approximately 10.0 mm in diameter (acceptable range: 5.5 mm–10.0 mm). The long guide 12*a* is approximately 36.0 mm in length (acceptable range: 15.0 mm–41.0 mm), and approximately 8.0 mm in width (acceptable range: 1.5 mm–10.0 mm). The short guide 13*b* is approximately 10.0 mm in length (acceptable range: 3.0 mm–17.0 mm) and approximately 4.0 mm in width (acceptable range: 1.5 mm–7.0 mm). Further, the gap between the peripheral surface of the cylindrical guide 13*a* and the leading end of the long guide 12*a* in terms of the process cartridge insertion direction is approximately 9.0 mm, and the gap between the peripheral surface of the cylindrical guide 13*a* and the trailing end 13*b*1 of the short guide 13*b* is approximately 7.5 mm (acceptable range: 5.5 mm–9.5 mm).

Next, an insertion control contact 13*e* and a removal control contact 13*f* of the top of the cleaning unit C will be described. Here, the top surface of the cleaning unit C means such a surface of the process cartridge B that will be on the top side after the process cartridge B is properly mounted in the apparatus main assembly 14.

In this embodiment, in terms of the direction perpendicular to the process cartridge insertion direction, the right and left ends 13*c* and 13*d*, respectively, of the top surface 13*i* of the cleaning unit C are provided with a process cartridge removal attitude regulating contact 13*e* and a process cartridge removal attitude contact 13*f*. This insertion control contact 13*e* regulates the attitude of the process cartridge B as the process cartridge B is mounted into the apparatus main assembly 14. More specifically, as the process cartridge B is inserted into the apparatus main assembly 14, the insertion control contact 13*e* comes into contact with a projection 25 (FIGS. 8 and 9) in the apparatus main assembly 14 so that the attitude of the process cartridge B relative to the apparatus main assembly 14 is fixed. The removal control contact 13*f* functions when the process cartridge B is taken out of the apparatus main assembly 14. More specifically, as the process cartridge B is pulled out of the apparatus main assembly 14, the insertion control contact 13*e* comes into contact with the projection 25. As a result, the process cartridge B is made to pivot about the contact point between the insertion control contact 13*e* and projection 25, being enabled to be smoothly taken out. The mounting and dismounting of the process cartridge B will be described later with reference to FIGS. 8 and 9.

To describe in more detail, in this embodiment, the right and left ends of the top surface 13*i* of the cleaning unit C, in terms of the direction perpendicular to the process cartridge insertion direction, are each provided with a recess 13*g*. This recess 13*g* has: a first slant surface 13*g*1, which extends diagonally upward from the leading end of the process cartridge B (assuming that direction X is the horizontal direction); a second slant surface 13*g*3, which extends diagonally downward from the top end 13*g*2 of the slant surface 13*g*1; and a fourth slant surface 13*g*5, which extends diagonally downward from the bottom end 13*g*4 of the slant surface 13*g*3. Further, a surface (slant) 13*g*7 extends from the bottom end 13*g*6 of the slant surface 13*g*5. The second slant surface 13*g*3 is the insertion control contact 13*e*, and the surface 13*g*7 is the removal control contact 13*f*.

At this time, the specifications of these surfaces and portions will be shown.

The angle of the insertion control contact 13*e* relative to the horizontal direction X (FIG. 5) of the process cartridge B in apparatus main assembly 14 is 0 deg. The length of the insertion control contact 13*e* is approximately 6.0 mm (acceptable range: 4.5 mm–8.0 mm). The angle of the removal control contact 13*f* relative to the aforementioned horizontally direction X is approximately 45 deg., and the length of the removal control contact 13*f* is approximately 10.0 mm (acceptable range: 8.5 mm–15.0 mm).

Mounting and Dismounting of Process Cartridge

Next, the process in which the process cartridge B is mounted into the apparatus main assembly 14, and the process in which the process cartridge B is dismounted from the apparatus main assembly 14, will be described with reference to FIGS. 8 and 9.

The process cartridge B assembled as described above is removably mountable in the cartridge mounting means provided in the apparatus main assembly 14.

Referring to FIG. 1, as an operator opens a cover 35 by rotating it about a hinge 35*a*, a cartridge mounting space S is exposed. The left and right walls (right wall is not shown) of the cartridge mounting space of the apparatus main assembly 14 are each provided with a cartridge mounting guide 16, as shown in FIG. 9. This guide 16 comprises two portions: first guiding portion 16*a* and second guiding portion 16*b*, the entrance portions of which are parallel to each other. The process cartridge B is inserted along these guiding portions 16*a* and 16*b*. The mounting of the process cartridge B into the image forming apparatus ends with the closing of the cover 35. The process cartridge B is mounted into, or dismounted from, the apparatus main assembly 14 in the direction perpendicular (more accurately, approximately perpendicular) to the axial line of the photosensitive drum 7, as shown in FIG. 8. Further, the process cartridge B is inserted into the apparatus main assembly 14 in such a manner that the cleaning unit C side leads and the development unit D side trails.

The process cartridge B is provided with recesses 17 as handle portions (FIG. 3), which are located at longitudinal ends of the process cartridge B to make it easier for an operator to grasp the process cartridge B when mounting or dismounting the process cartridge B; the operator mounts or dismounts the process cartridge B by grasping the handle portions 17 using both hands.

The process cartridge B is provided with a drum shutter 18 (FIG. 3) for covering or exposing the transfer opening 13*n* in coordination with the mounting and dismounting of the process cartridge B. As the process cartridge B is dismounted from the laser beam printer A, the shutter 18 closes to protect the portion of the photosensitive drum 7 in the transfer station. Referring to FIG. 5, this drum shutter 18 is connected, being thereby supported, by the ends of arms 18*a* and links 18*b* which are rotationally supported by the cleaning means holding frame 13. Each arm 18*a* is supported by a fulcrum shaft 18*c*. To a portion of the arm 18*a* correspondent to the position of the fulcrum 18*c*, a lever 23 is attached by its base portion. As the process cartridge B is inserted into the apparatus main assembly 14 in the direction of the arrow X in FIG. 5, the tip of each lever 23 comes into contact with a stationary stopper (unshown) in the apparatus main assembly 14. As the process cartridge B is inserted further, the lever 23 is pushed, and the shutter 18 is opened by the movement of the lever 23. When dismounting the process cartridge B from the apparatus main assembly 14, the shutter 8 is closed by the resiliency of torsional coil springs 23*a* as the process cartridge B is pulled out of the apparatus main assembly 14.

The first guiding portion 16*a* is the portion of the guide 16 on the bottom side, and guides the long guide 12*a* and cylindrical guide 13*a* of the process cartridge B. Listing from the upstream side toward the downstream side in terms of the process cartridge insertion direction (indicated by arrow mark X), the first guiding portion 16*a* has a main guiding portion 16*a*1, a stepped portion 16*a*2, a recess 16*a*3, a secondary guiding portion 16*a*4, and a positioning groove 16*a*5. The main guiding portion 16*a*1 guides the long guide 12*a* and cylindrical guide 13*a*, and the secondary guiding portion 16*a*4 guides the cylindrical guide 13*a* to the positioning groove 16*a*5. The positioning groove 16*a*5 is where the cylindrical guide 13*a* is fitted to accurately fix the position of the process cartridge B. The second guiding portion 16*b* is the portion of the guide 16 on the top side, and guides the short guide 13*b*. Listing from the upstream side toward the downstream side in terms of the process cartridge insertion direction, the second guiding portion 16*b* has an upwardly slanted surface 16*b*1 and a recess 16*b*2.

There are a pair of projections 25 (rotation controlling members) in the cartridge mounting space S of the apparatus main assembly 14. They are fixed to a stay 27, being located toward the longitudinal ends of the process cartridge B one for one. As the process cartridge B is inserted into the cartridge mounting space S, each projection 25 comes into contact with the insertion control contact 13*e* and controls the rotation of the process cartridge B in the clockwise direction in FIG. 8. Further, the cylindrical guide 13*a* fits into the groove 16*a*5. As a result, the process cartridge B is accurately mounted in the predetermined position. As will be described later, when the process cartridge B is dismounted, the projection 25 comes into contact with the removal control contact 13*f*, enabling the process cartridge B to be smoothly dismounted.

There are also a pair of pressing members 26 in the cartridge mounting space S (FIG. 8). Each pressing member 26 is rotationally supported by a shaft 26*b* as a fulcrum, being kept pressed by the resiliency of a tensional coil spring 26*a* in the clockwise direction in FIG. 8. The pressing member 26 continuously applies pressure upon the top surface of the process cartridge B in a flexible manner to prevent the process cartridge B from being vibrated by the vibrations or the like of the apparatus.

Next, the relationships among the mounting guides on the apparatus main assembly 14 side, and the guides 12*a*, 13*a* and 13*b* on the process cartridge B side, during the mounting and dismounting of the process cartridge B, will be described with reference to the drawings. FIG. 8 is a phantom drawing for showing the state of the process cartridge B immediately before the process cartridge B begins to be dismounted. In FIG. 8, the contour of the entirely of the process cartridge B as seen in its longitudinal direction is shown by a solid line, and the mounting guides on the apparatus main assembly 14 side are shown by an "imaginary line".

First, the process cartridge B is inserted into the apparatus main assembly 14 by an operator. As the process cartridge B is inserted, the cylindrical guide 13*a* and long guide 12*a* of the process cartridge B side on the guiding portion 16*a*, being therefore guided by the guiding portion 16*a*. At this stage, the short guide 13*b* is yet to be guided by the guiding portion 16*b*; the short guide 13*b* has a predetermined distance (approximately 2.0 mm–4.0 mm in this embodiment) from the guiding portion 16*b*. Also at this stage, the pressing member 26 rotates upward following the slant surface 13*j* on the top side of the process cartridge B. Next, as the process cartridge B is inserted deeper into the apparatus main assembly 14, the pressing member 6 slides onto the top surface of the process cartridge B, preventing the process cartridge B from lifting. After sliding onto the top surface of the process cartridge B, the pressing member 26 continuously presses upon the top surface of the process cartridge B as long as the process cartridge B is in the apparatus main assembly 14. Next, as the process cartridge B is inserted far deeper into the apparatus main assembly 14, the cylindrical guide 13*a* slides past the stepped portion 16*a*2 of the first guiding portion 16*a*, and comes to the edge of the recess 163. The recess 16*a*3 of the guiding portion 16*a* is for freeing the long guide 12*a* as the process cartridge B reaches a predetermined insertion point. The depth (approximately 4.0 mm–8.0 mm in this embodiment) of the recess is made greater than the vertical distance between the short guide 13*b* and guide 16. Also at this stage, the short guide 13*b* is yet to come into contact with the second guiding portion 16*b* (upwardly slanted surface 16*b*1).

Thus, as the process cartridge B is further advanced into the apparatus main assembly 14, the short guide 13*b* comes into contact with the second guiding portion 16*b* before the cylindrical guide 13*a* of the process cartridge B reaches the bottom edge of the recess 16*a*3. In other words, the long guide 12*a* and short guide 13*b* function as process cartridge insertion guides to soften the impact to the process cartridge B which otherwise might be caused by the stepped portion or the like.

As the process cartridge B is further advanced into the apparatus main assembly 14, the long guide 12*a* of the process cartridge B comes to the edge of the recess 16*a*3 of the first guiding portion 16*a*. Thereafter, the cylindrical guide 13*a* of the process cartridge B rides on the secondary guiding portion 16*a*4. During this period, the cylindrical guide 13*a* and short guide 13*b* of the process cartridge B are guided by the guiding portion 16*a* and second guide 16*b*, respectively.

As the process cartridge B is further advanced, the short guide 13*b* comes to the edge of the recess 16*b*2 of the second guide 16*b*. For a short period when the short guide 13*b* is freed, or becomes disengaged, from the guiding portion 16*b*, only the cylindrical guide 13*a* slides on the secondary guiding portion 16*a*4. Lastly, as the cylindrical guide 13*a* falls into the groove 16*a*5 of the first guiding portion 16*a*, the process cartridge B slightly pivots in the counterclockwise direction, and at the same time, the insertion control contact 13*e* of the cleaning means holding frame 13 comes into contact with the rotation control portion 25*a* (FIG. 8) of the projection 25 of the apparatus main assembly 14. As a result, the process cartridge B takes its final position in the apparatus main assembly 14. In this state, the positional relationship between the process cartridge B and the apparatus main assembly 14 is fixed around the cylindrical guide 13*a*, and the other guides (long guide 12*a* and short guide 13*b*) are not in contact with the guide 16 of the apparatus main assembly 14 at all. In other words, the process cartridge B remains accurately positioned relative to the apparatus main assembly 14.

As for the positional relationship between the insertion control contact 13*e* and rotation control portion 25*a*, the two portions are directed so that the moment generated by the driving of the process cartridge B is blocked by the contact between the two portions. The apparatus main assembly 14 and process cartridge B are structured so that the distance from the contact point between the insertion control contact 13*e* and rotation control portion 25*a*, to the center of the cylindrical guide 13*a* becomes greater than the distances from the long guide 12*a* and short guide 13*b* to the center of the cylindrical guide 13*a*. Therefore, the attitude of the process cartridge B remains more stable during the driving of the process cartridge B.

When the positional relationship between the process cartridge B and apparatus main assembly 14 is as shown in FIG. 8, a helical drum gear 7*b* located at one end of the photosensitive drum 7 in terms of the direction of the axial line of the photosensitive drum 7 is in engagement with the helical driving gear 28 provided on the apparatus main assembly 14 side. Driving force is transmitted to the photosensitive drum 7 from the apparatus main assembly 14 through the gears 28 and 7*b*. As driving force is transmitted from the helical gear 28 to the helical driving gear 7*b*, the process cartridge B is subjected to such force that works in the direction to rotate the process cartridge B in the clockwise direction in FIG. 8. However, the process cartridge B is prevented by the insertion control contact 13*e* from moving in the clockwise direction.

Further, the process cartridge B is under the downward pressure continuously applied by the pressing member 26. Therefore, even if the cylindrical guide 13*a* fails to fit into the groove 16*a*5 of the apparatus main assembly 14, the process cartridge B is rotated about the contact point between the rotation control portion 25*a* and insertion control contact 13*e*, causing the cylindrical guide 13*a* to fit into the groove 16*a*5.

Next, referring to FIG. 8, the dismounting of the process cartridge B from the image forming apparatus A will be described. The direction indicated by an arrow mark Y is the direction in which the process cartridge B is dismounted. When dismounting the process cartridge B, first, an operator must grasp the handle 17 (portion of the toner holding frame onto the downstream side of the recess of the developing means holding frame 12 in terms of dismounting direction, in FIGS. 3 and 6) of the process cartridge B, and pull it upward (direction of an arrow mark a). As the handle 17 is pulled, the process cartridge B rotates about the cylindrical guide 13*a* in the clockwise direction, and the removal control contact 13*f* of the process cartridge B comes into contact with the removal contact portion 25*b* of the projection 25 of the apparatus main assembly 14. As the operator continues to pull the process cartridge B upward, the process cartridge B rotates, with the contact point between the removal control contact 13*f* and removal control portion 25*b* of the projection 25 serving as a fulcrum. As a result, the cylindrical guide 13*a* is moved upward, slipping out of the groove 16*a*5. During this movement of the process cartridge B, the drum gear 7*b* and helical driving gear 28 are smoothly disengaged from each other. Thereafter, the process cartridge B can be pulled straight out of the apparatus main assembly 14. As the process cartridge B is pulled straight, the process cartridge B comes out of the apparatus main assembly 14 following in reverse order the stages it went through when it was mounted.

As described above, according to this embodiment of the present invention, the long guide as a second guiding member, which extends on the exterior of the end wall of the development unit D in the cartridge insertion direction, also extends over the exterior of the end wall of the cleaning unit C in a manner to straddle the development unit D and cleaning unit C. Therefore, the process cartridge does not wobble when it is mounted or dismounted; it can be smoothly inserted. In other words, the present invention improves the process cartridge B in operability.

Further, the guiding means of the process cartridge B which guides the process cartridge B when the process cartridge B is mounted into, or dismounted from, the apparatus main assembly 14 is constituted of three separate guiding portions (cylindrical guide 13*a*, long guide 12*a*, and short guide 13*b*), and the process cartridge B and apparatus main assembly 14 are structured so that during the mounting or dismounting of the process cartridge B, the process cartridge B is guided at least two separate guiding portions. Therefore, even if the process cartridge mounting guide on the apparatus main assembly side has a stepped portion or the like, the impact to which the process cartridge B is subjected is softened.

The process cartridge B and apparatus main assembly 14 are structured so that the final position and attitude of the process cartridge B in the apparatus main assembly 14 is fixed by the rotation control portion 25*a* and cylindrical guide 13*a*, which are directed to take the moment of the process cartridge B generated by the driving of the process cartridge B, and that after the mounting of the process cartridge B, the other guides (long guide 12*aq* and short guide 13*b*) of the process cartridge B remain out of contact with the guide 16 of the apparatus main assembly 14. Therefore, the process cartridge B remains more stable in terms of attitude while it is driven (while an image is formed).

Figure 7:
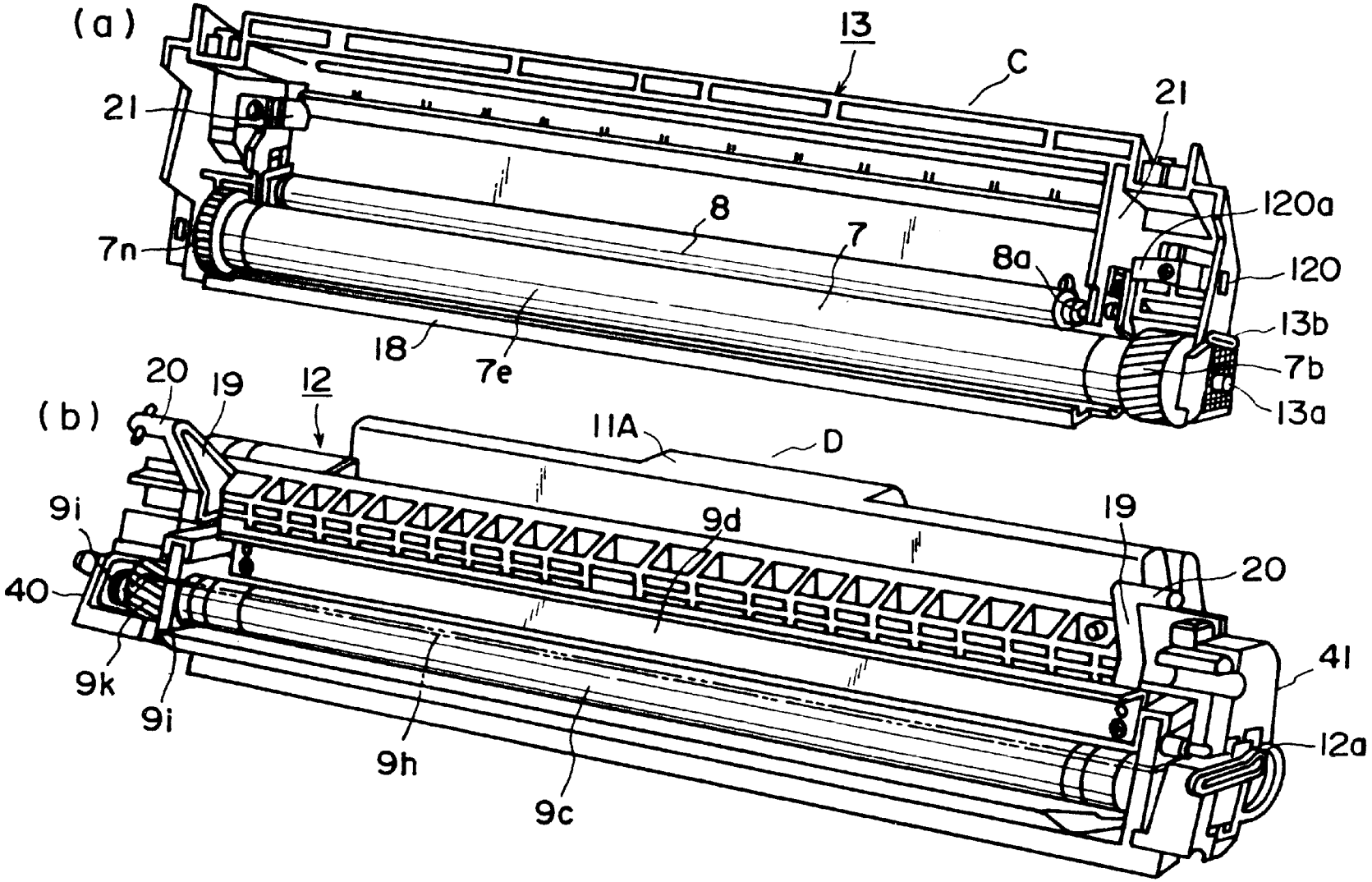
FIG. 7(*a*) is a perspective view of an outer appearance of a cleaning unit of the process cartridge shown in FIG. 3.

Referring to FIGS. 7(*a*) and 7(*b*), the photosensitive drum 7 is also provided with a spur gear 7*n*, which is located on the end opposite to the end where the helical drum gear 7*b* is located, in terms of the axial line of the photosensitive drum 7. As the process cartridge B is mounted into the apparatus main assembly 14, the spur gear 7*n* meshes with a gear (unshown) coaxial with the transfer roller 4 provided on the apparatus main assembly 14 side, and transmits from the process cartridge B to the transfer roller 4 the driving force for rotating the transfer roller 4.

A referential code 9*u* designates a helical gear attached to one end of the development roller 9*c* in terms of the axial direction of the development roller 9*c*. The helical gear 9*u* meshes with the helical drum gear 7*b* so that the force for driving the development roller 9*c* is transmitted to the helical gear 9*u* from the helical drum gear 7*b*.

Toner Holding Frame

Figure 14:
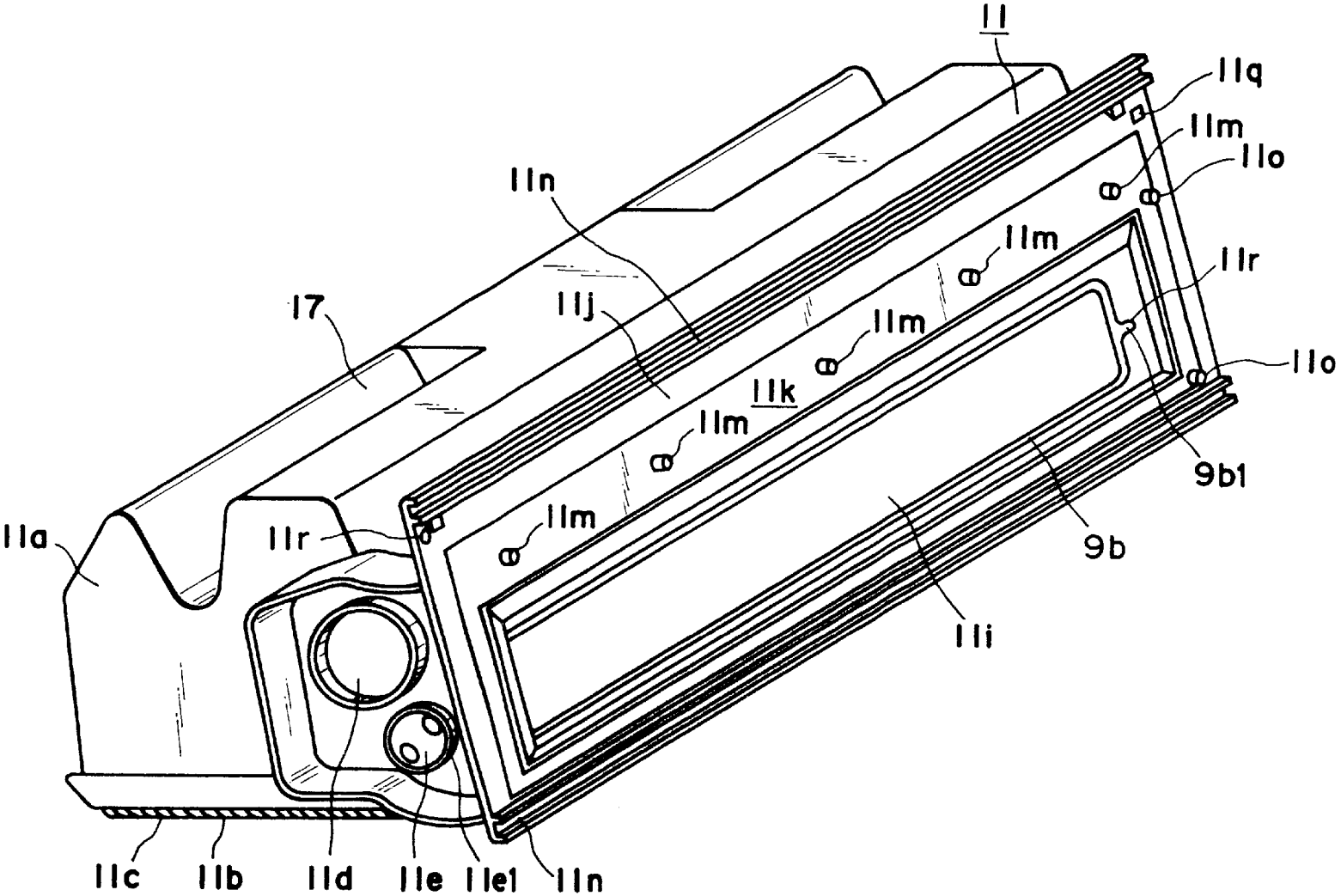
FIG. 14 is a perspective view of a toner frame.
Figure 15:
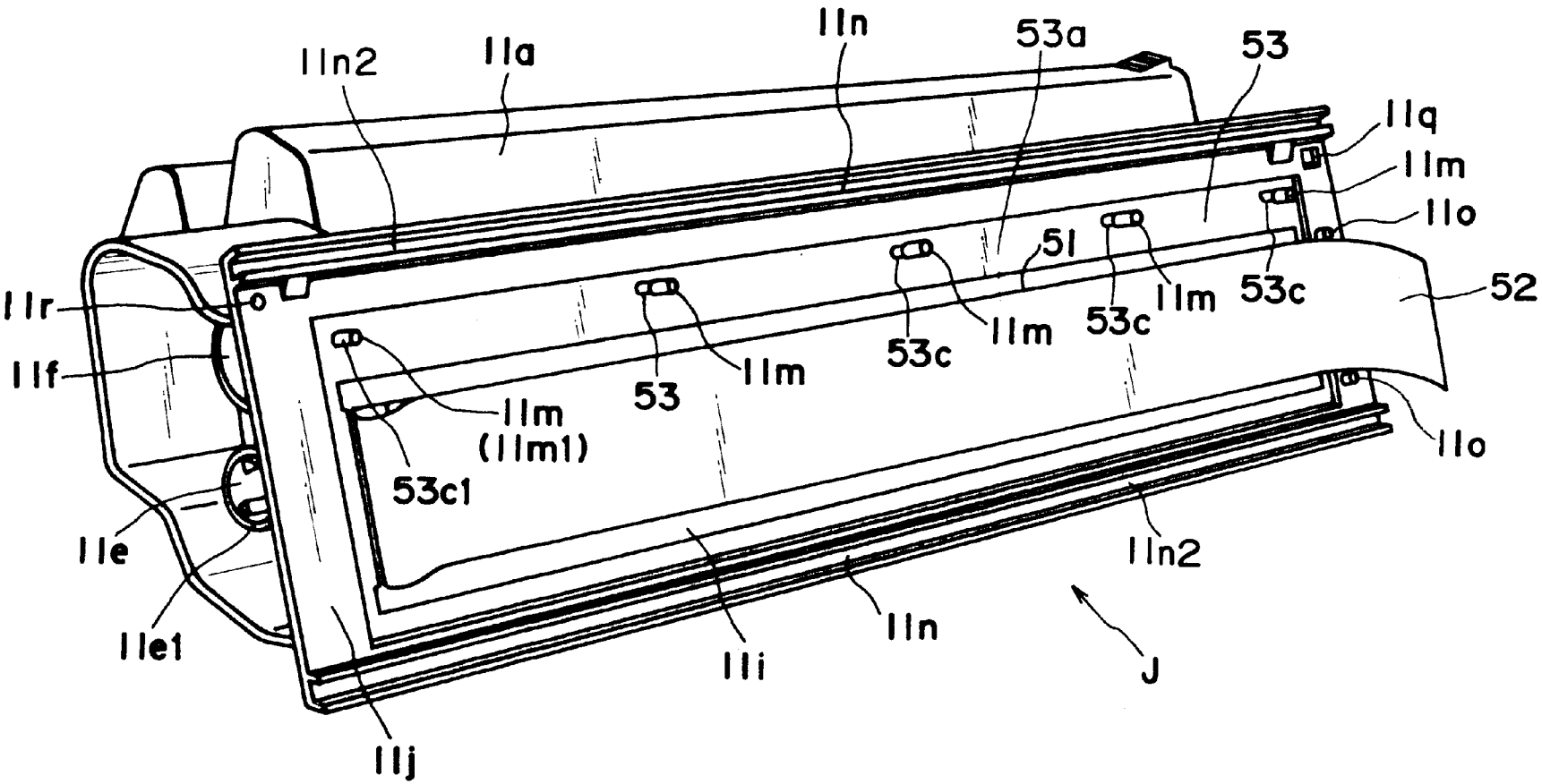
FIG. 15 is a perspective view of the toner frame after the toner seal is mounted.

Referring to FIGS. 3, 14 and 15, the toner holding frame will be described in detail. FIG. 14 is a perspective view of the toner holding frame prior to the welding of the toner seal, and FIG. 15 is perspective view of the toner holding frame after the filling of the toner.

The toner holding frame 11 comprises two components: top portion 11*a* and bottom portion 11*b*. The top portion 11*a* is provided with two recesses 17, which are the portions of the top wall of the top portion 11*a*. Each recess 17 extends in the longitudinal direction of the process cartridge B from the longitudinal end toward the center of the top wall. The outward wall of each recess 17 constitutes a part of the aforementioned handle. The external surface of the bottom portion, or the bottom wall, of the bottom portion 11*b* of the toner holding frame 11 is provided with a plurality of ribs 11*c*, which are parallel to each other, being approximately 5 mm apart from the adjacent ones, and extend in the longitudinal direction of the process cartridge B. These ribs 11*c* and the surfaces of the recesses 17 are where the hands of an operator are placed when the operator grasps the process cartridge B. The ribs 11*c* prevent the hands from slipping, when the process cartridge B is grasped. When joining the top and bottom portions 11*a* and 11*b* of the toner holding frame 11, the welding surfaces U of the top and bottom portions 11*a* and 11*b* are placed in contact with each other, and vibrations are forcefully applied to the two components. As a result, the welding ribs are melted to weld the two portions 11*a* and 11*b* to each other. The method for welding the two portions does not need to be limited to the above described vibratory welding method. For example, the two portions may be joined by thermal welding, ultrasonic welding, gluing, or the like. Prior to the joining of the two portions 11*a* an 11*b* of the toner holding frame 11, the toner sending member 9*b* is attached within the top portion 11*a* of the toner holding frame 11, and a coupling 11*e* is attached to the end of the toner sending member 9*b* through a hole 11*e*1 (as shown in FIG. 14). This hole 11*e*1 is in one of the walls of the top portion 11*a* of the toner holding frame 11 located at the longitudinal ends of the toner holding frame 11. The same wall as the wall which has the hole 11*e*1 is provided with another hole 11*d* through which toner is filled into the toner holding frame 11. The diameter of this toner filling hole 11*d* is approximately 30 mm. The hole 11*e*1 and toner filling hole 11*d* are located next to each other. Further, the top portion 11*a* of the toner holding frame 11 is provided with an opening 11*i*, which constitutes the opening of the toner holding frame 11 through which toner is sent from the toner holding frame 11 to the developing means holding frame 12. This opening 11*i* extends in the longitudinal direction of the top portion 11*a* of the toner holding frame 11. A seal (which will be described later) is welded in a manner to block this opening 11*i*. After the welding of the seal, toner is filled into the toner holding frame 11 through the toner filling hole 11*d*, and the toner filling hole 11*d* is sealed by a toner cap 11*f* to complete a toner unit J. The toner cap 11*f* is formed of soft material such as polyethylene, polypropylene, or the like, so that it does not come off after it is pressed into the toner filling hole 11*d* of the toner holding frame 11. The toner unit J is welded to the developing means holding frame 12, which will be described later, by ultrasonic welding to form a development unit D. A method for welding the toner unit J to the developing means holding frame 12 does not need to be limited to ultrasonic welding. For example, it may be gluing, elasticity based snap fitting, or the like.

Referring to FIG. 3, the angle of the slanted surface K of the bottom portion 11*b* of the toner holding frame 11 is desired to be such that, after the process cartridge B is properly mounted in the horizontally placed apparatus main assembly 14, the angle θ which the slant surface K of the bottom portion 11*b* of the toner holding frame 11 forms relative to the horizontal line Z becomes approximately 60 deg., at which the toner in the top portion of the toner container naturally descends as the toner in the bottom portion of the toner container is consumed. The rotational range of the toner sending member 9*b* extends beyond the imaginary extension of the slant surface K; the bottom wall of the bottom portion 11*b* of the toner holding frame 11 is provided with a recess 11*g* for accommodating the rotation of the toner sending member 9*b*. The diameter of the rotational range of the toner sending member 9*b* is approximately 30 mm (in this embodiment, the depth of the recess 11*g* relative to the bottom wall of the bottom portion 11*b* is approximately 3.6 mm. The depth has only to be within a range of approximately 2.0 mm–10.0 mm). This is for the following reason. That is, if the rotational range of the toner sending member 9*b* is above the slant surface K, it is possible that the toner which accumulates in the adjacencies of the toner sending member 9*b* after naturally descending from the top side of the slant surface K toward the bottom end of the slant surface K may fail to be sent into the developing means holding frame 12; the toner remaining in the space between the rotational range of the toner sending member 9*b* and the slant surface k remains there. However, this embodiment assures that the virtually the entirety of the toner within the toner holding frame 11 is sent to the developing means holding frame 12.

The toner sending member 9*b* is formed of a rod of ferric material having a diameter of 3 mm. In order to enhance the toner sending performance, it is shaped like the contour of a rectangle, and the mutually opposing shorter portions of the toner sending member 9*b* are provided with supporting axles 9*b*1 one for one. One of the supporting axles 9*b*1 is fitted in a hole 11*r* in the inwardly facing surface of the opening 11*i*, and the other is fixed to the coupler 11*e*.

As described above, according to this embodiment of the present invention, the toner holding frame 11 is constituted of two portions, or the top and bottom portions 11*a* and 11*b*, and the bottom wall of the bottom portion 11*b* is provided with the recess 11*g* for providing the toner sending member 9*b* with clearance. Therefore, even the toner sending performance of a large capacity process cartridge can be improved without cost increase.

It is predictable that while the process cartridge B is shipped from a factory to a user, the toner within the toner holding frame 11 will suddenly shift due to the vibrations, shocks, and the like which will occur during the shipment.

Therefore, in this embodiment, the interior of the top portion 11*a* of the toner holding frame 11 is provided with a plurality of partitioning plates 11*p* (cross-hatched portion in FIG. 3), which extend in parallel to each other in the direction perpendicular to the longitudinal direction of the toner holding frame 11, at equal intervals. In this embodiment, three partitioning plates 11*p* are provided. The bottom edge of each partitioning plate 11*p* comprises two portions: portions 11*p*1 and portion 11*p*2. The bottom edge portion 11*p*1 is contoured like approximately a quarter of a circle which conforms to the rotational range of the toner sending member 9*b*, whereas the bottom edge portion 11*p*1 is basically straight and holds a microscopic gap from the bottom wall of the bottom portion 11*b* of the toner holding frame 11. The position of the bottom edge portion 11*p*1 facing the toner sending member 9*b* is such that, as seen from the longitudinal direction of the process cartridge B, it looks as if the toner filling hole 11*d* is partially covered with the partitioning plate 11*p*.

From the standpoint of preventing the toner within the toner container 11A from shifting, the partitioning plate 11*p* is desired to be as large as possible. However, if the partitioning plate 11*p* is made as large as possible, it becomes impossible for the toner container 11A to be filled with toner to its deepest end. This is due to the following reason. When filling toner into the toner container 11A, the development unit J is positioned so that the toner filling hole 11*d* faces upward. In this state, the partitioning plates 11*p* are directly below the toner filling hole 11*d*. Therefore, if the partitioning plates 11*p* are larger than a certain size, they block the straight toner passage from the toner filling hole 11*d* to the other end, or the deepest end, of the toner container 11A, preventing the toner container 11A from being filled all the way to the deepest end. Thus, the partitioning plates 11*p* in this embodiment are configured as described above. As a result, toner is filled all the way even into the deepest end of the toner container 11A, through the aforementioned straight toner passage which is only partially blocked by the partitioning plates 11*p*. Further, in terms of a sectional view of the toner holding frame 11 at a plane perpendicular to the longitudinal direction of the toner holding frame 11, each partitioning plate 11*p* occupies the toner holding frame 11 by a substantially large ratio. Therefore, even if the process cartridge B is subjected to vibrations, shocks, and the like, the partitioning plates 11*p* prevent the toner from shifting, preventing thereby the toner from becoming compacted.

Structures of Mutually Facing Portions of Toner Holding Frame and Developing Means Holding Frame Referring to FIGS. 3 and 14, the portion of the toner holding frame 11, by which the toner holding frame 11 is joined with the developing means holding frame 12, has the opening 11*i* through which toner is sent from the toner holding frame 11 to the developing means holding frame 12. The opening 11*i* is surrounded with a recess having a bottom surface 11*k*, or the recessed surface 11*k*. A cover film plate 53 is fitted into this recess as shown in FIG. 3, and thermally welded to the recessed surface 11*k*. With the cover film plate 53 welded to the recessed surface 11*k*, the outwardly facing surface 53*a* of the cover film plate 53 is approximately flush with the surface 11*j* of the toner holding frame 11 (top portion 11*a*). The recessed surface 1*k* is provided with a plurality of joggles 11*m*, which are aligned in a straight line along one of the long edges of the opening 11*i* (five joggles are provided in this embodiment). The surface 11*j* is provided with two joggles 11*o*, which are located along one of the short edges of the opening 11*i*; being slightly away from the recessed surface 11*k*. Further, the surface 11*j* is provided with two long grooves 11*n*, which extend in parallel along the long edges of the surface 11*j* one for one. The bottom surface 11*n*2 of each groove 11*n* is located more on the outward side (developing means holding frame 12 side) than the surface 11*j*.

Figure 12:
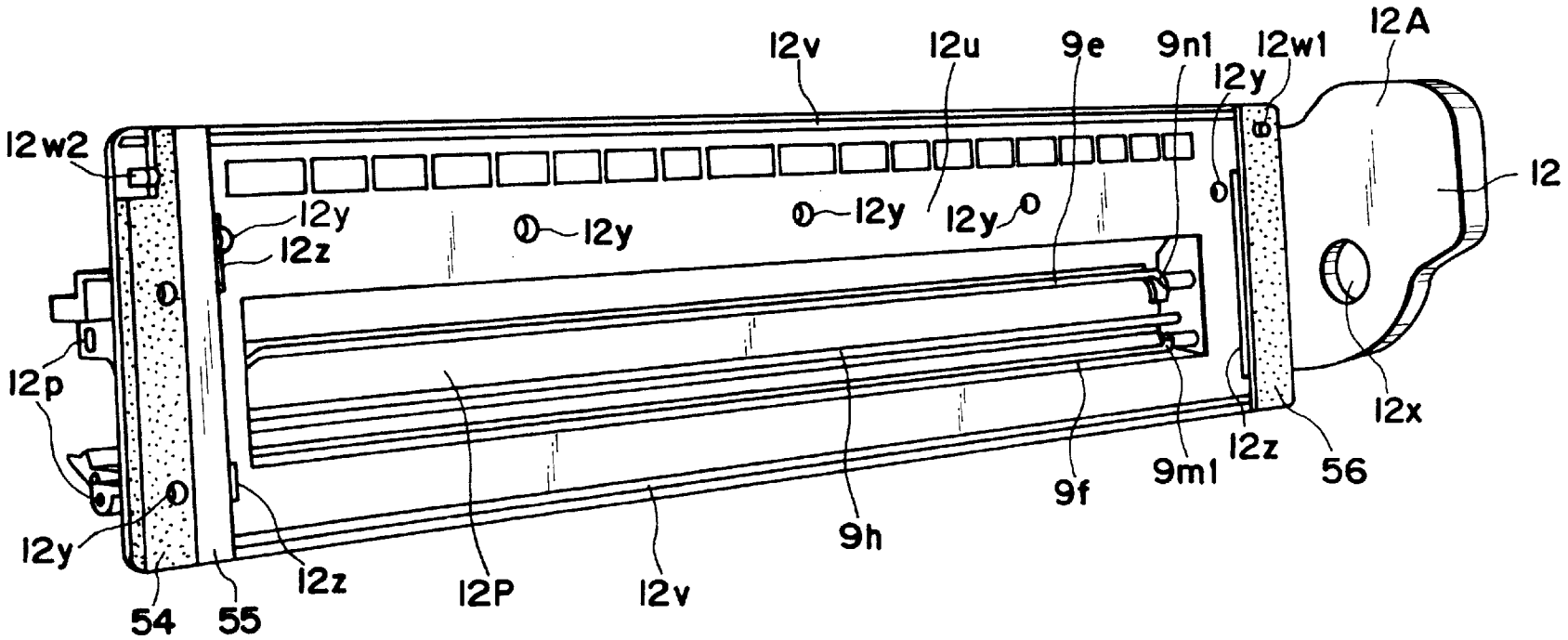
FIG. 12 is a perspective view of a developing device frame.

Referring to FIG. 12, the surface of the developing means holding frame 12, which faces the toner holding frame 11, is a surface 12*u*, which has a pair of straight ribs 12*v* with a rectangular cross section. The ribs 12*v* extend in the longitudinal direction of the developing means holding frame 12 along the long edges of the surface 12*u*, and are to be fitted one for one in the grooves 11*n* of the toner holding frame 11. The top surface of each rib 12*v* is provided with a rib (unshown) with a triangular cross section, which is smaller than the rib 12*v*. Thus, the toner holding frame 11 and developing means holding frame 12 are welded to each other by ultrasound welding along their longitudinal edges.

Next, referring to FIG. 15, the cover film plate 53 which is fitted in the recess of the toner holding frame 11, which has the bottom surface 11*k*, or the recessed surface 11*k*, is provided with a round hole 53*c*1 and a plurality of elongated holes 53*c*. The round hole 53*c*1 is the rightmost hole, in which the rightmost joggle 11*m*1 perfectly fits. In the elongated holes 53*c*, the rest of the joggles 11*m* loosely fit. As the joggles 11*m* fit into the holes 53*c*1 and 53*c* of the cover film plate 53, the joggles 11*m* correspondent to the elongated holes 53*c* come to the center of the corresponding elongated holes 53*c*. The cover film plate 53 is also provided with an opening 53*b* (approximately equal in size to opening 11*i*), which aligns with the opening 11*i*. This opening of the cover film plate 53 is covered with a cover film 51, which is easy to tear in the longitudinal direction, and is pasted to the cover film plate 53, along the four edges of the opening 53*b*. Further, to the cover film 51, a tear tape 52 for tearing the cover film 51 in order to expose the opening 53*b* is welded. The tear tape 52 is extended from one of the longitudinal ends of the cover film 51 to the other, being folded back there, and is doubled back to the initial end, being further extended outward of the toner holding frame 11 (FIGS. 5 and 15), from between an elastic seal 54 (FIG. 12), for example, a piece of felt, pasted to the short edge of the developing means holding frame 12, which is located at one of the longitudinal end of the developing means holding frame 12 and faces the toner holding frame 11, and the portion of the toner holding frame 11, which faces the developing means holding frame 12. The inward side of the elastic seal 54 is covered with a tape 55, which is formed of synthetic resin film with a small coefficient of friction, and is pasted to the elastic seal 54. To a surface 12*u* of the developing means holding frame 12, that is, the surface at the other end of the developing means holding frame 12 in terms of the longitudinal direction, that is, the end opposite to where the elastic seal 54 is located, an elastic seal 56 is pasted (FIG. 12).

Further, in order to make it easier to align the toner holding frame 11 and developing means holding frame 12 when joining the two frames 11 and 12, the surface 11*j* of the toner holding frame 11 is provided with a round hole 11*r* and a square hole 11*q*, into which a round joggle 12*w*1 and a square joggle 12*w*2 provided on the developing means holding frame 12 side are fitted. Although the round joggle 12*w*1 perfectly fits in the round hole 11*r*, the square joggle 12*w*2 loosely fits in the square hole 11*q*. Incidentally, the elastic seal 56 fits around the round joggle 12*w*1, and is adhered to the surface 12*u*. A surface 12*u* of the developing means holding frame 12, which faces the toner holding frame 11, is provided with a plurality of recesses 12*y*, in which the joggles 11*m* and 11*o* of the toner holding frame 11 loosely fit.

The toner holding frame 11 and developing means holding frame 12 are independently assembled as subassembly units, prior to the joining of the toner holding frame 11 and developing means holding frame 12. When joining the toner holding frame 11 and developing means holding frame 12, the round and square joggles 12*w*1 and 12*w*2, respectively, for positioning the developing means holding frame 12 are fitted into the round and square holes 11*r* and 11*q*, respectively, for positioning the toner holding frame 11, and then, the toner holding frame 11 and developing means holding frame 12 are pressed against each other. As they are pressed against each other, the elastic seals 54 and 56 are compressed, allowing a pair of ribs 12*z* to come close to the surface of the toner holding frame 11. The ribs 12*z* are integrally formed parts of the developing means holding frame 12, being located one for one at the longitudinal ends of the developing means holding frame 12 and extending in the widthwise direction of the developing means holding frame 12, and serve as spacers. In order to provide a passage to the tear tape 52, the rib 12*z* on the side from which the tear tape 52 is pulled out, extends in the width (short edge) direction of the tear tape 52 only in the areas outside the tear tape path, that is, only the areas above and below the top and bottom edges, respectively, of the tar tape 52.

With the toner holding frame 11 and developing means holding frame 12 pressed each other in the above described state, vibrations are applied between the ribs 12*v* and grooves 11*n* by ultrasonic waves. As a result, the aforementioned smaller ribs with a triangular cross section melt and weld to the bottoms of the grooves 11*n*. Consequently, the peripheries of the grooves 11*n* of the toner holding frame 11, and the ribs 12*z*, as spacers, of the developing means holding frame 12, are placed tightly in contact with their counterparts, creating a virtually sealed space between the opening surfaces 11*j* and 12*u* of the toner holding frame 11 and developing means holding frame 12, respectively. The cover film 51 and tear tape 52 settle in this space.

In order to send the toner stored in the toner holding frame 11 into the developing means holding frame 12, an end 52*a* (FIG. 5) of the tear tape 52, which is extending out of the process cartridge B, must be pulled by an operator. As the end 52*a* is pulled, the cover film 51 is torn, and therefore, the opening 53*b* (11*i*) is exposed to allow the toner to be sent from the toner holding frame 11 into the developing means holding frame 12.

Since the mutually facing surfaces of the toner holding frame 11 and developing means holding frame 12 are structured as described above, the outwardly facing surface of the cover film plate 53 and the surface 11*j* of the toner holding frame 11 are virtually flush with each other. Therefore, the tear tape 52 can be smoothly pulled out from between the toner holding frame 11 and developing means holding frame 12 by applying to the tear tape 52 force strong enough to tear the cover film 53. Further, the position of the cover film plate 53 in terms of the longitudinal direction is fixed by the joggle 11*m*1 located on the side opposite to the side from which the tear tape 52 is pulled out, and in addition, the cover film plate 53 is fitted in the recess of the toner holding frame 11, that is, the recess having the bottom surface 11*k*, assuring that the cover film plate 53 remains accurately positioned. Further, the toner holding frame 11 is provided with a plurality of joggles 11*m* which are aligned in the longitudinal direction, and these joggles 11*m* are fitted into the holes of the cover film plate 53. Therefore, the cover film 51, which tends to be bent, is kept virtually flat, and remains accurately positioned. Further, even if the assembly step, which follows the step in which the cover film plate 53 is welded to the toner holding frame 11, is started without waiting until the welding seam between the cover film plate 53 and toner holding frame 11 solidifies and stabilizes, the cover film plate 53 will not shift.

As described above, the toner holding frame 11 and developing means holding frame 12 are welded to each other by the frictional heat generated by ultrasonic waves; the rib with a triangular cross section, which is on the top surface of each the rib 12*v* of the developing means holding frame 12, melted by the frictional heat. Thus, there is a possibility that the toner holding frame 11 and developing means holding frame 12 will deform due to thermal stress. However, according to this embodiment of the present invention, the ribs 12*v* of the developing means holding frame 12, which extend across the entire range of the developing means holding frame 12 in terms of the longitudinal direction, fit in the grooves 11*n* of the toner holding frame 11, which extend across the entire range of the toner holding frame 11 in terms of the longitudinal direction, reinforcing the adjacencies of the welding seams between the toner holding frame 11 and developing means holding frame 12. Therefore, it is not likely to occur that the toner holding frame 11 and developing means holding frame 12 deform due to the thermal stress.

As described above, the top portion 11*a* of the toner holing frame 11 has the grooves 11*n*, handles 17 (recesses), partitioning plates 11*p*, toner filling hole 11*d*, holes 11*e*1, round hole 11*r*, square hole 11*q*, and cover film plate anchoring portion (recess with bottom surface 11*k*, joggles 11*m* and opening 11*i*), which are integrally formed with the top portion 11*a*. The bottom portion 11*b* of the toner holing frame 11 has the ribs 11*c* and recess 11*g*, which are integrally formed with the bottom portion 11*b*. The materials for the top and bottom portions 11*a* and 11*b* of the toner holding frame 11 are plastics, for example, polyethylene, ABS resin (acrylonitrile/butadiene/styrene copolymer), polycarbonate, polypropylene, and the like.

Referring to FIG. 3, the toner holding frame 11 in this embodiment has two slant surfaces K and L for allowing the toner (single component toner) stored in the toner container 11A, to efficiently descend toward the opening 11*i*. The slant surfaces K and L extend in the longitudinal direction of the toner holding frame 11 across the entirety of the toner holding frame 11. The slant surface L is above the opening 11*i*, whereas the slant surface K is located in the deeper end of the toner holding frame 11 as seen from the opening 11*i* (in the direction of the shorter edge of the toner holding frame 11). Further, the slant surface L is a part of the top portion 11*a* of the toner holding frame 11, and the slant surface K is a part of the bottom portion 11*b* of the toner holding frame 11.

Next, the developing means holding frame 12 will be described in more detail.

Developing Means Holding Frame

Figure 11:
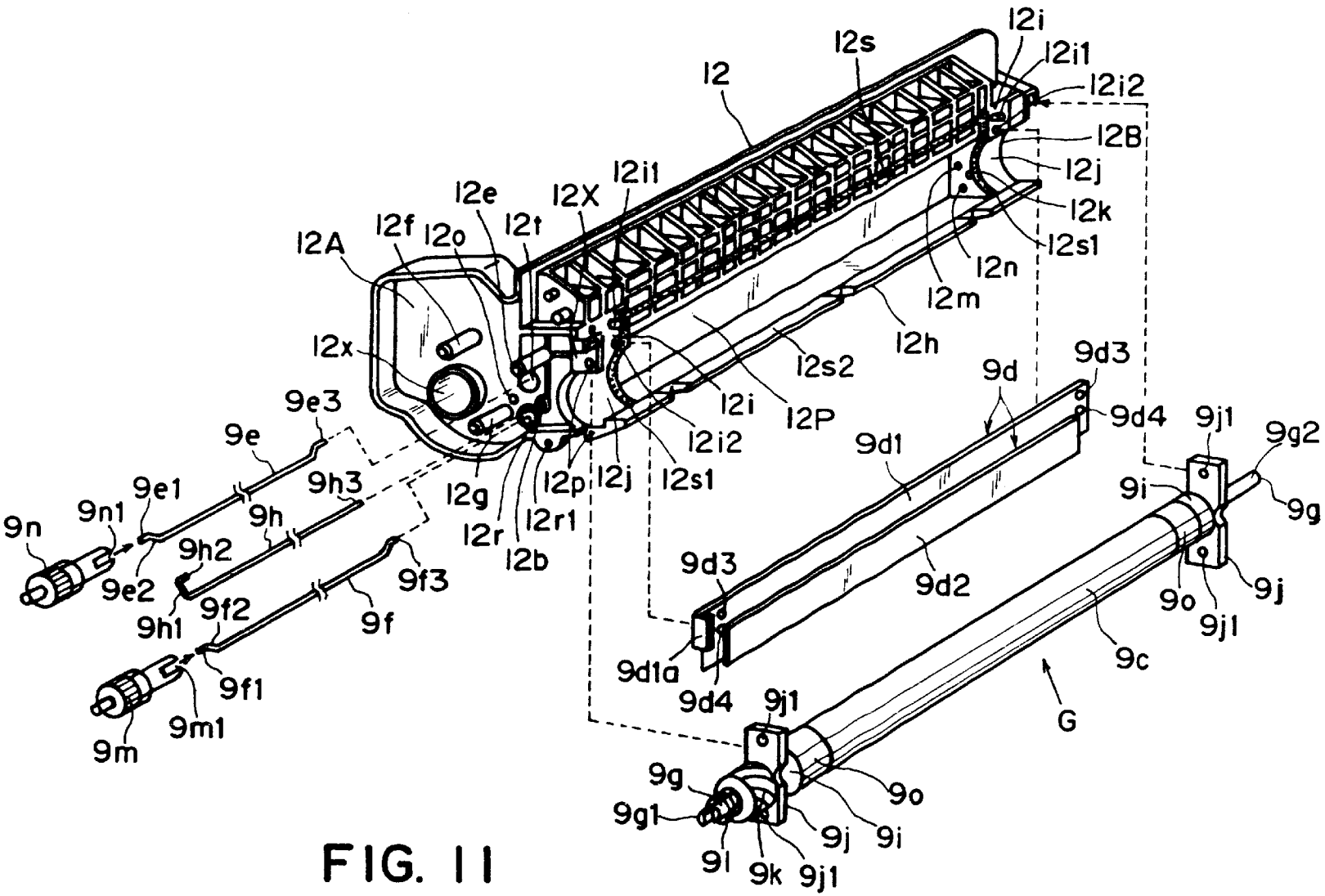
FIG. 11 is an exploded perspective view of a developing unit.
Figure 13:
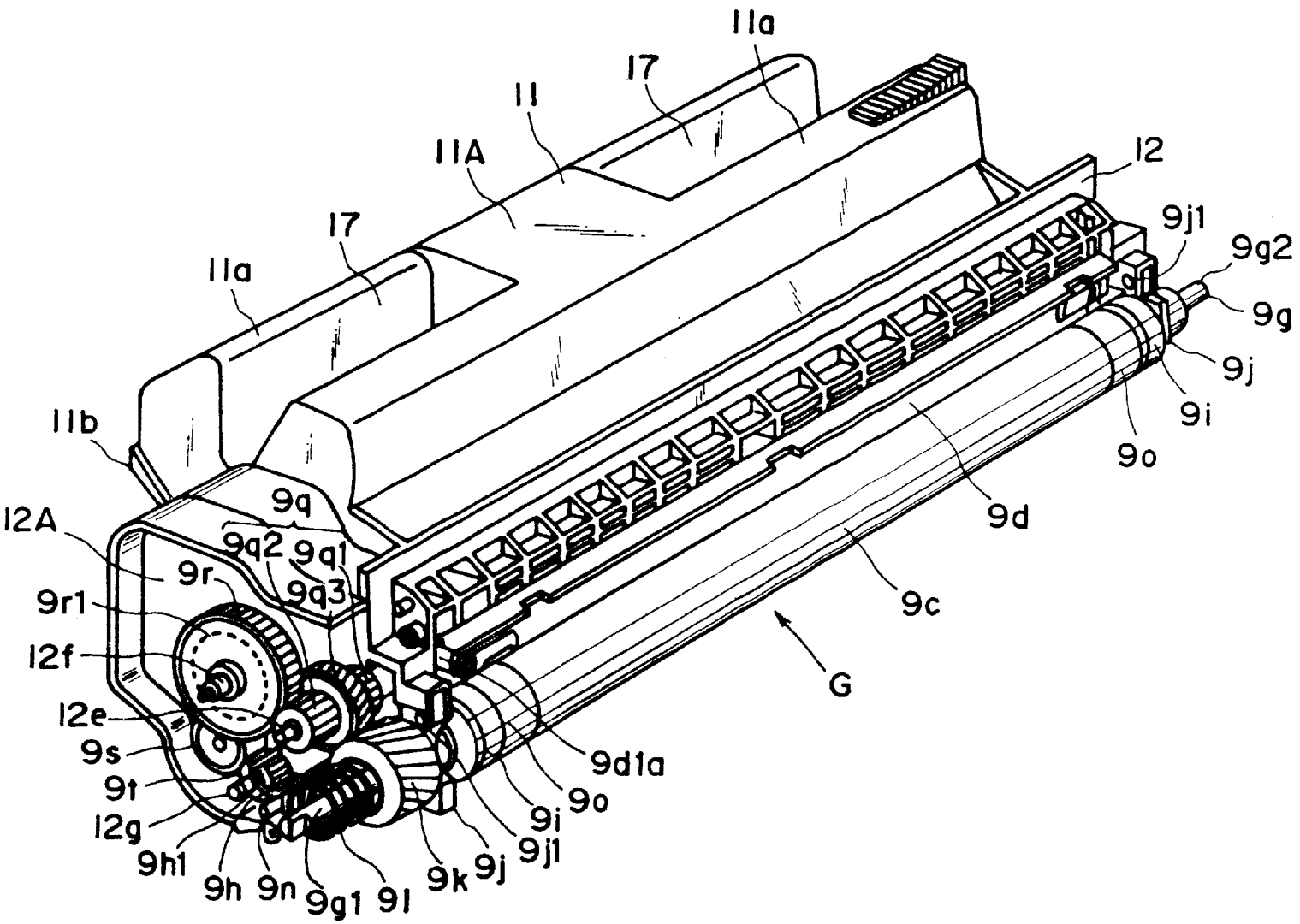
FIG. 13 is a perspective view in which t developing device holder of the developing unit is omitted.

Referring to FIGS. 3, 11, 12 and 13, the developing means holding frame 12 will be described. FIG. 11 is an exploded perspective view of the developing means holding frame 12 and developing means, and shows how the various components are assembled into the developing means holding frame. FIG. 12 is a perspective view of the developing means holding frame 12 as seen from the welding surface side, and shows how the toner stirring members 9*e* and 9*f* are attached to the developing means holding frame 12. FIG. 13 is a perspective view of the development unit prior to the attachment of the development unit holder.

As described above, into the developing means holding frame 12, the development roller 9*c*, development blade 9*d*, toner stirring members 9*e* and 9*f*, and toner remainder detecting rod antenna 9*h* are assembled.

The development blade 9*d* comprises an approximately 1–2 mm thick metallic plate 9*d*1, and a piece of urethane rubber 9*d*2 fixed to the metallic plate 9*d*1 by hot melting, or with the use of double-sided tape and the like. It regulates the amount of the toner on the peripheral surface of the development roller 9*c*. A blade contact surface 12*i*, as a blade anchoring surface, of the developing means holding frame 12 is regulated to approximately 0.05 mm in flatness. The surface 12*i* is provided with a joggle 12*i*1 and a screw hole 12*i*2. In order to attach the development blade 9*d* to the developing means holding frame 12, the joggle 12*i*1 is fitted into a hole 9*d*3 of the metallic plate 9*d*1, and the metallic plate 9*d*1 is screwed to the flat surface 12*i*, by a screw put through a screw hole 9*d*4 of the metallic plate 9*d*1, and the screw hole 12*i*2. In order to prevent toner invasion, an elastic seal 12*s* formed of MOLTOPRENE or the like is pasted to the developing means holding frame 12 in a manner to extend in the longitudinal direction along the top edge of the metallic plate 9*d*1. Also pasted to the developing means holding frame 12 are a pair of elastic seals 12*s*1, which extend downward from the longitudinal ends of the elastic seal 12*s*, following the semicylindrical surfaces 12*j*, one for one, the curvature of which matches that of the peripheral surface of the development roller 9*c*. Pasted to the mandible-like portion 12*h* is a thin elastic seal 12*s*2, which is placed in contact with the development roller 9*c* in such a manner that the plane of the contact surface of the elastic seal 12*s*2 becomes tangent to the peripheral surface of the development roller 9*c*.

The metallic plate 9*d*1 of the development blade 9*d* is bent 90 deg. at one of the longitudinal ends, forming a bent portion 9*d*1*a*. The bent portion 9*d*1*a* makes contact with a development bias contact 121 (FIGS. 10(*a*) and 10(*b*)) held by the development unit holder, which will be described later, and equalized the metallic plate 9*d*1 and development roller 9*c* in potential level. This is done for the following reason. That is, the toner amount is detected based on the changes in the electrostatic capacity between the toner remainder detecting rod antenna 9*h* and development roller 9*c*, and therefore, this electrostatic capacity, which is affected by the metallic plate 9*d*1, must be prevented from irregularly changing. Thus, the metallic plate 9*d*1 and development roller 9*c* must be equalized in potential level.

Next, the development roller unit G will be described. The development roller unit G comprises: (1) development roller 9*c*; (2) spacer rings 9*i* for keeping constant the distance between the peripheral surfaces of the development roller 9*c* and photosensitive drum 7; (3) development roller bearings 9*j* for precisely positioning the development roller 9*c* relative to the developing means holding frame 12; (4) sleeve caps 9*o* for covering the longitudinal ends of the development roller 9*c* to prevent leakage between the cylindrical aluminum bases of the photosensitive drum 7 and development roller 9*c*; (5) development roller gear 9*k* (helical gear) driven by he helical drum gear 7*b* attached to the photosensitive drum 7, to rotate the development roller 9*c*; (6) contact 9*l* in the form of a coil spring, one end of which remains in contact with the development roller gear 9*k*; and (7) magnet 9*g* placed within the hollow of the development roller 9*c* to adhere toner to the peripheral surface of the development roller 9*c*. In order to attach the development roller unit G to the developing means holding frame 12, first, two holes 9*j*1 of the development roller bearing 9*j* are aligned one for one with the holes 12*p* of the developing means holding frame 12, located at the longitudinal ends of the developing means holding frame 12, and the pins of the development unit holders 40 and 41 are inserted through the holes 9*j*1 and 12*p*. Then, the development unit holders 40 and 41 are screwed to the developing means holding frame 12; the development roller unit G is attached to the development roller anchoring portions 12X of the developing means holding frame 12 located its longitudinal ends. The development unit holders 40 and 41 will be described later.

As described above, in this embodiment, when attaching the development roller 9*c* to the developing means holding frame 12, first, the development roller unit G is assembled, and then, the assembled development roller unit G is attached to the developing means holding frame 12 with the use of the development unit holders 40 and 41. Therefore, assembly efficiency is much better compared to directly attaching the development roller 9*c* itself to the developing means holding frame 12.

The development roller unit G is assembled in the following order. First, each longitudinal end of the development roller 9*c* is capped with a sleeve cap 9*o*. Then, each longitudinal end of the development roller 9*c* is fitted with the spacer ring 9*i* and the development roller bearing 9*j*. The spacer ring 9*i* is placed on the outward side of the sleeve cap 9*o*, and the development roller gearing 9*j* is placed on the outward side of the spacer ring 9*i*. Next, the development roller gear 9*k* is attached to one of the longitudinal ends of the development roller 9*c*, on the outward side of the bearing 9*j*, and the development contact 9*l* in the form of a coil spring is attached to the same longitudinal end of the development roller 9*c* as that to which the development roller gear 9*k* is attached, on the outward side of the development roller gear 9*k*. At this stage of assembly, one longitudinal end 9*g*1 of the cylindrical magnet 9*g*, which is D-shaped in cross section at the tip, is projecting from the longitudinal end of the development roller 9*c*, to which the development roller gear 9*k* has been attached, whereas the other longitudinal end 9*g*2 of the magnet 9*g*, which is also D-shaped in cross section at the tip, is projecting from the other longitudinal end of the development roller 9*c*. The development roller unit G is structured and assembled as described above.

Next, the rod antenna 9*h* for detecting the amount of the remaining toner will be described. One end 9*h*1 of the rod antenna 9*h* is bent in a manner to form a letter U. The U-shaped end portion 9*h*1 is placed in contact with a toner detection contact 122 attached to the development unit holder 40, to establish electrical connection. The development unit holder 40 will be described later. In order to attach the rod antenna 9*h* to the developing means holding frame 12, first, the rod antenna 9*h* is inserted into the developing means holding frame 12 from the other end 9*h*3 of the rod antenna 9*h* through a through hole 12*b* of the side wall 12A of the developing means holding frame 12, and the end portion 9*h*3 is put through a through hole 12*k* of the other side wall of he developing means holding frame 12 to support the rod antenna 9*h* with the side walls of the developing means holding frame 12. In other words, the rod antenna 9*h* is accurately positioned by the through holes 12*b* an 12*k* of the side walls of the developing means holding frame 12, being thereby supported by the side walls. The through hole 12*b* is fitted with a seal (unshown), for example, a piece of felt, sponge, or the like, to prevent toner invasion.

Further, the tip 9*h*2 of the U-shaped portion 9*h*1 is inserted into an approximately 5 mm deep hole 12*o* of the developing means holding frame 12 to fix the position of the rod antenna 9*h* in terms of the axial direction, and also to increase the rigidity of the U-shaped portion as a contact which contacts the toner detection contact 122. The toner detection contact 122 will be described later. The through hole 12*k* into which the end portion 9*h*3 of the rod antenna 9*h* fits is plugged from the outward side of the side wall by thermal welding or the like method to prevent toner invasion.

Next, the toner stirring members 9*e* and 9*f* will be described. The toner stirring members 9*e* and 9*f* are shaped like a crankshaft, and stir toner by rotating. They are located in the path through which the toner stored in the toner container 11A reaches the development roller 9*c*, and near the development roller 9*c* and rod antenna 9*h*. Further, the toner stirring members 9*e* and 9*f* are arranged so that the angle formed by the arm portions of the two members becomes 90 deg.

The toner stirring members 9*e* and 9*f* are inserted into the developing means holding frame 12 through holes 12*t* and 12*r*, respectively, of the side wall 12A of the developing means holding frame 12, or the same side wall through which the rod antenna 9*h* is inserted, from the end portions 9*e*3 and 9*f*3, respectively, and the end portions 9*e*3 and 9*f*3 are fitted into the through holes 12*m* and 12*n*, respectively, of the side wall 12B of the developing means holding frame 12, which are located opposite to the side wall 12A. After the insertion, these through holes 12*m* and 12*n* are plugged by thermal welding from the outward side of the side plate 12B in the same manner as the hole 12*k* is plugged after the insertion of the rod antenna 9*h*. After the insertion of the stirring members 9*e* and 9*f* into the developing means holding frame 12, stirring gears 9*m* and 9*n* are fitted in the through holes 12*t* and 12*r*, respectively. During these insertions of the stirring gears 9*m* and 9*n*, the crank arms 9*e*2 and 9*f*2 of the toner stirring members 9*e* and 9*f* are fitted in the grooves 9*m*1 and 9*n*1 cut at the ends of the shafts of the stirring gears 9*m* and 9*n* in their diameter direction, respectively. Further, the journals 9*e*1 and 9*f*1 of the stirring members 9*e* and 9*f* are fitted in the center holes (unshown) in the bottoms of the end grooves of the shafts of the stirring gears 9*m* and 9*n*, to support the toner stirring members 9*e* and 9*f* by the developing means holding frame 12.

When the toner holding frame 11 and developing means holding frame 12 are joined, the side wall 12A of the developing means holding frame 12, through which the rod antenna 9*h* and toner stirring members 9*e* and 9*f* are inserted, covers a toner cap 11*f* attached to the top portion 11*a* of the toner holding frame 11; the side wall 12A extends over the side wall of the toner holding frame. Further, the side wall 12A is provided with the hole 12X, in which a toner sending gear 9*s* (FIG. 13) for transmitting driving force to the toner sending member 9*b* is rotationally fitted. The toner sending gear 9*s* transmits driving force to the toner sending member 9*b* by being connected a coupler 11 (FIGS. 14 and 15), which is connected to the end of the toner sending member 9*b*, and is rotationally supported by the toner holding frame 11.

Next, transmission of driving force will be described.

FIG. 13 shows a gear train. The stirring gears 9*m* and 9*n* (the stirring gear 9*m*, which is hidden in FIG. 13, is meshed with the bottom side of a small gear 9*q*1 of an idler gear 9*q*, and the stirring gear 9*n* is below the stirring gear 9*m*), and the toner sending gear 9*s*, receive driving force from the development roller gear 9*k* through a gear train. To describe more specifically, first, the stirring gear 9*m* receives driving force through the small gear 9*q*1 of the idler gear 9*q* (the idler gear 9*q* is a step gear). As the stirring gear 9*m* receives driving force, the stirring member 9*e* rotates. The idler gear 9*q* receives during force from the development roller gear 9*k* because the large gear 9*q*3 of the step idler gear 9*q* is meshed with the development roller gear 9*k*. Driving force is further transmitted from the middle gear 9*q*2 of the idler gear 9*q* to an idler gear 9*r*, which also is a step gear. Then, driving force is transmitted from the small gear 9*r*1 of the idler gear 9*r* to the toner sending gear 9*s*, rotating the toner sending member 9*b*. Further, driving force is transmitted from the toner sending gear 9*s* to the stirring gear 9*n* through an idler gear 9*t*, rotating the stirring member 9*f*. The idler gears 9*q*, 9*r* and 9*t* are rotationally mounted on joggle-like shafts 12*e*, 12*f* and 12*g*, correspondingly, which are integrally formed parts of the developing means holding frame 12. These shafts 12*e*, 12*f* and 12*g* are approximately 2–3 mm in diameter, and their end portions are supported by the development unit holder 40 which will be described later. Therefore, it does not occur that they deform due to load. In addition, the base portions of the shafts 12*e*, 12*f* and 12*g* are increased in diameter in a manner of "cladding" or in a stepped manner, to increase their rigidity. The gear train is located on the same side of the developing means holding frame 12 as the above described U-shaped portion 9*h*1 of the rod antenna 9*h*.

With the provision of the above described structural arrangement, the supporting of the gears of the gear train, and the establishment of electrical connection to the toner remainder amount detection contact, can be accomplished by a single component (development unit holder 40 in this embodiment). Further, the toner stirring members 9*e* and 9*f*, rod antenna 9*h*, gears 9*q*, 9*r*, 9*s* and 9*t* of the gear train, and stirring gears 9*m* and 9*n*, can be attached to the developing means holding frame 12 from the same side of the developing means holding frame 12 in terms of the longitudinal direction of the developing means holding frame 12. Therefore, assembly efficiency is drastically improved.

The mandible-like portion 12*h* of the developing means holding frame 12 doubles as a guide for conveying the recording medium 2, for example, recording paper. Incidentally, in order to increase the rigidity of the developing means holding frame 12, the developing means holding frame 12 may be formed by vacuum molding.

Referring to FIG. 12, a portion designated by a referential code 12P is an opening, the long edges of which are parallel to the longitudinal direction of the developing means holding frame 12. With the toner holding frame 11 joined with the developing means holding frame 12, the opening 12P aligns with the opening 11*i* of the toner holding frame 11, allowing the toner stored in the toner holding frame 11 to be supplied to the development roller 9*c*. The aforementioned rod antenna 9*h* and stirring members 9*e* and 9*f* extend from one end of the opening 12P to the other in terms of the longitudinal direction of the opening 12P.

According to this embodiment, in the developing means holding frame 12, the development roller anchoring portion 12X, side wall 12A, development blade anchoring portion (blade attachment flat surface 12*i*), rod antenna 9*h* anchoring portions (through holes 12*b*, 12*k* and 12*o*), stirring member anchoring portions (through holes 12*t*, 12*r*, 12*m* and 12*n*), gear mounting portions (shafts 12*e*, 12*f* and 12*g*), and the like are integrally formed with the developing means holding frame 12 as integral parts of the developing means holding frame 12. The material for the developing means holding frame 12 is the same as that for the above described toner holding frame 11.

Development Unit Holder

Next, the development unit holder 40 will be described.

The description regarding the development unit holder 40 will be given with reference to FIGS. 4–7, 10, 11 and 22. FIG. 10(*a*) is a perspective view of the development unit holder 40, which is attached to the developing means holding frame 12, on the side from which the process cartridge B is driven (hereinafter, "driven side"), as seen from the outward side of the development unit holder. FIG. 10(*b*) is a perspective view of the development unit holder 40 as seen from its inward side.

The development unit holders 40 and 41 are attached one for one to the longitudinal ends of the assembly shown in FIG. 13, from the longitudinal direction of the assembly, to complete the development unit D. More specifically, first, two pins 40*d* (41*d*) of the development unit holder 40 (41) are put through the corresponding holes 9*ji* of the development roller bearing, and are fitted in the holes 12*p* of the developing means holding frame 12. Then, the development unit holder 40 (41) is solidly fixed to the developing means holding frame 12 with the use of small screws 33 (34), in a manner to sandwich the development roller bearing 9*j* with the development unit holder 40 (41) and developing means holding frame 12. The small screws 33 (34) are put through holes 401 (411) of the development unit holder 40 (41). As for the mounting of the magnet 9*g* (FIGS. 3 and 13) to be placed in the cylindrical hollow of the development roller 9*c*, one end 9*g*1 of the shaft of the magnet 9*g*, which is D-shaped in cross section, is fitted in a hole 40*e* of the development unit holder 40, which also is D-shaped in cross section, whereas the other end 9*g*2 of the shaft of the magnet 9*g*, which also has a D-shaped cross section, is fitted in a hole 40*e* (FIG. 22) of the development unit holder 41. As a result, the position of the magnet 9*g* in terms of the longitudinal direction becomes fixed. The angles of the magnetic poles of the magnet 9*g* relative to a referential point become fixed as the aforementioned magnetic shaft ends with the D-shaped cross section are fitted in the corresponding holes 40*e* with the D-shaped cross section.

The development unit holder 40 (41) is provided with a rotational axis 20, which is an integrally formed part of the development unit holder 40 (41) and projects from the development unit holder 40 (41). The rotational axis 20 is placed in the recess 21 (FIG. 7(*a*)) of the cleaning means holding frame 13, and then, the developing means holding frame 12 is connected to the cleaning means holding frame 13 by the connecting member 22 (FIG. 6). As a result, the development unit D is supported by the cleaning means holding frame 13 in such a manner that the development unit D is allowed to pivot relative to the cleaning means holding frame 13 which holds the photosensitive drum 7. In addition, the compression spring 22*a* (FIGS. 16 and 17) attached to the connecting member 22 for the purpose of keeping constant the gap between the peripheral surfaces of the photosensitive drum 7 and development roller 9*c* (in order to prevent the photosensitive drum 7 and development roller 9*c* from becoming displaced relative to each other due to vibrations) is pressed upon the spring seat 40*b* (41*b*) (FIGS. 10 and 22) of the development unit holder 40 (41).

As described before, the development unit holder 40 (41) is provided with a long guide 12*a*, which is on the outward surface of the development unit holder 40 (41). Further, the development unit holder 40 is fitted with the toner detection contact 122 for detecting the amount of the remaining toner, and development bias contact 121. The contacts 122 and 121 are formed of metallic plate, and are attached to the development unit holder 40 by pressing the projection on the inward surface of the development unit holder 40, through the holes of the contacts 122 and 121. First, the attachment of the toner detection contact 122 will be described with reference to the drawings.

The toner detection contact 122 comprises an external portion 122*a* and an internal portion 122*b*. The external portion 122*a* is positioned on the external surface of the development unit holder 40 so that it remains in contact with an unshown toner detection contact provided on the apparatus main assembly 14 side when the process cartridge B is in the apparatus main assembly 14. The internal portion 122*b* remains in contact with the U-shaped portion 9*h*1 of the rod antenna 9*h*, while maintaining a predetermined contact pressure between the two portions. The exposed surface of the external portion 122*a* of the toner detection contact 122 is virtually flush with the external surface 40*a*1 of the main wall 40*a* of the development unit holder 40. The internal portion 122*b* of the toner detection contact 122 is positioned on the inward side of the development unit holder 40 so that the internal portion 122*b* contacts the rod antenna 9*h*. In other words, he toner detection contact 122 is put through the main wall 40*a* of the development unit holder 40.

Next, the development bias contact 121 will be described.

The development bias contact 121 has a plate spring portion 121*a*, the inward portion 121*b*, and the outward portion 121*c*. The portions 121*a* and 121*b* are on the inward side of the development unit holder 40, whereas the portion 121*c* is on the outward side of the development unit holder 40. After the attachment of the development unit holder 40 to the developing means holding frame 12, the plate spring portion 121*a* is kept in contact with the bend portion 9*d*1*a* of the metallic plate 9*d*1 of the development blade 9*d*, by its own elasticity, and keeps the metallic plate 9*d*1 and development roller 9*c* virtually equalized in potential level. The inward portion 121*b* is fitted around a boss 40*f* with the aforementioned hole 40*e*, and is kept in contact with the development contact 9*l*, in the form of a coil, fitted around the boss 40*f*, by the elasticity of the development contact 9*l*, while allowing the development contact 9*l* to slide on the inward portion 121*b* (maintaining a contact pressure in a range of 100 g–300 g). If necessary, electrically conductive grease may be coated on the surface area of the inward portion 121*b* on which the development contact 91 slides. The outward portion 121*c* is set in a recess of the side wall 40*a*, which is on the outward side of the side wall 40*a*. The outward surface of the outward portion 121*c* is virtually flush with the outward surface of the side wall 40*a*. After the process cartridge B is mounted in the apparatus main assembly 14, the outward portion 121*c* remains in contact with an unshown development contact of the apparatus main assembly 14, and receives from the apparatus main assembly 14 the development bias which is applied to the development roller 9*c*. In other words, the development bias is applied from the apparatus main assembly 14 to the development roller 9*c* through the development bias contact 121, and the development contact 9*l* in the form of a coil.

After the attachment of the development unit holder 40 to the developing means holding frame 12, the inward portion 122*b*, or the plate spring portion, of the toner detection contact 122 remains in contact with the U-shaped portion 9*h*1 of the rod antenna 9*h* shown in FIG. 13, remaining therefore electrically connected to the rod antenna 9*h*. The contact pressure between the rod antenna 9*h*, and the inward portion 122*b* of the toner detection contact 122, is approximately 100 g. Further, after the mounting of the process cartridge B in the apparatus main assembly 14, the outward portion 122*a* set in the outward surface 40*a*1 of the development unit holder 40 remains electrically connected to the unshown toner detection contact of the apparatus main assembly 14. Thus, an electrical signal reflecting the electrostatic capacity between the development roller 9*c* and rod antenna 9*h*, which fluctuates in response to the changes in the amount of the toner present between the development roller 9*c* and rod antenna 9*h*, is transmitted to the unshown contact of the apparatus main assembly 14 through the rod antenna 9*h* and toner detection contact 122. As a control portion (unshown) detects that the electrical signal transmitted to the unshown contact of the apparatus main assembly 14 has reached a predetermined level, the control portion signals that the process cartridge B should be replaced. As described before, in the three holes 40*g* in the inward surface of the development unit holder 40, the end portions of the joggle-like gear shafts 12*e*, 12*f* and 12*g* for the gears 9*q*, 9*r* and 9*t* fit, correspondingly. In other words, the joggle-like gear shafts 12*e*, 12*f* and 12*g* are sandwiched by the development unit holder 40 and developing means holding frame 12, being supported thereby. In the hole 40*m* in the inward surface of the development unit holder 40, the stirring gear 9*m* is inserted to be rotationally supported by the development unit holder 40.

Making a single component (development means holder) perform various functions as described above leads to improvement in assembly efficiency as well as cost reduction.

Also in this embodiment, the rotational axis 20, spring mounting portion 40*b*, long guide 12*a*, magnet 9*g* anchoring portion (hole 40*e*), development bias contact anchoring portion (boss 40 and the like), toner detection contact 122 anchoring portion, hole 40*m*, pin 40*d*, screw hole 401, and the like are formed as integral parts of the development unit holder 40. Further, the rotational axis 20, spring mounting portion 41*b*, long guide 12*a*, and the like are formed as integral parts of the development unit holder 41. The developing means holders 40 and 41 are formed of acrylonitrile-styrene copolymer resin (which contains glass filler by 20%) in a single step.

In order to attach the development unit holder 40 (41) to the developing means holding frame 12, first, the development unit holder 40 (41) is accurately positioned relative to the developing means holding frame 12 by inserting the pins 40*d* (41*d*) of the development unit holder 40 (41) into the holes 12*p* of the developing means holding frame 12, and then, a screw is put through the screw hole 401 (411) of the development unit holder 40 (41), and screwed into the female threaded hole 12*r*1 of the developing means holding frame 12.

Structure of Electrical Contact

Next, referring to FIGS. 4 and 7, the connections and positions of the electrical contacts for electrically connecting the process cartridge B and the main assembly of the image forming apparatus A as the process cartridge B is mounted into the main assembly, will be described.

The process cartridge B is provided with a plurality of electrical contacts as shown in the drawings. More specifically, the process cartridge B has four electrical contacts: (1) electrically conductive ground contact 119 electrically connected to the photosensitive drum 7 to ground the photosensitive drum 7 through the apparatus main assembly 14; (2) electrically conductive charge bias contact 120 electrically connected to the charge roller shaft 8*a* to apply charge bias to the charge roller 8 from the apparatus main assembly 14; (3) electrically conductive development bias contact 121 electrically connected to the development roller 9*c* to apply development bias to the development roller 9*c* from the apparatus main assembly 14; and (4) electrically conductive toner remainder amount detection contact 122 electrically connected to the rod antenna 9*h* to detect the amount of the remaining toner. These four electrical contacts are exposed from the process cartridge B, at the outward surface of the side wall (right side) of the cartridge housing, being separated from each other by distances large enough to prevent electrical leak among them. As described before, the ground contact 119 and charge bias contact 120 are attached to the cleaning means holding frame 13, and development bias contact 121 and toner remainder amount detection contact 122 are attached to the developing means holding frame 12 (development unit holder 40). The toner detection contact 122 doubles as a cartridge presence (absence) detection contact for detecting whether or not the process cartridge B has been properly mounted in the apparatus main assembly 14.

The ground contact 119 is formed as a part of the drum shaft 7*a* of the photosensitive drum 7 either by using electrically conductive substance as the material for the drum shaft 7*a* or by inserting an electrically conductive contact into the electrically nonconductive drum shaft 7*a* through insert molding. In this embodiment, the drum shaft 7*a* is formed of metallic material such as iron. The other contacts 120, 121 and 122 are formed of approximately 0.1–0.3 mm thick electrically conductive metallic plate (for example, stainless steel plate or phosphor bronze). They are intricately extended from the inward side of the process cartridge B to the outward side of the process cartridge B. More specifically, the charge bias contact 120 is exposed from the driven side (end C1 side) of the cleaning unit C, and the development bias 121 and toner detection contact 122 are exposed from the driven side (end D side) of the development unit D.

The charge bias contact 120 is located virtually straight above the long guide 12*a*, and in the adjacencies of the portion of the cleaning means holding frame 13, which is supporting the charge roller 8 (FIG. 7(*a*)). Further, the charge bias contact 120 is electrically connected to the charge roller 8; the portion 120*a* of the charge bias contact 120 is in contact with the charge roller 8*a*.

Next, the development bias contact 121 and toner detection contact 122 will be described. These two contacts 121 and 122 are located on the longitudinal end D1 of the development unit D, that is, the same longitudinal end of the process cartridge B as where the charging bias contact 120 of the cleaning means holding frame 13 is located. Referring to FIG. 10(*a*), the outward portion 121*c* of the development bias contact 121 is located directly below the long guide 12*a*, and in the adjacencies of the portion of the right wall 12*c* of the developing means holding frame 12, which is supporting the magnet 9*g* contained in the development roller 9*c* (FIG. 4). The development bias contact 121 is electrically connected to the development roller 9*c* through the coil spring 91 as the development contact in contact with the end of the development roller 9*c* (FIG. 7(*b*)). The toner detection contact 122 shown in FIG. 4 is located on the upstream side of the long guide 12*a* in terms of the cartridge insertion direction (direction of the arrow mark X). Also referring to FIG. 7(*b*), the toner detection contact 122 is in contact with the rod antenna 9*h* extended in the toner container 11A alone the development roller 9*c*. Also as described above, the rod antenna 9*h* is stretched from one end of the development roller 9*c* to the other in terms of the longitudinal direction of the development roller 9*c*, holding a predetermined distance from the peripheral surface of the development roller 9*c*. The electrostatic capacity of the rod antenna 9*h* and development roller 9*c* changes according to the amount of the toner present between the two components 9*h* and 9*c*. Thus, the control portion (unshown) of the apparatus main assembly 14 determines the amount of the remaining toner by detecting the changes in this electrostatic capacity as changes in electrical potential.

Here, the toner remainder amount means the amount of the toner which is between the development roller 9*c* and rod antenna 9*h* and provides a predetermined amount of electrostatic capacity. Thus, it is possible to detect when the amount of the toner remaining in the toner container 11A will have reduced to a predetermined level. More specifically, as the control portion of the apparatus main assembly 14 detects through the toner detection contact 122 that the electrostatic capacity has assumed a predetermined first value, it determines that the amount of the toner remaining in the toner container 11A has reduced to a predetermined level. Also as it is detected that the electrostatic capacity has assumed the predetermined first value, the apparatus main assembly 14 signals that the process cartridge B needs to be replaced (for example, a lamp is turned on and off, or a buzzer is sounded). Further, as the control portion detects that the electrostatic capacity has assumed a predetermined second value, which is smaller than the first value, it determines that the process cartridge B has been mounted in the apparatus main assembly 14. Unless the control portion detects that the process cartridge B has been mounted in the apparatus main assembly 14, it does not allow the apparatus main assembly 14 to start an image forming operation. The apparatus main assembly 14 may be enabled to signal that the process cartridge B has not been mounted in the apparatus main assembly 14 (for example, it may be enabled to turn on and off a lamp).

Next, the connections between the electrical contacts on the process cartridge B side, and the electrical contacts on the apparatus main assembly 14 side, will be described.

The cartridge mounting space S of the image forming apparatus A is provided with four contacts (unshown) which come into contact with the contacts 119–112, correspondingly, as the process cartridge B is mounted in the cartridge mounting space S. The four contacts are on the same wall of the space S.

Here, the positional relationships among the contacts and guides will be described.

First, referring to FIG. 4, in terms of the vertical direction, the development bias contact 121 is positioned at the lowest level. The toner detection contact 122, long guide 12*a*, and cylindrical guide 13*a* (ground contact 119) are positioned at about the same level above the development bias contact 121, and above these three, the short guide 13*b* is positioned. The charge bias contact 120 is positioned at the highest level. In terms of the cartridge insertion direction (direction of arrow mark X), the toner detection contact 122 is positioned most upstream. The long guide 12*a*, charge bias contact 120, and development bias contact 121 are positioned on the downstream side of the toner detection contact 122 in the listed order. Positioned further downstream are the short guide 13*b* and cylindrical guide 13*a* (ground contact 119). With the above described positioning of the contacts and guides, the charge bias contact 120 is placed close to the charge roller 8; development bias contact 121, to the development roller 9*c*; the toner detection contact 122, to the rod antenna 9*h*; and the ground contact 119 is placed close to the photosensitive drum 7. In other words, the electrodes do not need to be intricately routed; the distances among the corresponding contacts can be reduced.

As the contacts 119–122 of the process cartridge B are positioned on the same side (drive side) as the helical drum gear 7*b* as in this embodiment, the engagements between the helical drum gear 7*b* and the cartridge driving means on the apparatus main assembly 14, and the electrical connection between the contacts 119–122 on the process cartridge B side and the electrical contacts on the apparatus main assembly 14 side, occur on the same side of the process cartridge B. Thus, if this side is used as the positional reference, the amount of compounded dimensional error can be reduced, and therefore, the contacts 119–122 and helical drum gear 7*b* can be more accurately positioned. Further, if the helix direction of the helical drum gear 7*b* is set, as in the above described embodiment, so that the photosensitive drum 7 is thrust toward the helical drum gear 7*b*, the position of the photosensitive drum 7 in terms of the axial direction of the photosensitive drum 7 can be fixed, relative to the side of the process cartridge B on which the contacts are placed. In this case, not only can the aforementioned effects be obtained, but also it is possible to improve the accuracy in the positional relationship between the photosensitive drum 7 and each contact. Further, if the lever 23 for opening or closing the drum shutter 18 (FIG. 5) is placed, as in the above described embodiment, on the side opposite to the side where the contacts 119–122 are placed, the frictional resistance which occurs as the process cartridge B is inserted into the apparatus main assembly 14 is evenly distributed in terms of the longitudinal direction of the process cartridge B; in other words, the frictional resistance caused on one side of the process cartridge B in terms of the longitudinal direction of the process cartridge B balances with the force which applies to the lever 23 on the other side as the drum shutter 18 is opened or closed. Therefore, the process cartridge B can be smoothly inserted.

Further, if the all the contacts of the process cartridge B are placed on the one side of the process cartridge B, and the process cartridge B is kept pressed rightward of the process cartridge B by a leaf spring 45 placed in the positioning groove 16*a*5 shown in FIG. 9, as in the above described embodiment, it is assured that all the contacts on the process cartridge B side remain in contact with the counterparts on the apparatus main assembly 14 side.

Incidentally, the contacts may be placed on the same side as the shutter lever 23. Such an arrangement also sufficiently provides the same effects as described above.

Structure of Process Cartridge Frame

The process cartridge B in this embodiment comprises the toner holding frame 11, developing means holding frame 12, and cleaning means holding frame 13, which together constitute the frame of the process cartridge B. Next, the structure of this frame of the process cartridge B will be described.

Referring to FIG. 3, the toner holding frame 11 comprises the toner container 11A, and the toner sending member 9*b* is attached to the toner holding frame 11. To the developing means holding frame 12, the development roller 9*c* and development blade 9*d* are attached. Also to the developing means holding frame 12, the stirring members 9*e* and 9*f* for circulating the toner within the development chamber are attached in the adjacencies of the development roller 9*c*. The toner holding frame 11 and developing means holding frame 12 are welded to each other, forming a development unit D (FIG. 7(*b*)).

To the charging means holding frame 13, the photosensitive drum 7, charge roller 8, and cleaning means 10 are attached. Further, the drum shutter 18 for protecting the photosensitive drum 7 by covering the photosensitive drum 7 when the process cartridge B is outside the apparatus main assembly 14 is attached to the charging means holding frame 13, completing the cleaning unit C (FIG. 7(*a*)).

Figure 16:
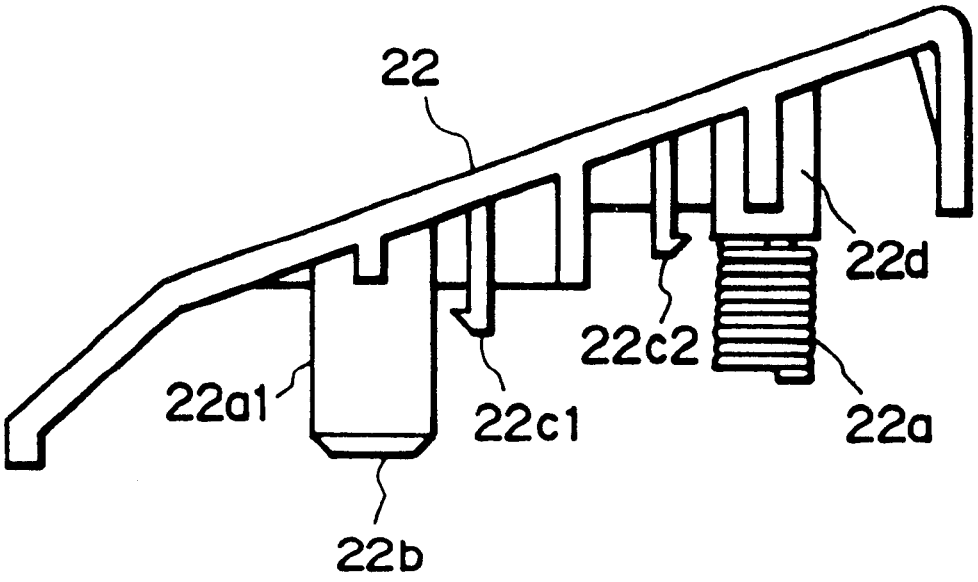
FIG. 16 is a side view of a connecting member.
Figure 17:
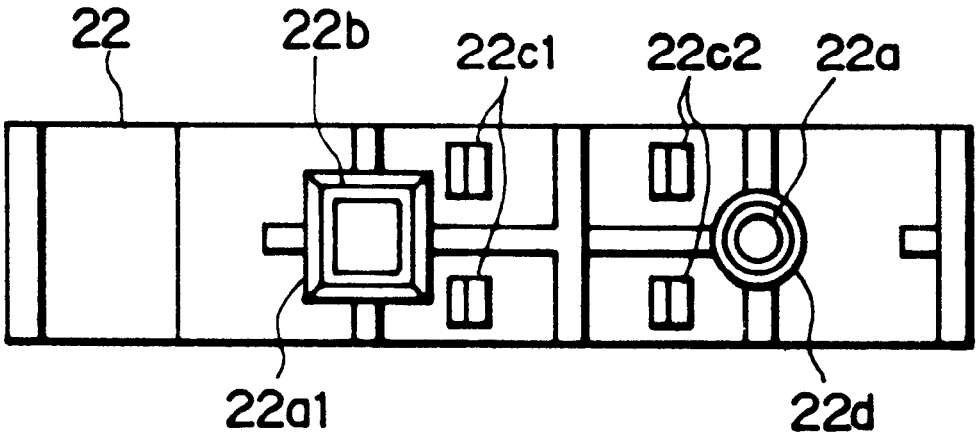
FIG. 17 is a bottom view of the device shown in FIG. 16.

The development unit D and cleaning unit C are joined by the connecting members 22, forming the process cartridge B. Here, the connecting member 22 will be described with reference to drawings. Referring to FIG. 16, each connecting member 22 in this embodiment comprises: a positioning projection 22*b* for fixing the positional relationship of the development unit D relative to the cleaning unit C; a compression spring 22*a* for keeping the development roller 9*c* of the development unit D upon the photosensitive drum 7 of the cleaning unit C; and a plurality of anchoring claws (snap claw) 22*c*1 and 22*c*2 which engage with the counterparts of the cleaning unit C to keep the cleaning unit C and development unit D joined. More specifically, the positioning projection 22*b* and the claws 22*c*1 and 22*c*2 are integrally formed parts of the connecting member 22, and the compression spring 22*a* is attached to the connecting member 22 after the formation of the connecting member 22.

Figure 18:
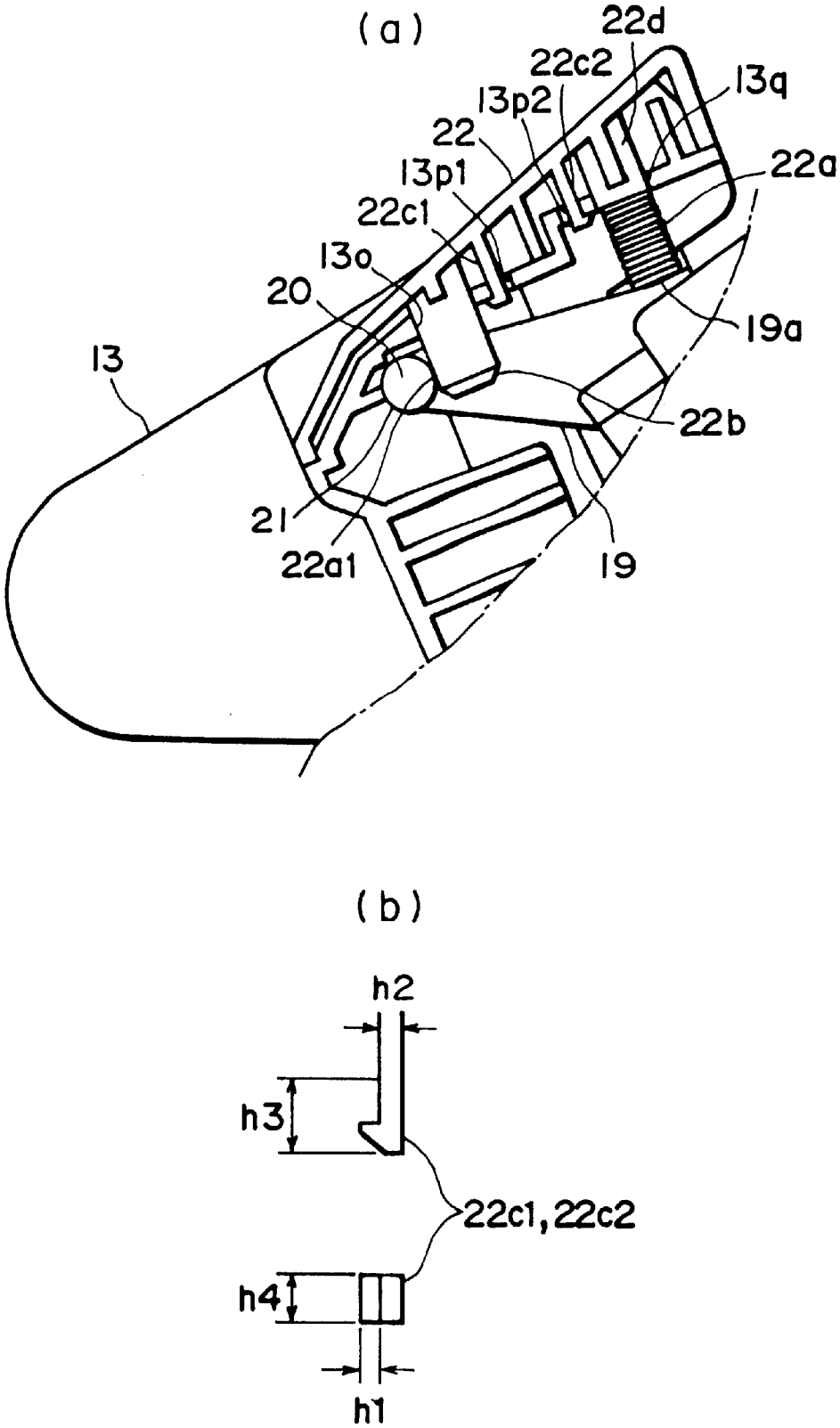
FIG. 18(*a*) is a longitudinal sectional view of a connecting portion of the process cartridge.

The development unit D comprises the development unit holder 40 and 41, which are attached one for one to the longitudinal ends of the developing means holding frame 12. The development unit holder 40 (41) has the arm 19, which has a connecting projection, the end portion of which constitutes the rotational axis 20. The development unit holders 40 and 41 are structured so that after their attachment to the developing means holding frame 12, their rotational axes 20 align with each other (FIG. 7(*b*)). On the other hand, the charging means holding frame 13 has the connecting recesses 21 (FIG. 7(*a*)), which are located one for one at the longitudinal ends of the charging means holding frame 13, and into which the aforementioned connecting projections are placed, being thereby accurately positioned. Referring to FIG. 18, each longitudinal end of the charging means holding frame 13 is provided with a square hole 13*o* into which the positioning projection 22*b* fits, square holes 13*p*1 and 13*p*2 into which the aforementioned anchoring claws 22*c*1 and 22*c*2 snap, and a round hole 13*q* through which the aforementioned compression spring 22*a* is put. These holes are in the top wall portion of the connecting recess 21.

After the rotational axis of the aforementioned connecting projection is placed in the connecting recess 21 of the charging means holding frame 13, the connecting member 22 is inserted into the charging means holding frame 13 in a manner to cause the anchoring claws to snap into the corresponding holes. As a result, the development unit D is rotationally connected to the cleaning unit C.

As the two units C and D are connected, the compression spring 22*a* attached to the connecting member 22 fits into the spring catcher 19*a* located at the base portion of the arm 19 of the development unit D, continuously generating such moment that works in the direction to rotate the development unit D about the rotational axis 20 of the connecting projection. As a result, the development roller 9*c* is kept pressed toward the photosensitive drum 7 by the weight of the development unit D itself and the resiliency of the compression spring 22*a*, with the interposition of the spacer rings 9*i*, the diameter of which is slightly larger than that of the development roller 9*c*, and which is coaxial with the development roller 9*c* (FIG. 22).

To one end of the photosensitive drum 7 and the same end of the development roller 9*c*, the helical drum gear 7*b* and helical development roller gear 9*k* (FIGS. 7(*a*) and 7(*b*)) are attached, being meshed with each other. Therefore, the development roller 9*c* is rotationally driven by he photosensitive drum 7. The development unit holder 40 (41) is configured so that the traverse line of action at the pitch point between the photosensitive drum 7 and development roller 9*c*, and the straight line connecting the pitch point and axial line of the rotational axis 20, is approximately 0–6 deg. on the meshing side. Therefore, as the photosensitive drum 7 rotates the development roller 9*c*, the moment is also generated in the development unit D, causing the development roller 9*c* to be pressed toward the photosensitive drum 7, with the interposition of the spacer rings 9*i*.

In other words, in the process cartridge B, the development roller 9*c* is kept pressed toward the photosensitive drum 7, with the interposition of the spacer rings 9*i*, by the weight of the development unit D itself, resiliency of the compression springs 22*a*, and the moment generated by the rotational driving of the development roller 9*c* by the photosensitive drum 7. Therefore, the gap between the peripheral surfaces of the photosensitive drum 7 and development roller 9*c* is kept constant (in this embodiment, approximately 300 $\mu$m), assuring that images of good quality are continuously outputted.

Next, the connecting member 22 will be described in detail. The connecting member 22 and its integral components such as the positioning projection 22*b* and the plurality of anchoring snap claws 22*c*1 and 22*c*2 are integrally formed of resinous material by injection molding. Then, the compression spring 22*a* is attached. As for the resinous material for the connecting member 22, polyethylene (PS), acrylonitrile-butadiene-styrol (ABS), polyphenyleneoxide (PPO), and the like, are available.

The connecting member 22 is provided with positioning projection 22*b*, which is an integral part of the connecting member 22, for accurately positioning the rotational axis 20 of the connecting projection relative to the connecting recess 21 of the charging means holding frame 13. The positioning projection 22*b* is in the form of a square pillar and has a referential surface 22*a*1 which makes contact with the rotational axis 20 of the connecting projection. If the positioning projection 22*b* is in the form of a round pillar, the positioning projection 22*b* makes contact with the rotational axis 20 of the connecting projection only at one point, failing to accurately position the rotational axis 20 due to elastic deformation. Thus, shaping the positioning projection 22*b* like a square pillar so that the positioning projection 22*b* is provided with the referential surface 22*a*1, reduces the amount of error in the positioning of the rotational axis 20. Further, the positioning projection 22*b* is given virtually no tolerance so that the positioning projection 22*b* can be perfectly press fitted into the square hole 13*o* of the top wall of the cleaning means holing frame 13. This is done to fix the connecting member 22 to the charging means holding frame 13 without the presence of any play, because the presence of any play between the connecting member 22 and charging means holding frame 13 reduces the accuracy with which the position of the rotational axis 20 of the connection projection is fixed, by an amount proportional to the amount of the play.

The connecting member 22 is provided with the boss 22*d* around which the compression coil spring 22*a* is press fitted. The boss 22*d* is formed as an integral part of the connecting member 22. Therefore, the compression spring 22*a* can be press fitted around the boss 22*d* of the connection member 22 in advance; the provision of the boss 22*d* is convenient when assembling the process cartridge B.

Referring to FIG. 16, the connecting member 22 is provided with a pair of the anchoring claws 22*c*1 and a pair of the anchoring claws 22*c*2, for anchoring the connecting member 22. The anchoring snap claw pairs 22*c*1 and 22*c*2 are located in the adjacencies of the positioning projection 22*b* and compression spring 22*a*, respectively. The anchoring claw 22*c*1 in the adjacencies of the positioning projection 22*b* is directed so that the actual claw portion of the anchoring claw 22*c*1 projects toward the positioning projection 22*b*. Similarly, the anchoring claw 22*c*2 in the adjacencies of the compression spring 22*a* is directed so that the actual claw portion of the anchoring claw 22*c*2 projects toward the compression spring 22*a*. With the provision of the above structural arrangement, a reliable connection can be established; the connecting member 22 is prevented from dislodging from the charging means holding frame 13.

More specifically, the connecting member 22 is kept under the force which is generated by the resiliency of he compression spring 22*a* and works in the direction to push the connecting member 22 out of the charging means holding frame 13. However, the end portion, or the actual claw portion, of the anchoring claw 22*c*2 projects toward the compression spring 22*a*. Therefore, the force from the compression spring 22*a* keeps the actual claw portion of the anchoring claw 22*c*2 latched to the anchoring claw catch portion of the charging means holding frame 13. In other words, the connecting member 22 is prevented by the resiliency of the compression spring 20*a* from dislodging from the charging means holding frame 13.

The rotational axis 20 of the connecting projection constantly rotates due to the small vibrations of the development unit D which occur due to the vibrations of the polysensitive drum 7, development roller 9*c*, spacer rings 9*i*, and the like. As the rotational axis 20 of the connecting projection rotates, the friction between the rotational axis 20 and positioning projection 22*b* of the connection member 22 pushes the positioning projection 22*b* upward. However, the end portion, or the actual claw portion, of the anchoring claw 22*c*2 projects toward the positioning projection 22*b*. Therefore, the friction keeps the actual claw portion of the anchoring claw 22*c*1 latched to the anchoring claw catch portion of the charging means holding frame 13. In other words, the connecting member 22 is prevented from becoming dislodged from the charging means holding frame 13 due to the force which is generated by the rotational axis 20 of the connecting projection in the direction to push the positioning projection 22*b* upward.

Referring to FIG. 18(*b*), a depth h1 by which the anchoring claws 22*c*1 and 22*c*2 latch to the charging means holding frame 13 is within a range of 0.4–1.2 mm. This is because experiments have proven that if the depth h1 is no more than 0.1 mm, the engagement between the anchoring claws and corresponding catch portions of the charging means holding frame 13 is unreliable, whereas if the depth h1 exceeds 1.2 mm, the stress caused in the base portion of the each anchoring claw when the anchoring claw is snap fitted becomes excessive. Further, in this embodiment, the various dimensions of each anchoring claw are set as follows: h2=1.5 mm; h3=7.0 mm; and h4=4.0 mm.

Also in this embodiment, two pairs of anchoring claws, or a total of four anchoring claws, are formed as integral parts of the connecting member 22. However, the configuration of the connecting member 22 is not limited to the above described one. For example, the connecting member 22 may be provided with only two anchoring claws: one with its actual claw portion projecting toward the compression spring 20*a* and the other with its actual claw portion projection toward the positioning projection 2*b*. Such a configuration also provides a sufficiently reliable connection.

As the left and right connecting members 22 are inserted, the rotational axes 20 of the left and right connecting projections are confined in the left and right spaces created by the walls of the left and right connecting recesses 21 of the cleaning means holding frame 13, and the positioning projections 22*b* of the left and right connecting members 22, respectively. In this embodiment, a tolerance in a range of 0.5 mm–0.8 mm is afforded between the dimension of the above described space and the diameter of the rotational axis 20, at one of the longitudinal ends of the process cartridge B, so that even if the two rotational axes 20 (left and right rotational axes 20) fail to perfectly align due to errors in component production, the process cartridge B can be assembled.

Process Cartridge Overhaul

As the toner within the toner container 11A of the process cartridge B is used up, the process cartridge B is recovered and overhauled following the steps described below.

Step in which Cleaning Unit and Development Unit are Separated

Next, the process in which the process cartridge B is disassembled into the cleaning unit C and development unit D will be described. For this purpose, either the connecting members 22 are broken off or plied up and out.

Figure 19:
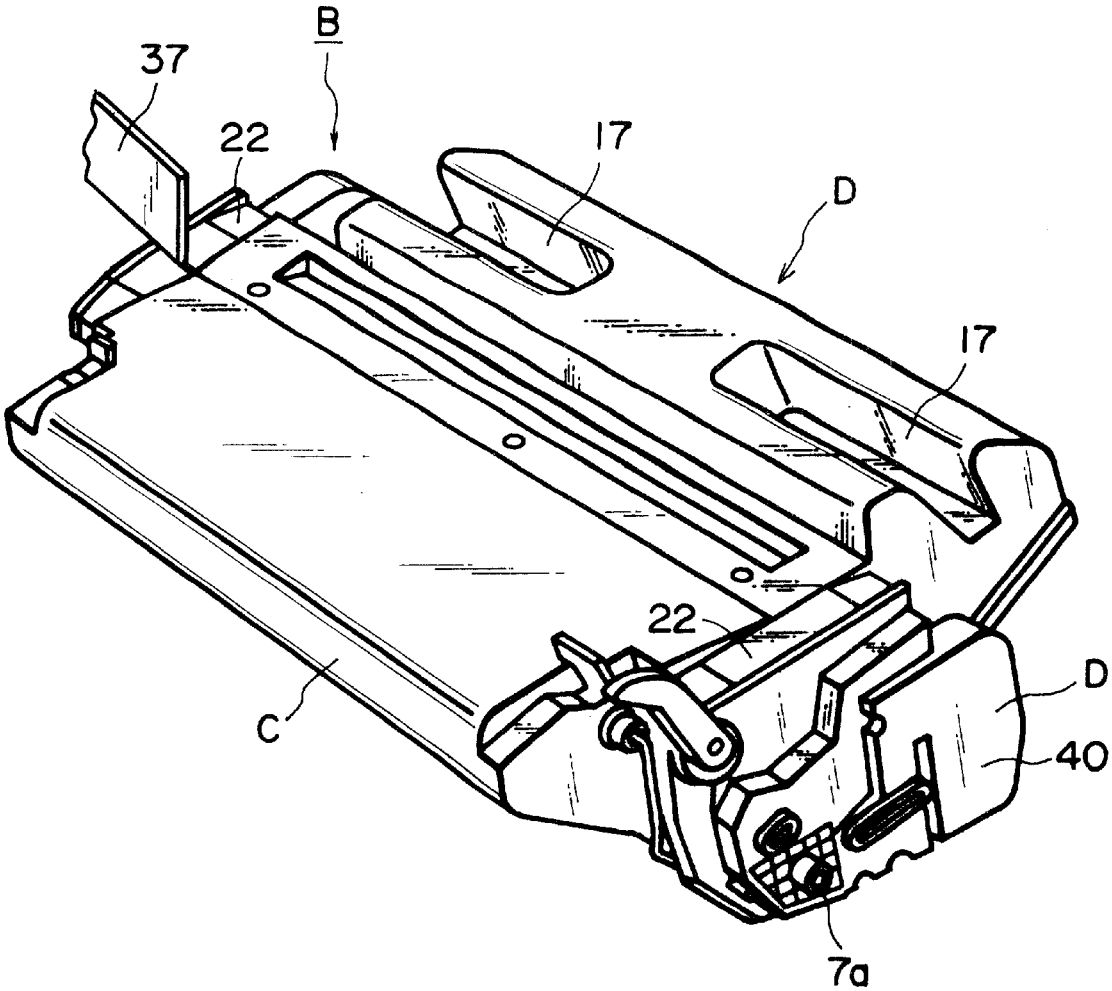
FIG. 19 is a perspective view illustrating a recycling operation of the process cartridge.

Referring to FIG. 19, first, the pair of connecting members 22, which are on the top side of the process cartridge B and are holding the cleaning unit C and development unit D together, are cut with the use of a cutter 37 or the like, and removed. As described before, each connecting member 22 is formed of resinous material, and fixes the position of the development unit D relative to the cleaning unit C in such a manner that the two units become pivotal relative to each other, with the compression spring 22*a* attached to the connecting member 22 to keep the development unit D pressed toward the cleaning unit C. Also as described before, the connecting member 22 is attached to the process cartridge B by snap fitting or the like means so that it cannot be removed.

Therefore, the cleaning unit C and development unit D can be simply and precisely joined simply by pressing the pair of connecting members 22 in the predetermined slots. Thus, in order to remove the connecting member 22, the connecting member 22 may be plied upward by inserting the tip of a flat head driver into the seam between the connecting member 22 and developing means holding frame 12, or between the connecting member 22 and charging means holding frame 13. While plying upward the connecting member 22, some of the anchoring claws 22*c*1 and 22*c*2 sometimes break. If any of the claws 22*c*1 and 22*c*2 breaks, the connecting member 22 is replaced with a new one. Otherwise, the connecting member 22 is examined to determine if it satisfactorily functions. If it is confirmed that the connecting member 22 satisfactorily functions, the connecting member 22 is reused. As for the compression spring 22*a*, if the examination of the compression spring 22*a* shows no abnormality, it is reused.

As the pair of connecting members 22 are removed, the cleaning unit C and development unit D become separated from each other.

Cleaning Unit Overhaul

Figure 20:
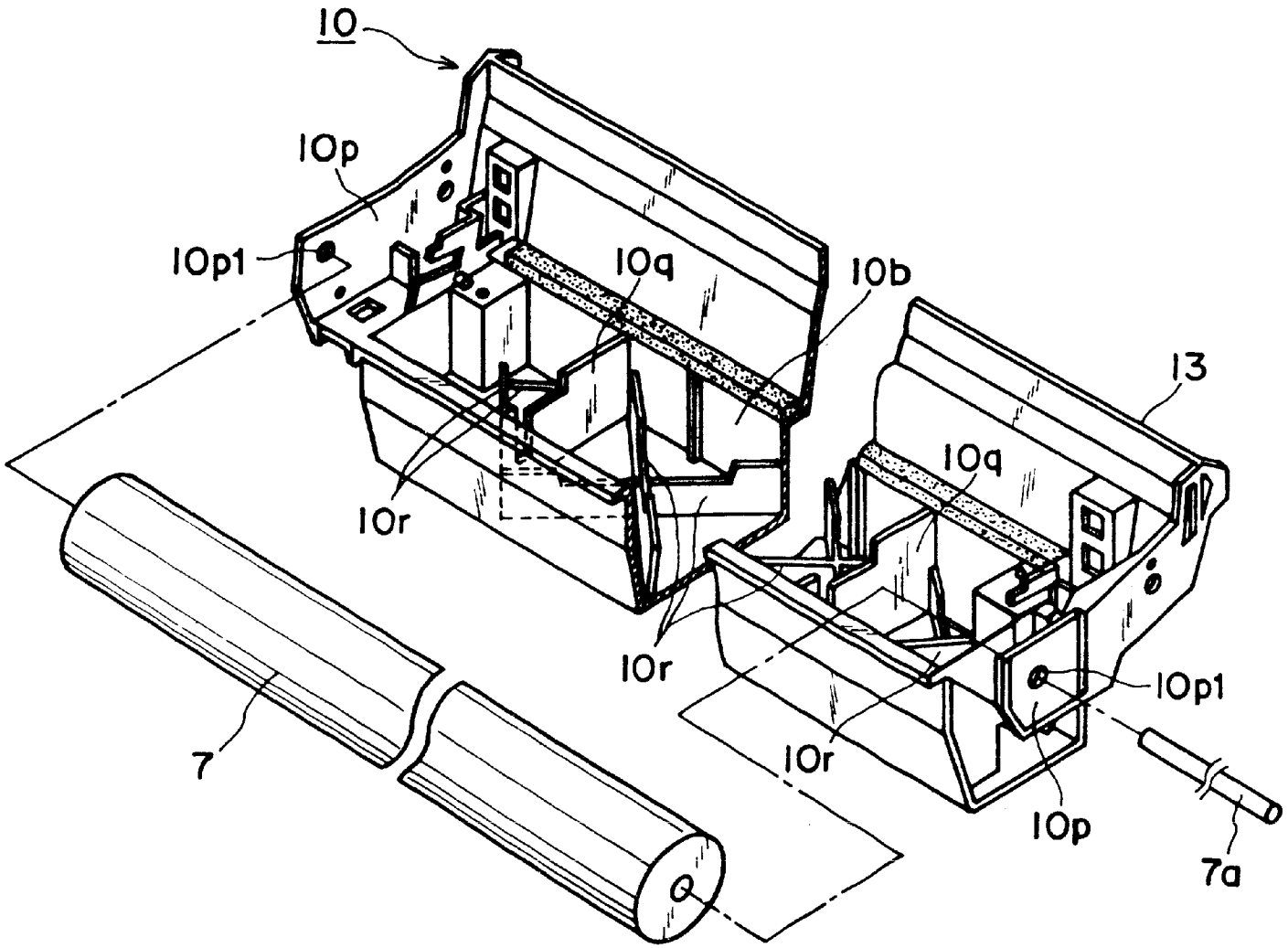
FIG. 20 is an exploded perspective view of a cleaning frame.
Figure 21:
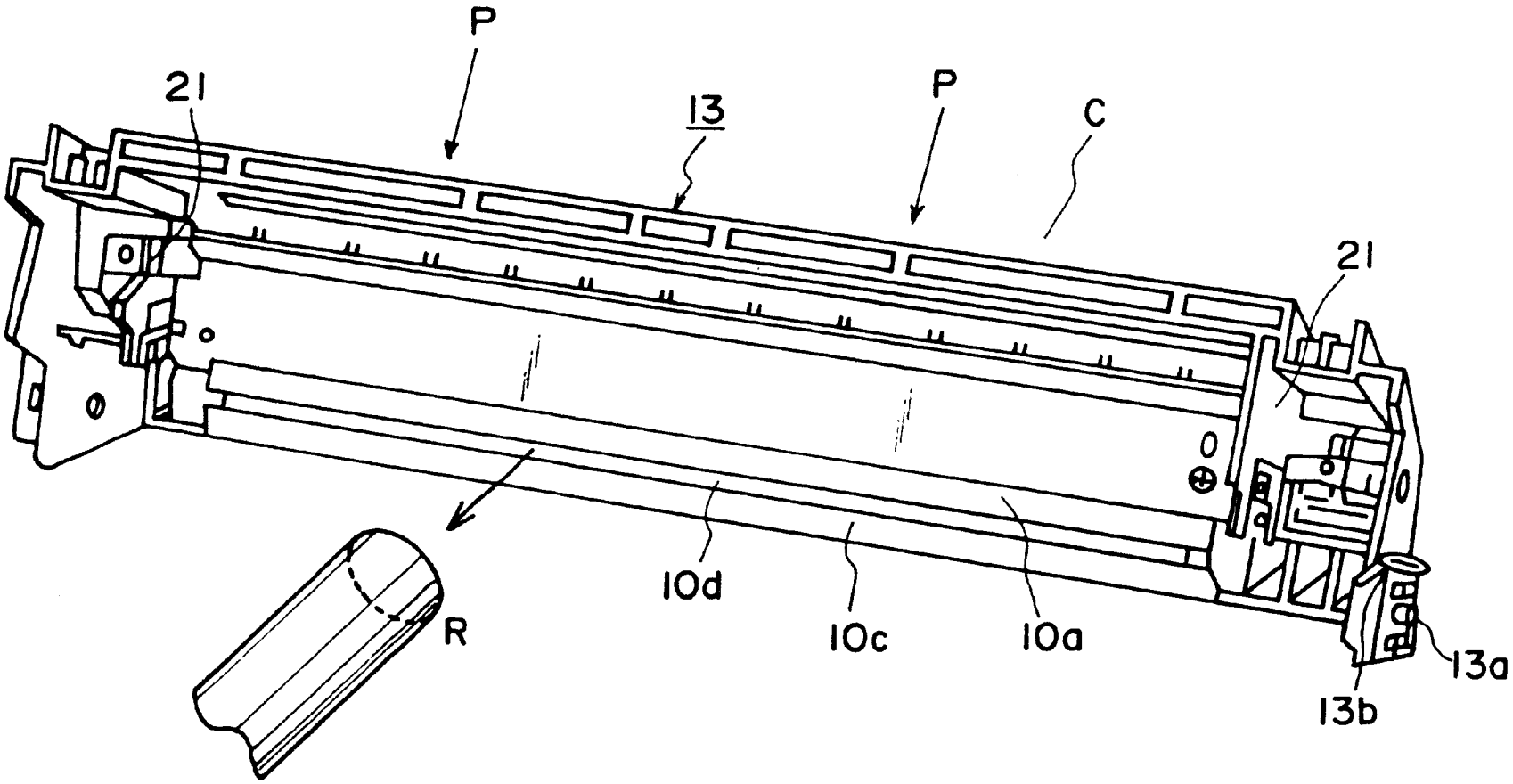
FIG. 21 is a perspective view illustrating a cleaning operation of a cleaning frame.

Next, the photosensitive drum 7 unit attached to the cleaning unit C is removed. Referring to FIG. 20, the photosensitive drum 7 unit is between the side walls 10*p* of the charging means holding frame 13 of the cleaning unit C, and is rotationally supported by the drum shaft 7*a*, the longitudinal ends of which are anchored in the drum shaft holes 10*p*1 of the side walls 10*p*. The drum shaft 7*a* extends from the shaft hole 10*p*1 of one of the side walls 10*p* to the shaft hole 10*p*1 of the other wall through the photosensitive drum 7.

In order to pull the drum shaft 7*a* out of the charging means holding frame 13, one end of the drum shaft 7*a* must be tapped inward of the charging means folding frame 13 by a hammer or the like to make the other end of the drum shaft 7*a* stick outward of the side wall 10*p*. Then, the drum shaft 7*a* can be pulled out of the charging means holding frame 13 by holding the protruding end of the drum shaft 7*a*. When tapping the end of the drum shaft 7*a*, a shaft which is smaller in diameter than that of the drum shaft 9*a* may be placed between the end of the drum shaft 7*a* and the hammer, because the placement of such a shaft makes the drum shaft 7*a* removing operation much easier to perform. As the drum shaft 7*a* is removed, the photosensitive drum 7 can be removed from the charging means holding frame 13. The internal space of the charging means holding frame 13 is partitioned by partitioning ribs 10*q*, and a reinforcement rib 10*r* is diagonally placed in each compartment formed by the placement of the partitioning ribs 10*q*.

Next, cleaning of the charging means holding frame 13 will be described. After the removal of the photosensitive drum 7, the cleaning unit C looks as shown in FIG. 20. This cleaning unit C is fixed on an appropriate table. Then, an overhauling technician must press the opening of the suction nozzle R of a vacuuming apparatus (unshown) against the gap 10*d* between the cleaning blade 10*a* and a receptor sheet 10*c*, by holding the suction nozzle R by hand. Then, the overhauling technician must suction the waste toner within the charging means holding frame 13 by horizontally moving the suction nozzle opening along the gap while tapping the charging means holding frame 13 along the portions indicated by arrow marks P.

After the extraction of the waste toner, the cleaning blade 10*a* and receptor sheet are removed from the cleaning unit C. Then, the interiors of the charging means holding frame 13 and removed toner bin 10*b* are cleaned with air or the like. The removed cleaning blade 10*a* is cleaned, and examined for abnormality. If no anomaly is found, it is reused as it is.

Whether or not the removed photosensitive drum 7 and cleaning blade 10*a* are reusable is determined through predetermined tests after the toner adhering to them is removed by air blast. Those which fail the tests, that is, those which do not meet predetermined performance standards, are exchanged with new components. However, a given component of a process cartridge which is known, through the studies conducted during the development stage of the process cartridge and/or statistical studies of the component carried out during numerous overhauling processes, to have a high probability that it will need to be replaced with a new one, should be replaced with a new one without testing it. Replacing such a component with a new one without testing it sometimes improves overhauling efficiency. After a new cleaning blade, or a recycled cleaning blade, and a new receptor sheet 10*c*, are attached to the cleaning means holding frame 13, a new photosensitive drum, or a recycled photosensitive drum 7, is rotationally attached to the cleaning means holding frame 13 following in reverse order the steps followed to removed the photosensitive drum 7 from the cleaning means holding frame 13.

Development Unit Overhaul

Referring to FIGS. 7(*b*), 11 and 22, before describing the overhauling of the development unit D, the general structure of the development unit D prior to disassembly will be described. As described before the development roller 9*c* is rotationally supported by the development roller bearings 9*j*; the sleeve flanges with which the longitudinal ends of the development roller 9*c* are rotationally supported by the development roller bearings 9*j*. The development blade 9*d* is attached to one of the long edges of the opening of the developing means holding frame 12. The magnet 9*g* is placed in the hollow of the development roller 9*c*. The longitudinal ends 9*g*1 and 9*g*2, or the shaft portions, of the magnet 9*g* have a D-shaped cross section, and are fitted in the holes 40*e* of the development unit holder 40 and 41, which also have a D-shaped cross section (FIGS. 10 and 22). The development unit holders 40 and 41 are screwed to the longitudinal ends of the developing means holding frame 12 one for one with the use of screws. In other words, the development roller 9*c* is rotationally supported by the development roller bearings 9*j*, and the positions of the shaft portions 9*g*1 and 9*g*2 of the magnet 9*g*, which has a D-shaped cross section, are fixed by the development unit holders 40 and 41.

The development unit holder 40 is attached to the one of the longitudinal ends of the joined combination of the toner holding frame 11 and developing means holding frame 12 across the side walls of the two frames, covering the driving force transmission gear train 24 for transmitting driving force to the toner sending member 9*b* and toner stirring members 9*e* and 9*f* of the developing means 9 as shown in FIG. 22, and thus constituting a part of the external portion of the process cartridge B frame. The development unit holder 41 covers the other side of the developing mean holding frame 12, and also constitute a part of the external portion of the process cartridge B frame.

The development unit holder 40 and 41 supports the magnet 9*g*, the end portions of which fit in the holes of the development unit holder 40 and 41 one for one.

Removal of Development Roller and Development Blade

As described before, in order to attach the development unit holder 40 to the joined combination of the cleaning unit C and development unit D, the positioning pins 40*d*, shown in FIG. 22, were fitted in the positioning holes 12*p* (FIG. 11) of the developing means holding frame 12, and the screw 33 was screwed into the developing means holding frame 12 after being put through the hole 401 (FIG. 10) of the development unit holder 40, the location of which was different from those of the holes 12*p*. Thus, the development unit holder 40 can be removed from the side wall of the developing unit D by removing the screw 33. Also as described before, the arm 19 of the development unit holder 40 is provided with the connecting projection, a part of which constitutes the rotational axis 20. The arm 19, and its rotational axis 20, are integrally molded parts of the development unit holder 40. The rotational axis 20 is placed in the innermost part of the connecting recess 21 of the charging means holding frame 13.

The driving force transmission gear train 24 comprises seven gears: gears 9*k*, 9*m*, 9*n*, 9*q*, 9*r*, 9*s* and 9*t* (each gear of step gear is counted as one independent gear), which are different in diameter, and are meshed among them. These gears drive the development roller 9*c*, toner sending member 9*b*, and toner stirring members 9*e* and 9*f* by transmitting thereto the rotational force of the photosensitive drum 7. These gears can be easily removed, simply by pulling, from the shafts or holes, with which the developing means holding frame 12 is provided for mounting these gears.

Next, the development unit holder 41 is removed. When the development unit holder 41 was attached to the side wall of the development unit D, the positioning pins 41*d* were fitted in the positioning holes of the developing means holding frame 12, and the screw 34 was screwed into the developing means holding frame 12 through the hole 411 (FIG. 22), the location of which was different from those of the positioning holes of the developing means holding frame 12. Thus, the development unit holder 41 can be removed from the side wall of the development unit holder 41 by removing the screw 34. Also, the arm 19 of the development unit holder 41 is provided with the connecting projection, a portion of which constitutes the rotational axis 20. The arm 19, and its rotational axis 20, are integrally molded parts of the development unit holder 41. The rotational axis 20 is placed in the innermost part of the connecting recess 21 of the charging means holding frame 13.

Next, as the development unit holders 40 and 41 are removed, the end portions, or shaft portions 9*g*1 and 9*g*2, with a D-shaped cross section, of the magnet 9*g* are exposed as shown in FIG. 11, and the pins 40*d* and 41*d* of the development unit holders 40 and 41, respectively, are pulled out of the positioning holes 401 and 411 of the developing means holding frame 12. Then, the development roller unit G is pulled out of the hole **9*i*1 of each development roller bearing 9*j* in the direction perpendicular to the axial direction of the development roller unit G. Next, the unshown screw, which was screwed into the hole 12*i*2 with female threaded hole in the blade anchoring flat surface 12*i* of the developing means holding frame 12, through the screw hole 9*d*4 of the development blade 9*d*, which was placed in alignment with the hole 12*i*2 with female threads, is removed. Then, the development blade 9*d* is removed from the developing means holding frame 12 by moving the development blade 9*d* in a manner to slide the left and right positioning joggles 12*i*1 projecting from the blade anchoring flat surface 12*i*, out of the corresponding positioning holes 9*d*3 of the development blade 9*d***.

Pasting of Elastic Seal for Overhaul

If the cover film 50 is restored, an overhauled process cartridge B is virtually the same as a new one. However, in this embodiment, the cover film 50 is not restored because it is unnecessary as long as the development unit D can be sealed so that the development unit D will not leak toner after the final assembly.

Figure 23:
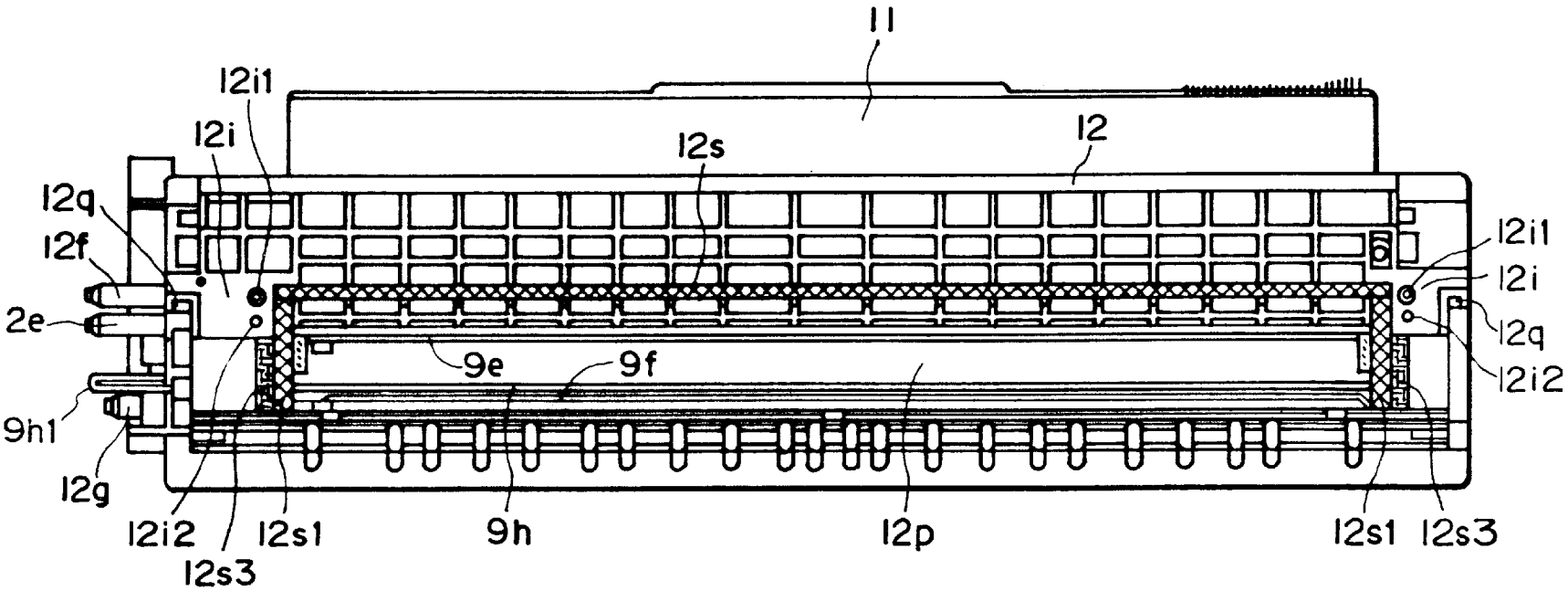
FIG. 23 is a front view of a developing unit after an elastic seal member remanufacturing has been mounted.
Figure 24:
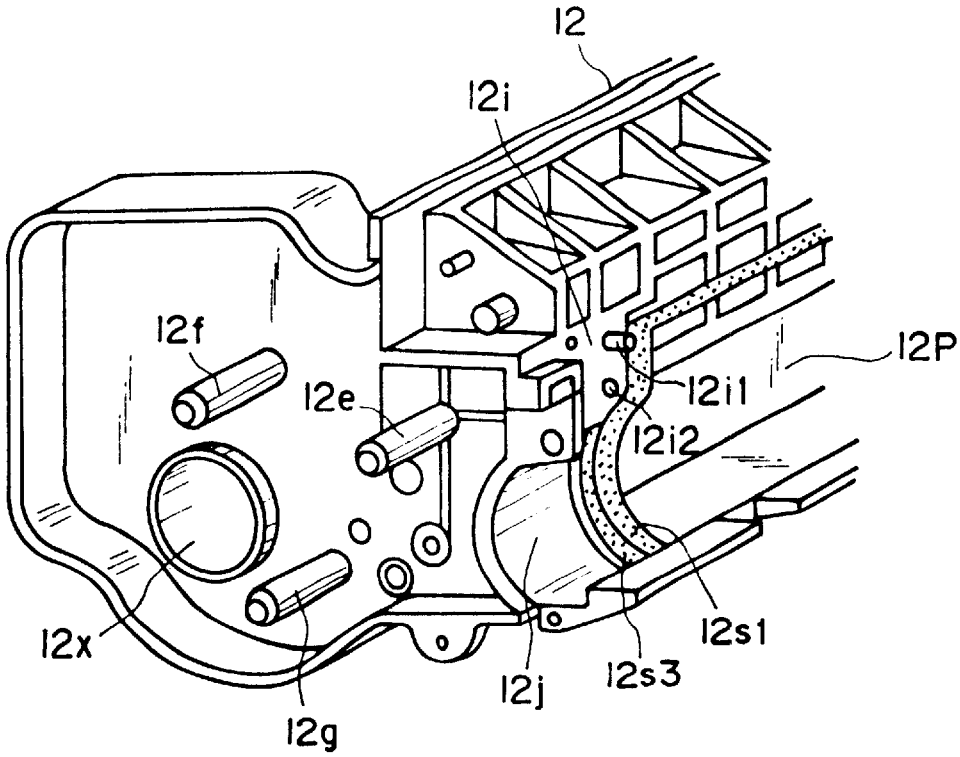
FIG. 24 is an enlarged perspective view illustrating mounting of the elastic seal member shown in FIG. 23.
Figure 25:
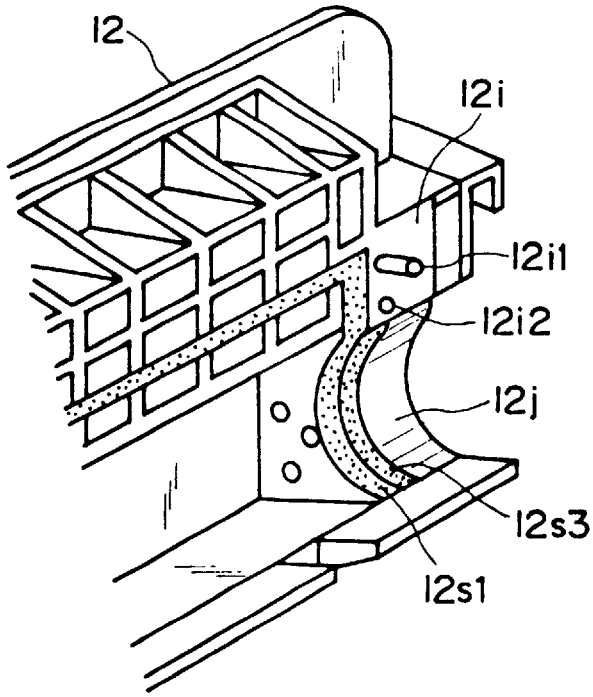
FIG. 25 is another enlarged perspective view illustrating mounting of the elastic seal member shown in FIG. 23.

Even though the cover film 51 is not restored, the development unit can be made leak proof by placing an additional elastic seal, on the outward side of the existing elastic seal **12*s*1, at each longitudinal end of the development unit D. FIG. 23 is a front view of the development unit D after the removal of the development unit holder 40 and 41, development roller unit G, and development blade 9*d* from the development unit D through the above described processes. In this drawing, a referential code 12*s*3 designates an additional elastic seal (hereinafter, "overhaul elastic seal", or "second end seal") attached to the developing means holding frame 12, on the outward side of the existing elastic seal 12*s*1 (first end seal). FIGS. 24 an 25 are enlarged perspective views of one of the longitudinal end portions, and the other, of the developing means holding frame 12 shown in FIG. 11, to which the overhaul elastic seal 12*s*3 has been attached. The overhaul elastic seal 12*s*3 is pasted to the semicylindrical surface 12*i* using pasting means such as double-sided adhesive tape or the like, in the same manner as the existing elastic seal 12*s*1. The overhaul elastic seal 12*s*3 is placed in contact with or in the adjacencies of the existing elastic seal 12*s*1. In this embodiment of the present invention, the same material as the material for the existing elastic seal 12*s*1 is used as the material for the overhaul elastic seal 12*s*3; in other words, nonwoven cloth of tetrafluoroethylene fiber, for example, Teflon felt (commercial name), is used. However, it does not need to be the same, and may be selected at the overhauling technician's discretion. Also in this embodiment, the external dimensions, or the thickness and width (in terms of the longitudinal direction of the development roller 9*c*), of the overhaul elastic seal 12*s*3 are made the same as those of the existing elastic member 12*s*1. However, its length is made less than that of the existing elastic seal 12*s*1 for the following reason. That is, there is the development blade anchoring flat surface 12*i* above where the overhaul elastic seal 12*s*3 is pasted, and therefore, if the length of the overhaul elastic seal 12*s*3 is made the same as that of the existing elastic seal 12*s*1, the overhaul elastic seal 12*s*3 extends onto the development blade anchoring flat surface 12*i*; making it difficult to accurately position the development blade 9*d* when reattaching the development blade 9*d*. Although the thickness and width of the overhaul elastic seal 12*s*3 are made the same as those of the existing elastic seal 12*s*1**, they do not need to be the same; they may be selected at the overhauling technician's discretion.

Toner Filling Process

Next, the toner container 11A is refilled with toner, with the frame portion of the development unit D held in such a manner that the toner delivery opening 12P faces upward, and the toner container 11A is positioned on the bottom side. In operation, the end of a funnel 47 is inserted through the toner delivery opening 12P, and toner t is poured into the funnel 47 from a toner bottle 48. The main portion of the funnel 47 may be provided with a measuring device equipped with an auger so that the toner container 11A can be refilled with the toner t at a higher efficiency.

Process Cartridge Assembly

After the attachment of the overhaul elastic seals **12*s*3, and the refilling of the toner container 11A with the toner t, the process cartridge B is reassembled. All that is necessary to reassemble the process cartridge B is to follow the aforementioned disassembly steps in the reverse order. In other words, first, the development blade 9*d* is attached to the developing means holding frame 12 by screwing the metallic plate 9*d*1 of the development blade 9*d* to the development blade anchoring flat surface 12*i* of the developing means holding frame 12, as shown in Figure 11**.

Next, the development roller unit G is assembled through the step in which the development roller **9*c* is fitted with the development roller bearings 9*j*, the step in which the development roller 9*c* is fitted with development roller gear 9*k*, and the like steps, as shown in FIGS. 7**(*b*), 11 and 13. Then, the thus assembled development roller unit G is attached to the developing means holding frame 12 in a manner to cover the opening **11*i* (toner delivery opening) of the developing means holding frame 12 so that each of the end portions of the development roller 9*c* is placed in contact with the toner leak prevention elastic seal 12*s*1 (first end seal) and overhaul elastic seal 12*s*3 (second end seal). During this process, the development roller bearing 9*j* is inserted into the groove 12*q* (FIG. 23) of the developing means holding frame 12. Also, the idler gears 9*q*, 9*r* and 9*t*, and the like, are fitted around the joggle-like projections 12*e*, 12*f* and 12*g*, in a manner to mesh with each other. Next, the positioning pins 40*d* of the development unit holder 40, shown in FIG. 22, are inserted into the holes 12*p* (FIG. 13) of the developing means holding frame 12, and the development unit holder 40 is screwed to the developing means holding frame 12 with the screw 33**.

Next, referring to FIGS. 7(*b*) and 22, the pins **41*d* of the development unit holder 41 are inserted into the unshown holes (hole of developing means holding frame 12, located on the side opposite to where the holes 12*p* are located, in terms of the longitudinal direction). Then, the development unit holder 41 is screwed to the developing means holding frame 12 with the screw 34**.

Before attaching the development blade **9*d* and development roller 9*c***, they are cleaned of the toner adhering to them, by blowing air upon them while suctioning the air from around them. Thereafter, they are examined to determine whether or not they are reusable. Those which failed to meet a predetermined performance standard are replaced with new ones. However, components which have been known, through the examinations during development processes, or overhauling process, to be statistically high in the probability with which they will be replaced, may sometimes be replaced with new ones without examination during the overhaul, because simply replacing them sometimes improves operational efficiency.

Next, the development unit D is placed in contact with the cleaning unit C, with the rotational axis 20 projecting from the development unit holder 40 (41) fitted in the connection recess 21 of the charging means holding frame 13. Then, a new connecting member 22, or the connecting member 22 which has passed the examination, is pushed into the connecting portion to fix the development unit D to the cleaning unit C, ending the overhauling of the process cartridge B.

According to the description of the overhauling of the process cartridge B, the developing unit holder 41 was removed after the development unit holder 40 was removed. However, the development unit holder 41 may be removed ahead of the development unit holder 40: the order in which the development unit holder 40 and 41 are removed does not matter. They may be removed at the same in such a case that the overhauling of the process cartridge B is automated.

Step for Attaching of Protective Sheet

Next, the step for attaching of a protective sheet will be described. After having been overhauled through the above described steps, the process cartridge B is packaged and shipped. During the shipment of the process cartridge B, that is, while the process cartridge B is delivered to a final user from a process cartridge factory, the following problems sometimes occur due to vibrations and impacts. That is, referring to FIG. 27 which is an enlarges sectional view of the photosensitive-drum 7, the mandible-like portion 12*h* of the developing means holding frame 12 and their adjacencies, the mandible-like portion 12*h* deforms, as indicated by the double dot chain line in FIG. 27, due to the vibrations and impacts which occur during the transportation of the process cartridge B, and as a result the edge 12*h*1 of the mandible-like portion 12*h* sometimes comes into contact with the photosensitive drum 7, damaging the photosensitive drum 7. This kind of deformation is most pronounced across the center portion of the process cartridge B in terms of the longitudinal direction for the following reason. That is, at both longitudinal ends of the developing means holding frame 12, the frame portion adjacent to the semicylindrical surface 12*j* is continuous with the mandible-like portion 12*h* as shown in FIG. 11, and this frame portion functions like a so-called sidewall which regulates the vibrations of the mandible-like portion 12*h*. Across the center portion of the developing means holding frame 12, however, there is not such a portion as the above described side wall that regulates the vibrations, and therefore, it is easier for the mandible-like portion 12*h* to deform across its center portion. As a result, the deformation is greatest across the center portion and gradually reduces toward the longitudinal ends. Thus, it does not occur that the mandible-like portion 12*h* comes into contact with the photosensitive drum 7 across the entirety of its edge 12*h*1, in terms of the longitudinal direction. In other words, only the limited portion, or the center portion, of the mandible-like portion 12*h* contacts the photosensitive drum 1. Incidentally, the greater a process cartridge in terms of the size in the longitudinal direction, the greater it is in terms of the deformation across the center portion in terms of the longitudinal direction. The thus created scratches or scars results in white or black streaks in an image, reducing image quality.

Figure 28:
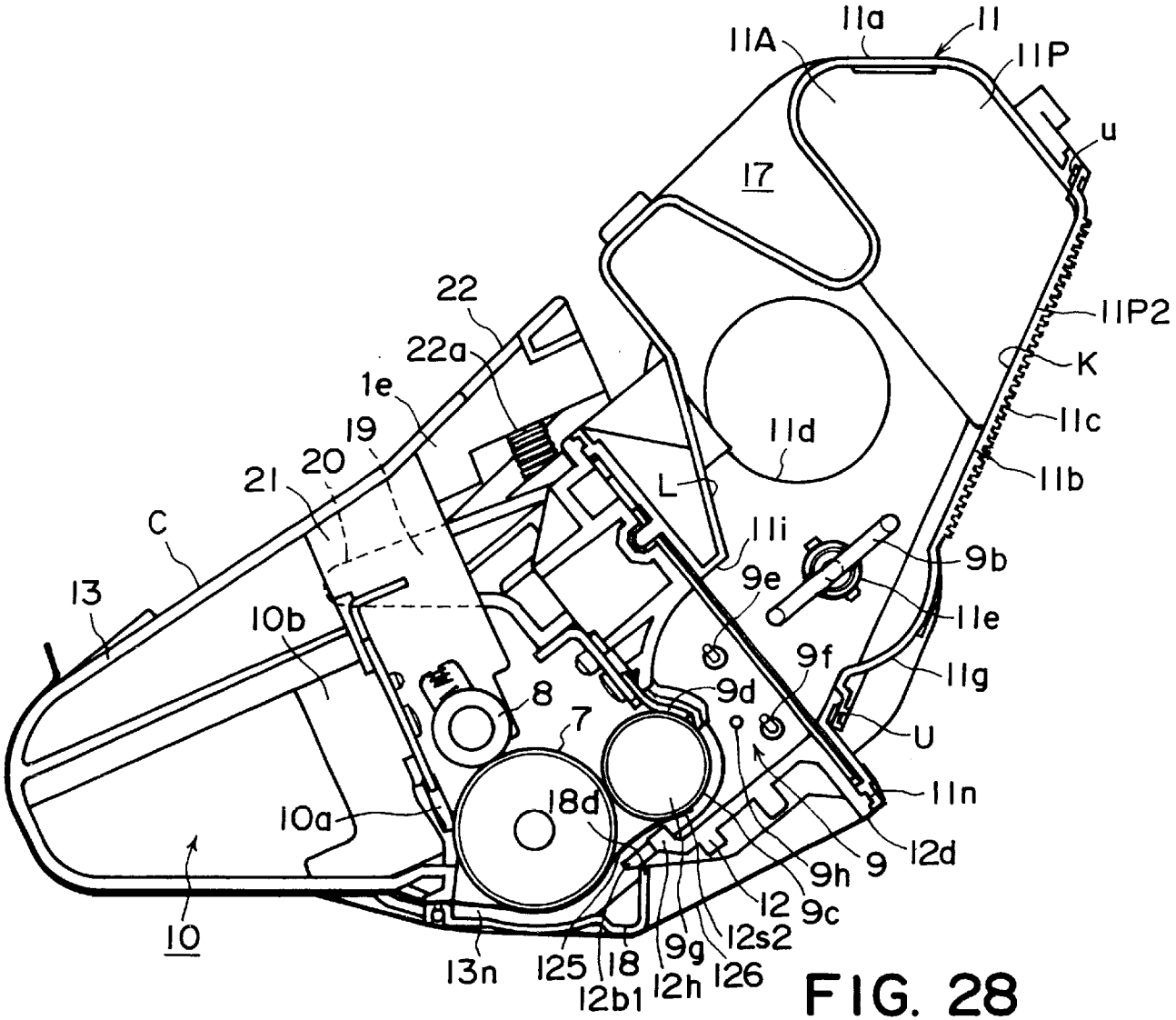
FIG. 28 is a sectional view of the process cartridge to which a protection sheet and a removable tape are affixed.
Figure 29:
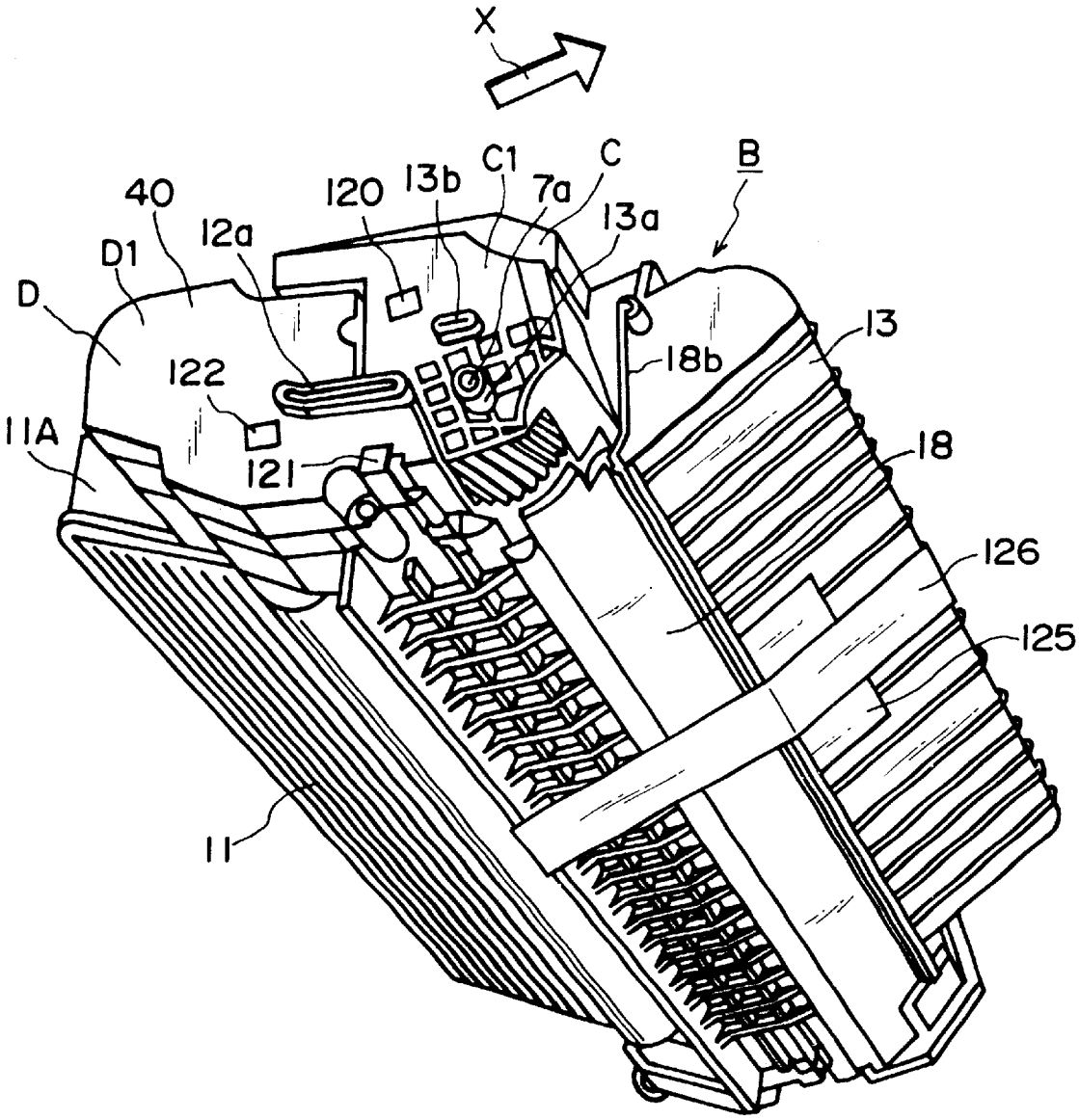
FIG. 29 is a perspective view illustrating an outer appearance of a process cartridge to which a protection sheet and a removable tape are affixed.

Thus, the present invention places a protective sheet 125 between the mandible-like portion 12*h* and the photosensitive drum 7, as shown in FIGS. 28 and 29, to prevent the edge 12*h*1 of the mandible-like portion 12*h* from directly coming into contact with the photosensitive drum 7, in order to prevent the photosensitive drum 7 from being damaged. Since the edge 12*h*1 of the mandible-like portion 12*h* does not come into contact with the photosensitive drum 7 across the entirety of the edge 12*h*1 in terms of the longitudinal direction, it is unnecessary for the protective sheet 125 to protect the photosensitive drum 7 across the entirety of the photosensitive drum 7 in terms of the longitudinal direction. In other words, the protective sheet 125 has only to be long enough to match the length of the range across which the mandible-like portion 2*h* might come into contact with the photosensitive drum 7. The length of this range can be determined through a commodity distribution test, a commodity transportation test, or the like. Referring to FIG. 29, in this embodiment, a polyethylene protective sheet 125 having a width of approximately 100 mm and a thickness of an approximately 0.1 mm is placed between the mandible-like portion 12*h* and the photosensitive drum 7, across the approximate center portion of the process cartridge B in terms of the longitudinal direction. As for the placement of the protective sheet 125, first, the protective sheet 125 is inserted from the cleaning means holding frame 13 side, through the gap between the cleaning means holding frame 13 and drum shutter 18, in a manner to cover the transfer opening 13*n*, so that the leading end of the protective sheet 125 reaches the adjacencies of where the development roller 9*c* and sealing member 12*s*2 contact each other. Then, the protective sheet 125 is secured with a piece of an ordinary tape, or a peelable tape, which will be described later, to prevent the protective sheet 125 from dislodging.

Step for Pasting of Peelable Tape

Figure 27:
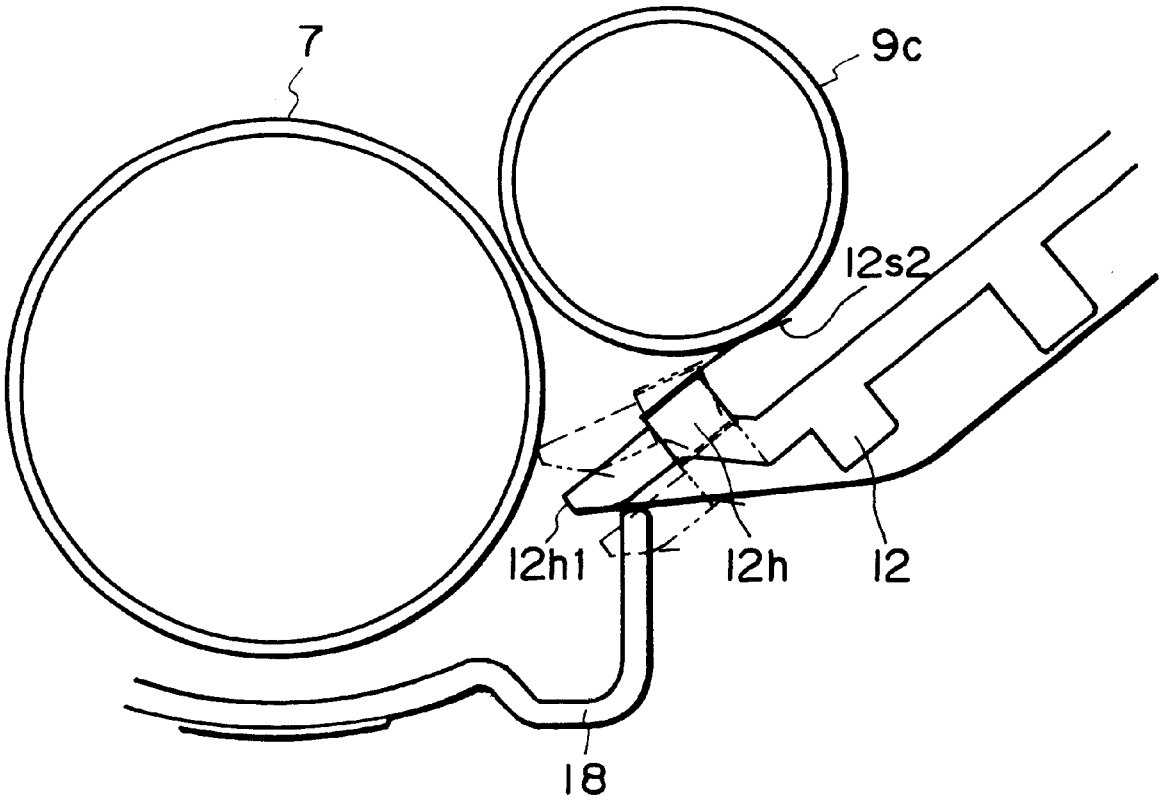
FIG. 27 is an enlarged view of a neighborhood of a free end portion of a lower jaw, illustrating deformation of the free end portion.

Next, the step for pasting of a peelable tape will be described. The above described protective sheet 125 is a measure for solving the problem which occurs as the mandible-like portion 12*h* deforms due to the vibrations and impacts during the shipment of a process cartridge, and causes the edges 12*h*1 to contact the photosensitive drum 7. In other words, it is a countermeasure for the deformation of the mandible-like portion 12*h* toward the photosensitive drum 7. However, it is quite natural that not only does the mandible-like portion 12*h* deform toward the photosensitive drum 7, but also it deforms away from the photosensitive drum 7 (FIG. 27). If the mandible-like portion 12*h* deforms away from the photosensitive drum 7, the sealing member 12*s*2 moves in the direction to become separated from the development roller 9*c*. In order to seal between the development roller 9*c* and mandible-like portion 12*h*, the portion of the sealing member 12*s*2 adjacent to one of the long edges of the sealing member 12*s*2 is pasted to the mandible-like portion 12*h*, and the other long edge of the sealing member 12*s*2 is placed in contact with the development roller 9*c*. Thus, as the mandible-like portion 12*h* moves away from the photosensitive drum 7, the contact pressure between the sealing member 12*s*2 and development roller 9*c* reduces, or the sealing member 12*s*2 becomes separated from the development roller 9*c*, allowing the toner within the developing means 9 to leak (as described before, according to the present invention, the cover film 51 is not attached when overhauling the process cartridge B, and therefore, the developing means 9 is full of toner). Therefore, according to the present invention, a tape is pasted across the cleaning unit C, drum shutter 18, and development unit D to prevent the deformation of the mandible-like portion 12*h*, in order to prevent the toner leakage.

Referring to FIG. 27, one of the ends of the drum shutter 18 in terms of the short dimension direction is in contact with, or close to, the external surface (reverse side of where the sealing member 12*s*2 is pasted) of the mandible-like portion 12*h*. Therefore, as the mandible-like portion 12*h* deforms away from the photosensitive drum 7, the external surface of the mandible-like portion 12*h* comes into contact with the aforementioned end of the drum shutter 18 in terms of the short dimension direction, causing the drum shutter 18 to deform. Thus, it is logical to think that reinforcing the drum shutter 18 so that it does not deform away from the photosensitive drum 7 also prevents the deformation of the mandible-like portion 12*h*.

Figure 30:
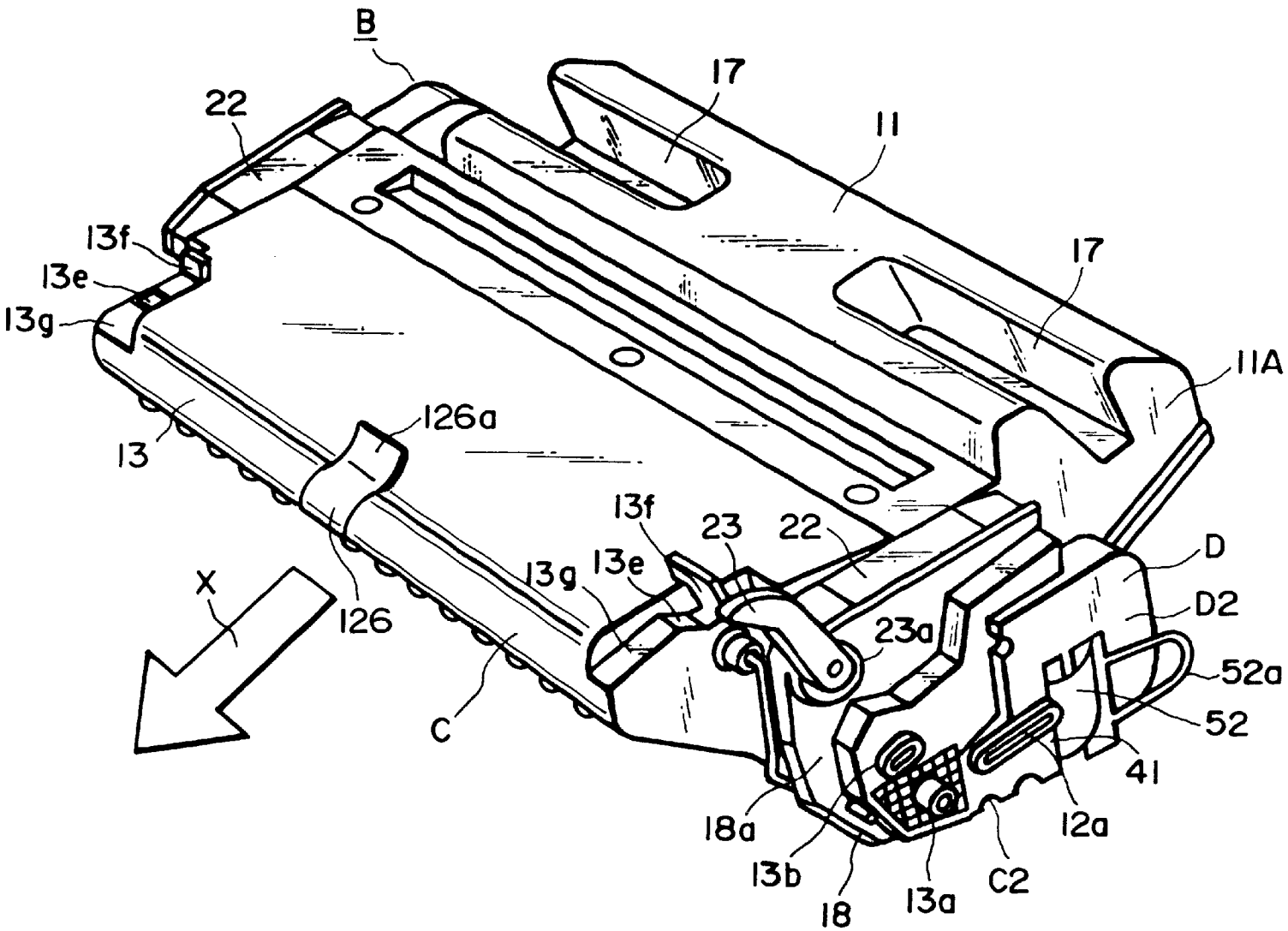
FIG. 30 is a perspective view illustrating an outer appearance of a process cartridge to which a removable tape is affixed.

Therefore, in order to reinforce of the drum shutter 18 so that it does not deform away from the photosensitive drum 7, a peelable tape 126 is pasted across the cleaning unit C, drum shutter 18, and development unit D, as shown in FIGS. 28 and 29. More specifically, one end of the peelable tape 126 is pasted to the toner holding frame 11, on the reverse side of where the groove 11*n* (FIG. 14) is present, and is stretched on the portion 12*d* of the external surface of the developing means holding frame 12 and the external surface of the drum shutter 18, reaching almost the top surface of the cleaning means holding frame 13. Between the portion 12*d* of the external surface of the developing means holding frame 12, and the portion of the drum shutter 18 to which the peelable tape 126 is pasted, the peelable tape 126 is stretched without being pasted to the process cartridge B. The portion of the drum shutter 18, with which the tape 126 comes into contact, being pasted thereto, after being stretched from the portion 12*d* of the external surface of the developing means holding frame 12, projects slightly outward of the process cartridge B. Therefore, the edge 18*d* of the drum shutter 18, that is, one of the ends of the drum shutter 18 in terms of the short dimension direction, which extends in the longitudinal direction, can be placed in contact with at least the mandible-like portion 12*h*. Also, the edge 18*d* of the drum shutter 18 can be pressed upon the mandible-like portion 12*h* by giving a certain amount of tension to the tape 126 across the aforementioned portion which is stretched without being pasted to the process cartridge B. Thus, it is very important that the peelable tape 126 is pasted without any amount of slack. This is because even if the peelable tape 126 is pasted, the presence of slack in the tape prevents the peelable tape 126 from regulating the deformation of the drum shutter 18. Therefore, the peelable tape 126 should be pasted while providing the tape 126 with a proper amount of tension, and the material for the peelable tape 126 should be as small as possible in elasticity. Further, from the standpoint of increasing tensile strength, the wider the peelable tape 126, the better. Further, since the peelable tape 126 must be peeled off, as will be described later, when the process cartridge B is used, it should be easy to peel and should not leave adhesive on the area from which it is peeled. In the present invention, the peelable tape 126 is approximately 40 mm wide. The base of the peelable tape 126 is a combination of polyester film, and polyester fibers or glass fibers. The adhesive of the peelable tape 126 is a rubber based adhesive. The peelable tape 126 is also pasted on the exposed portion of the protective sheet 125 as shown in FIG. 29. The end portion of the peelable tape 126, on the cleaning unit C side, is folded so that the adhesive covered surface of the end portion is pasted onto the adhesive covered surface of the portion of the peelable tape 126 immediately adjacent to the end portion, as shown in FIG. 30, to prevent the end portion of the peelable tape 126 from being pasted to the cleaning unit C. This portion 126*a* of the peelable tape 126, that is, the portion created by folding the end portion of the peelable tape 126 as described above, constitutes the tab portion 126*a* of the peelable tape 126 which is grasped by a user when the user intends to remove the protective sheet 125 and peelable tape 126. Although the protective sheet 125 and peelable tape 126 are necessary while the process cartridge B is transported, they get in the way when mounting the process cartridge B into the laser beam printer A for printing. Therefore, they must be removed by the user. All that is necessary for the user to do to remove them when the user mounts the process cartridge B into the laser beam printer A is to peel the peelable tape 126 by grasping the tab portion 126*a*, or the portion which has not adhered to the cleaning unit C. As the peelable tape 126 is peeled, the protective sheet 125 comes off together with the peelable tape 126 because the aforementioned exposed portion of the protective sheet 125 is pasted to the peelable tape 126. This arrangement of pasting the exposed portion of the protective tape 125 to the peelable tape 126 prevents the user from forgetting to remove the protective sheet 125, further improving the usability of the process cartridge B.

Figure 31:
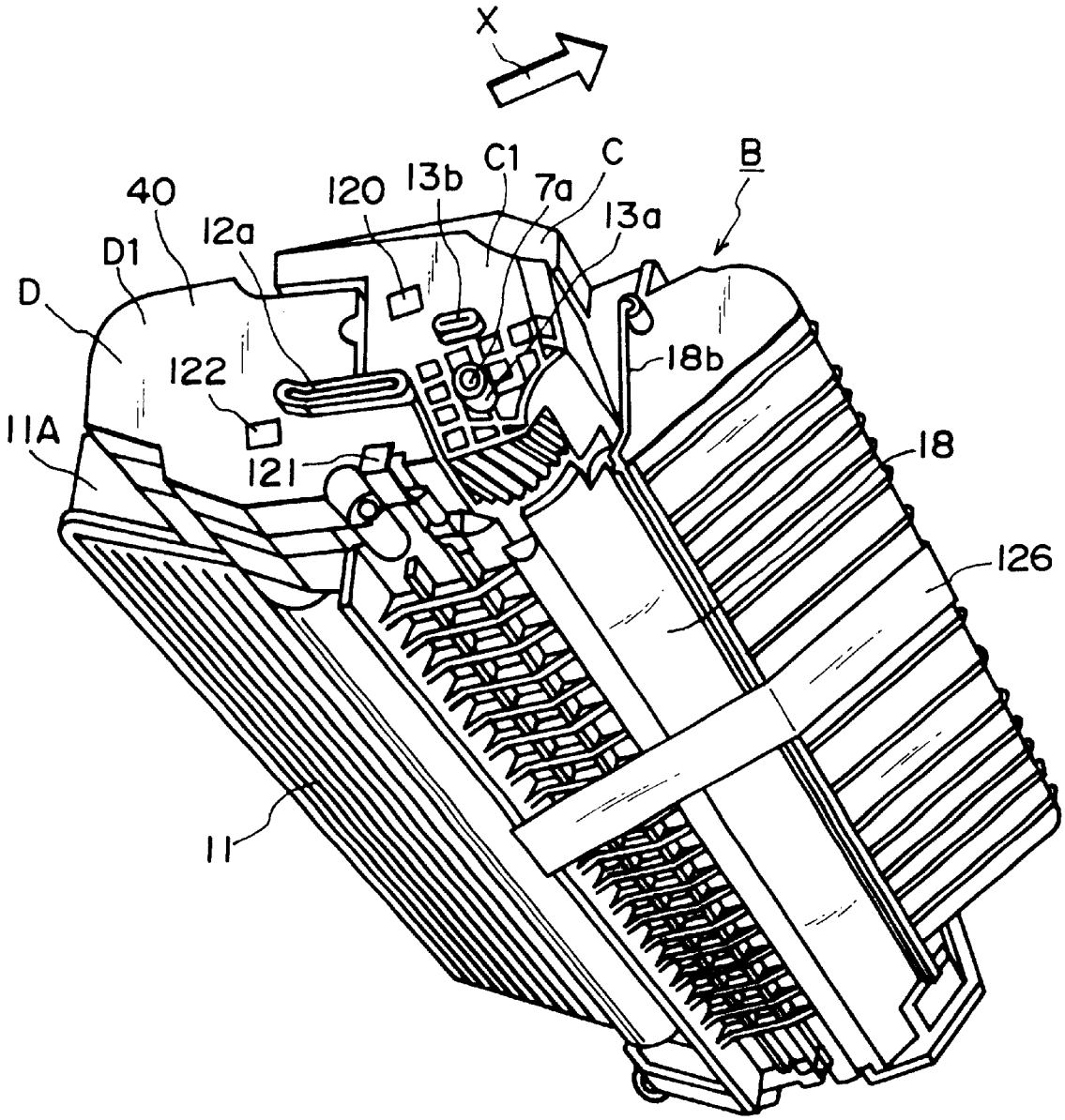
FIG. 31 is a perspective view illustrating an outer appearance of a process cartridge to which only a removable tape is affixed.
Figure 32:
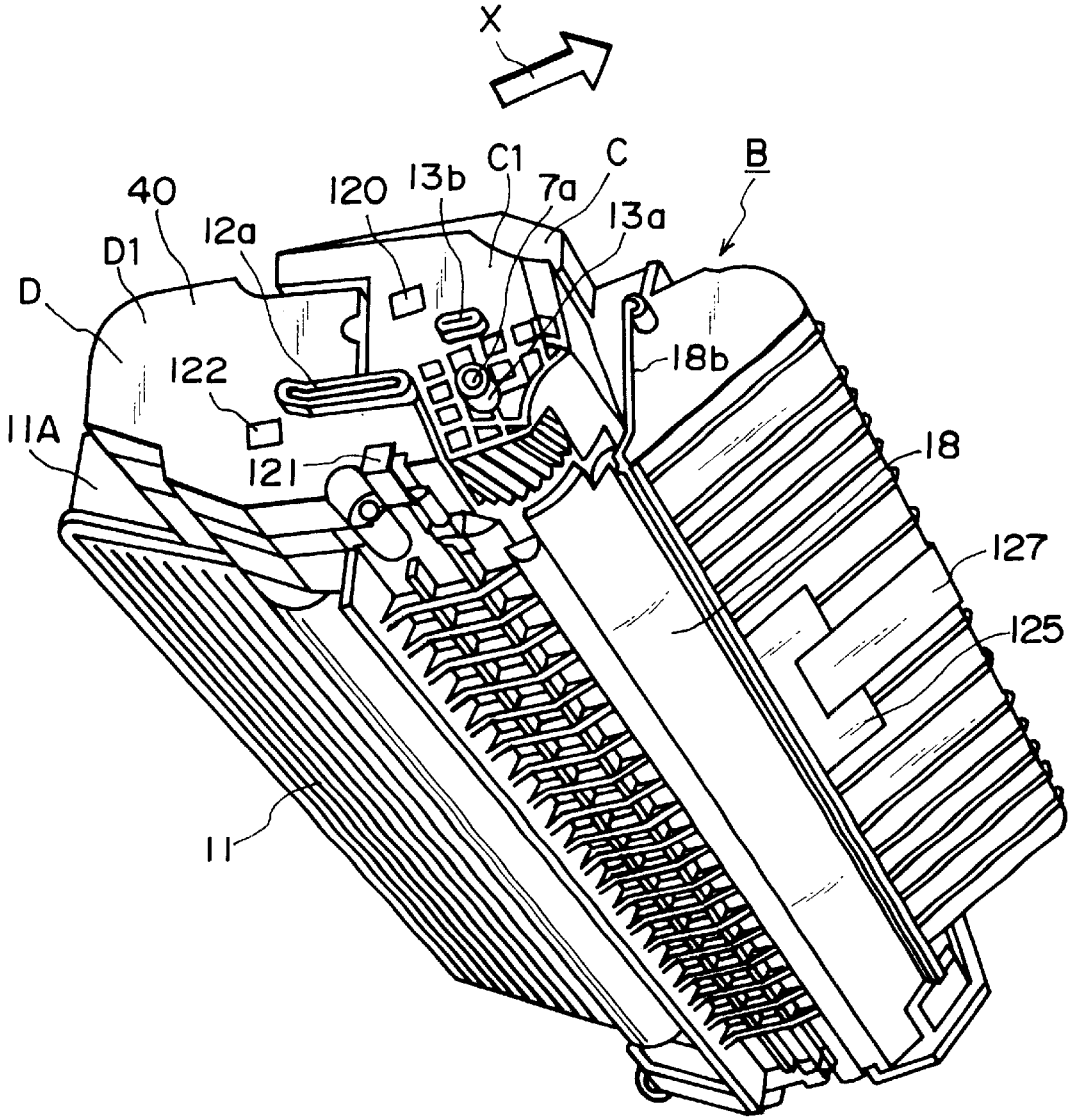
FIG. 32 is a perspective view illustrating and other appearance of a process cartridge to which only a protection sheet is affixed.

The above described case is an example of the embodiment of the present invention, in which both the protective sheet 125 and peelable tape 126 are employed as shown in FIGS. 28 and 29. However, it is unnecessary to employ both. The shape of the cross section of the mandible-like portion 12*h* varies among various process cartridges depending on the idea on which the cartridge design is based; accordingly, the resistance of the mandible-like portion 12*h* to deformation varies, and also, the distance between the edge 12*h*1 of the mandible-like portion 12*h* and the photosensitive drum 7 is not the same in all process cartridges. Thus, there are process cartridges in which the vibrations and impacts which occur during their transportation do not cause the edge 12*h*1 of the mandible-like portion 12*h* to come into contact with the photosensitive drum 7. Further, the amount by which the edge 12*h*1 of the mandible-like portion 12*h* deforms toward the drum shutter 18 varies depending on the resistance of the mandible-like portion 12*h* to deformation, which is affected by the shape of the cross section of the mandible-like portion 12*h*, the strength of the drum shutter 18, the material used for packaging the process cartridge B, and the like factors. Therefore, toner does not leak from all process cartridges. In other words, even when the mandible-like portion 12*h* deforms in the direction to cause the edge 12*h*1 of the mandible-like portion 12 to move toward the photosensitive drum 7 far enough for the edge 12*h*1 of the mandible-like portion 12*h* to come into contact with the photosensitive drum 7, due to the vibrations and impacts which occur during the transportation of the process cartridge, the mandible-like portion 12*h* does not always deform in the direction to cause the edge 12*h*1 of the mandible-like portion 12*h* to moves away from the photosensitive drum 7 far enough to allow toner to leak. On the contrary, even when the mandible-like portion 12*h* deforms in the direction to cause the edge 12*h*1 of the mandible-like portion 12 to move away from the photosensitive drum 7 far enough to allow toner to leak, the mandible-like portion 12*h* does not always come into contact with the photosensitive drum 7. Thus, the selection of the protective sheet 125 and peelable 126 are optional; they may be selected according to the specific requirements of each process cartridge. FIG. 31 shows a process cartridge which has only the peelable tape 126, and FIG. 32 shows a process cartridge which has only the protective sheet 125. In FIG. 32, a tape 127 is for preventing the protective sheet 125 from dislodging, and does not regulate the deformation of the mandible-like portion 12*h* as does the peelable tape 126. Incidentally, the peelable tape 126 in FIG. 31 and the tape 127 in FIG. 32 are pasted to the corresponding process cartridges B so that one end of each tape reaches the top surface of the cleaning means holding frame 13, and is folded back as shown in FIG. 30 (tab portion 126*a*), being not pasted to the cleaning means holding frame 13, to make it easier for a user to peel the tape.

The above described steps are the essential steps for overhauling a process cartridge. They are parts of only one example of a process cartridge overhauling method in accordance with the present invention. The order in which these steps are carried out, and a method for overhauling a process cartridge do not need to be limited to those described above. Thus, the preceding description of the present invention will be supplemented below so that a process cartridge overhauling method in accordance with the present invention will be accurately understood.

First, {Cleaning Unit Overhauling Step} was described before {Development Unit Overhauling Step}. This does not mean that {Development Unit Overhauling Step} is always carried out after {Cleaning Unit Overhauling Step}. Since the cleaning unit and development unit are separated from each other through {Step for Separating Cleaning Unit and Development Unit}, {Cleaning Unit Overhauling Step} and {Developing Unit Overhauling Step} may be carried out independently from each other. In other words, they may be carried at the same time, or in parallel, or {Development Unit Overhauling Step} may be carried out ahead of {Cleaning Unit Overhauling Step}.

Figure 26:
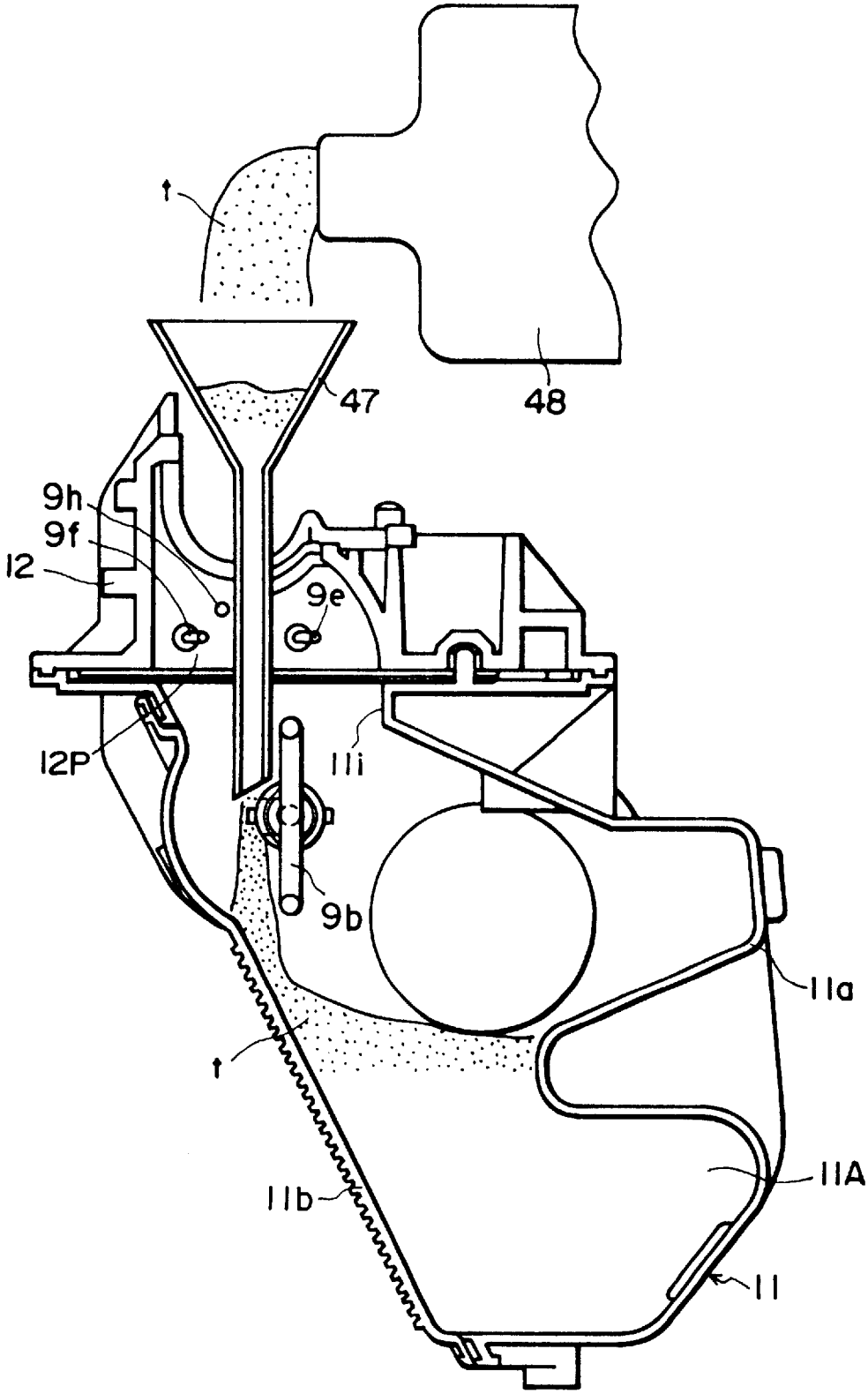
FIG. 26 is a longitudinal sectional view illustrating a toner filling step.

Secondly, {Toner Filling Step} was described as a step in which toner is filled through the hole 11*i* as shown in FIG. 26, and therefore, it was described as a step carried out after {Step for Pasting Elastic Sealing Member for Overhauling}. However, a portion through which a toner container is refilled with toner does not need to be limited to the opening 11*i*. For example, a toner container may be refilled with toner through the toner filling hole 11*d* of the toner holding frame 11. In such a case, toner leaks out if the opening 11*i* is left exposed. Therefore, the toner container should be refilled with toner after the development unit holders 40 and 41 are attached (after the development roller unit G is attached to the developing means holding frame 12) in {Process Cartridge Assembly Step}, because such an arrangement improves assembly efficiency.

Thirdly, the development blade and development roller unit, which have been removed from the development unit, and the photosensitive drum and cleaning blade, which have been removed from the cleaning unit, are not always reattached to the very development unit and cleaning unit, respectively, from which they have been removed. That is, when a process cartridge is overhauled through a so-called production line, the development blades, for example, having been removed from the development unit, are stored in a group of a certain number in a tote box or the like, and delivered to the production line after being cleaned by air blast. Therefore, there is no guarantee that each development blade is attached to the very development unit from which it was removed. However, as long as a development unit to which a given development blade is attached to is the same in specifications as the development unit from which the development blade was removed, it is not mandatory that the development blade be attached to the very development unit from which it was removed; admittedly there are some dimensional discrepancies resulting from tolerance. This is also true of the development roller unit, photosensitive drum, and cleaning blade. Further, a development unit or a cleaning unit is not always united with the cleaning unit or development unit, respectively, from which it was separated, and for the same reason as that given above regarding the development blade, it is not mandatory that a development unit or a cleaning unit be united with the very cleaning unit or development unit, respectively, from which it was separated.

The embodiment described above includes a process cartridge overhauling method in which process cartridges are recovered and disassembled after their service lives expire; the components obtained through the disassembly of the process cartridges are grouped by component type; some of the components are replaced with new components (without being recycled); and the thus obtained components are reassembled into process cartridges following the above described steps, and a process cartridge overhauling method in which a process cartridge is overhauled using the same components as those in he very process cartridge, with a few exceptions which must be replaced with new components, or recyclable components from other process cartridges.

Further, it is obvious that each of the above described steps may be automated using robots as appropriate. Not only is the present invention applicable to the above described process cartridge B for forming a monochromatic image, but also to a process cartridge which comprises a plurality of developing means 10, and forms a multicolor image (for example, dichromatic image, trichromatic image, full-color image, and the like). Further, the present invention is compatible with various well-known developing methods, for example, the two component magnetic brush based developing method, cascade developing method, touch-down developing method, and cloud developing method. Further, not only is the present invention compatible to the so-called contact charging method and structure in the above described first embodiment, but also to various other charging methods, for example, one of the conventionally used charging methods and structures, in which a piece of tungsten wire is surrounded with a shield formed of metallic material such as aluminum on three sides, and high voltage is applied to the tungsten wire to generate positive or negative ions, which are transferred onto the peripheral surface of a photosensitive drum to uniformly charge the peripheral surface of the photosensitive drum. The charging means may be in the form of a blade (charge blade), a pad, a block, a rod, or a wire, in addition to the above described roller. The method for cleaning the toner remaining on the photosensitive drum 7 may employ a cleaning means in the form of a blade, a fur brush, a magnetic brush, or the like. The above described process cartridge B may be a cartridge in which an image bearing member and a developing means are integrally disposed, and which is removably mountable in the main assembly of an image forming apparatus; a cartridge in which a charging means, a cleaning means or a developing means, and an electrophotographic photosensitive member, are integrally disposed, and which is removably mountable in the main assembly of an image forming apparatus; or a cartridge in which at least a developing means and an electrostatic photosensitive member are integrally disposed, and which is removably mountable in the main assembly of an image forming apparatus. Further, in the preceding embodiments of the present invention, a laser beam printer was referred to as an image forming apparatus. However, the application of the present invention does not need to be limited to a laser beam printer. It is obvious that the present invention is also applicable to various other image forming apparatuses, for example, an LED printer, an electrophotographic copying machine, a facsimile machine, a word processor, and the like.

As described above, the present invention realizes a simple method for overhauling a process cartridge.

While the invention has been described with reference to the structures disclosed herein, it is not confined to the details set forth and this application is intended to cover such modifications or changes as may come within the purpose of the improvements or the scope of the following claims.

What is claimed is:

1. A remanufacturing method for a process cartridge detachably mountable to a main assembly of an electrophotographic image forming apparatus, the process cartridge including a first unit supporting an electrophotographic photosensitive drum and a second unit supporting a developing roller for developing an electrostatic latent image formed on the electrophotographic photosensitive drum and having a developer accommodating portion accommodating a developer to be used for development of the electrostatic latent image by the developing roller, the first unit and the second unit being rotatably coupled, said method comprising:

(a) a unit separating step of separating the first unit and the second unit from each other;

(b) a developer filling step of filling the developer into the developer accommodating portion of the second unit;

(c) a unit coupling step of coupling the first unit and the second unit with each other; and (d) a tape affixing step of removably affixing a tape along an outer surface of the first unit, an outer surface of a drum shutter for covering such a portion of the electrophotographic photosensitive drum which is exposed from the first unit and the second unit, and an outer surface of the second unit.

2. A method according to claim 1, further comprising a developing roller dismounting step of dismounting the developing roller from the second unit prior to said developer filling step, and a developing roller mounting step of mounting a developing roller to the second unit prior to said unit coupling step.

3. A method according to claim 2, wherein the developing roller to be mounted to the second unit in said developing roller mounting step is the developing roller removed from the second unit of the process cartridge, or a developing roller removed from a second unit of another process cartridge.

4. A method according to claim 1, 2 or 3, further comprising a developing blade dismounting step of dismounting from the second unit a developing blade mounted on the second unit for regulating an amount of the developer to be deposited on the developing roller, and a developing blade mounting step of mounting the developing blade on the second unit prior to said unit coupling step.

5. A method according to claim 4, wherein the developing blade to be mounted to the second unit in said developing blade mounting step is the developing blade removed from the second unit of the process cartridge in said developing blade dismounting step, or a developing blade removed from a second unit of another process cartridge.

6. A method according to claim 1, 2, or 3, wherein in said developer filling step, the developer is supplied into the developer accommodating portion through a developer supply opening for supplying to the developing roller.

7. A method according to claim 1, 2, or 3, wherein in said developer filling step, the developer is supplied into the developer accommodating portion through a developer filling port provided in a developer accommodation frame which constitutes the developer accommodating portion.

8. A method according to claim 1, 2, or 3, wherein the first unit and the second unit coupled in said unit coupling step are those separated in said unit separating step, or are those randomly selected from first units and second units provided by separating them in a plurality of process cartridges.

9. A method according to claim 1, 2, or 3, wherein in said tape affixing step, the tape is affixed substantially along longitudinally central portions of the first unit, the drum shutter and the second unit.

10. A method according to claim 1, 2, or 3, further comprising a protection sheet mounting step of mounting a pullable protection sheet so as to extend between the first unit and the drum shutter and between an inner surface of the second unit and the developing roller.

11. A method according to claim 10, wherein in said protection sheet mounting step, the protection sheet is mounted substantially along longitudinally central portions of the first unit, the drum shutter and the second unit.

12. A method according to claim 10, wherein in said tape affixing step, the tape is affixed on an outer surface of the protection sheet.

13. A method according to claim 10, wherein before the process cartridge remanufactured by said remanufacturing method, the tape is removed and the protection sheet is pulled out from a mount position when the tape is removed.

14. A method according to claim 1, 2, or 3, wherein the tape comprises polyester film as a base material.

15. A method according to claim 10, wherein the sheet used in said protection sheet mounting step is made of polyethylene.

16. A method according to claim 1, 2, or 3, wherein the tape is affixed with a tension applied thereto.

17. A method according to claim 1, 2, or 3, further comprising:

a cleaning blade and electrophotographic photosensitive drum dismounting step of dismounting a cleaning blade for removing the developer remaining on the electrophotographic photosensitive drum and the electrophotographic photosensitive drum, from the first unit, prior to said unit coupling step; and a developer removing step of removing from the first unit the developer removed from the electrophotographic photosensitive drum by the cleaning blade.

18. A method according to claim 17, wherein the dismounted electrophotographic photosensitive drum is reused or is replaced with a new electrophotographic photosensitive drum, or the dismounted cleaning blade is reused or is replaced with a new cleaning blade, or a developing blade mounted on the second unit is dismounted and the dismounted developing blade is reused or replaced with a new developing blade, or the developing roller is dismounted from the second unit and the dismounted developing roller is reused or replaced with a new developing roller.

19. A method according to claim 18, wherein the electrophotographic photosensitive drum in the process cartridge after said coupling step is the one removed from the first unit of the process cartridge or an electrophotographic photosensitive drum dismounted from a first unit of another process cartridge.

20. A method according to claim 18, wherein the cleaning blade in the process cartridge after said coupling step is the one dismounted from the first unit of the process cartridge in said cleaning blade and electrophotographic photosensitive drum dismounting step or a cleaning blade dismounted from a first unit of another process cartridge.

21. A remanufacturing method for a process cartridge detachably mountable to a main assembly of an electrophotographic image forming apparatus, the process cartridge including a first unit supporting an electrophotographic photosensitive drum and a cleaning blade for removing a developer remaining on the electrophotographic photosensitive drum, and a second unit supporting a developing roller for developing an electrostatic latent image formed on the electrophotographic photosensitive drum and having a developer accommodating portion accommodating a developer to be used for development of the electrostatic latent image by the developing roller, the first unit and the second unit being rotatably coupled, said method comprising:

(a) a unit separating step of separating the first unit and the second unit from each other;

(b) a drum replacing step of replacing the electrophotographic photosensitive drum mounted to the first unit with a new electrophotographic photosensitive drum;

(c) a developing roller dismounting step of dismounting the developing roller from the second unit;

(d) a developing blade dismounting step of dismounting from the second unit a developing blade, mounted to the second unit, for regulating an amount of the developer deposited on the developing roller;

(e) a developer filling step for filling the developer into the developer accommodating portion from a developer supply opening for supplying the developer to the developing roller from the developer accommodating portion;

(f) a developing blade mounting step of mounting a developing blade to the second unit;

(g) a developing roller mounting step of mounting a developing roller to the second unit;

(h) a unit coupling step of coupling the first unit and the second unit with each other;

(i) a protection sheet mounting step of mounting a pullable protection sheet so as to extend between the first unit and a drum shutter and between an inner surface of the second unit and the developing roller; and (j) a tape affixing step of removably affixing a tape along an outer surface of the first unit, an outer surface of a drum shutter for covering such a portion of the electrophotographic photosensitive drum which is exposed from the first unit and a second unit, an outer surface of the second unit.

22. A method according to claim 21, wherein the developing roller to be mounted to the second unit in said developing roller mounting step is the developing roller dismounted from the second unit of the process cartridge in said developing roller dismounting step, or a developing roller removed from a second unit of another process cartridge.

23. A method according to claim 21 or 22, wherein the developing blade to be mounted to the second unit in said developing blade mounting step is the developing blade dismounted from the second unit of the process cartridge, in said developing blade dismounting step or a developing blade removed from a second unit of another process cartridge.

24. A method according to claim 21 or 22, wherein the first unit and the second unit coupled in said unit coupling step are those separated in said unit separating step, or are those randomly selected from first units and second units provided by separating them in a plurality of process cartridges.

25. A method according to claim 21 or 22, wherein in said tape affixing step, the tape is affixed substantially along longitudinally central portions of the first unit, the drum shutter and the second unit.

26. A method according to claim 21 or 22, wherein in said protection sheet mounting step, the protection sheet is mounted substantially along longitudinally central portions of the first unit, the drum shutter and the second unit.

27. A method according to claim 21 or 22, wherein in said tape affixing step, the tape is affixed on an outer surface of the protection sheet.

28. A method according to claim 21 or 22, wherein before the process cartridge is remanufactured by said remanufacturing method, the tape is removed and the protection sheet is pulled out from a mount position when the tape is removed.

29. A method according to claim 21 or 22, wherein the tape comprises polyester film as a base material.

30. A method according to claim 21 or 22, wherein the sheet used in said protection sheet mounting step is made of polyethylene.

31. A method according to claim 21 or 22, wherein the tape is affixed with a tension applied thereto.

32. A method according to claim 21 or 22, wherein in said drum replacing step, a cleaning blade for removing the developer remaining on the electrophotographic photosensitive drum and the electrophotographic photosensitive drum are removed, from the first unit, and said method further comprising a developer removing step of removing from the first unit the developer removed from the electrophotographic photosensitive drum by the cleaning blade.

33. A method according to claim 32, wherein the removed electrophotographic photosensitive drum is reused or is replaced with a new electrophotographic photosensitive drum, or the removed cleaning blade is reused or is replaced with a new cleaning blade, or the dismounted developing blade is reused or replaced with a new developing blade, or the dismounted developing roller is reused or replaced with a new developing roller.

34. A method according to claim 33, wherein the cleaning blade in the process cartridge after said coupling step is the one removed from said first unit of the process cartridge or is a cleaning blade dismounted from a first unit of another process cartridge.

* * * * *

UNITED STATES PATENT AND TRADEMARK OFFICE

CERTIFICATE OF CORRECTION

PATENT NO. : 6,643,482 B2
DATED : November 4, 2003
INVENTOR(S) : Akira Higeta et al.

It is certified that error appears in the above-identified patent and that said Letters Patent is hereby corrected as shown below:

Column 1,
Line 10, “as” should read -- as a --.
Line 49, “are is” should read -- is --.
Line 51, “through” should read -- through an --.

Column 2,
Line 2, “provides” should read -- provided --.
Line 66, “t” should read -- a --.

Column 6,
Line 49, “pivotal” should read -- pivotally --.

Column 7,
Line 14, “pivotal” should read -- pivotally --.
Line 44, “nonrotationally” should read -- non-rotationally --.

Column 8,
Line 42, “and” should read -- end --.

Column 11,
Line 58, “entirely” should read -- entirety --.

Column 14,
Line 13, “two” should read -- by two --.

Column 16,
Line 10, “the” (first occurrence) should be deleted.

Column 18,
Line 12, “end” should read -- ends --.
Line 64, “pressed” should read -- pressed against --.

Column 19,
Line 47, “the rib” should read -- rib --.
Line 48, “melted” should read -- is melted --.
Line 64, “holing” should read -- holding --.

Column 20,
Line 2, “holing” should read -- holding --.

UNITED STATES PATENT AND TRADEMARK OFFICE

CERTIFICATE OF CORRECTION

PATENT NO. : 6,643,482 B2
DATED : November 4, 2003
INVENTOR(S) : Akira Higeta et al.

It is certified that error appears in the above-identified patent and that said Letters Patent is hereby corrected as shown below:

Column 21,
Line 30, “he” should read -- the --.

Column 22,
Line 28, “he” should read -- the --.
Line 32, “an” should read -- and --.

Column 23,
Line 26, “connected” should read -- connected to --.

Column 25,
Line 59, “he” should read -- the --.

Column 30,
Line 11, “the all” should read -- all --.
Line 67, “holder” should read -- holders --.

Column 31,
Line 45, “he” should read -- the --.

Column 32,
Line 59, “he” should read -- the --.

Column 33,
Line 29, “the each” should read -- each --.

Column 35,
Line 40, “removed” should read -- remove --.
Line 56, “holder” should read -- holders --.

Column 36,
Line 9, “constitute” should read -- constitutes --.
Line 11, “holder” should read -- holders -- and “supports” should read -- support --.
Line 13, “holder” should read -- holders --.

Column 37,
Line 30, “holder” should read -- holders --.

UNITED STATES PATENT AND TRADEMARK OFFICE

CERTIFICATE OF CORRECTION

PATENT NO. : 6,643,482 B2
DATED : November 4, 2003
INVENTOR(S) : Akira Higeta et al.

It is certified that error appears in the above-identified patent and that said Letters Patent is hereby corrected as shown below:

Column 39,
Line 16, “holder” should read -- holders --.
Line 29, “enlarges” should read -- enlarged --.

Column 40,
Line 17, “an” should be deleted.

Column 42,
Line 51, “moves” should read -- move --.
Line 58, “peelable” should read -- peelable tape --, and “are” should read -- is --.

Column 43,
Line 25, “carried” should read -- out --.

Column 44,
Line 15, “he” should read -- the --.

Column 45,
Line 59, “supplying” should read -- supplying developer --.

Column 46,
Line 20, “cartridge” should read -- cartridge is --.

Column 47,
Line 39, “an” should read -- and an --.

Signed and Sealed this

Fifteenth Day of June, 2004

JON W. DUDAS
*Acting Director of the United States Patent and Trademark Office*